US007369807B2

(12) United States Patent
Naruse et al.

(10) Patent No.: US 7,369,807 B2
(45) Date of Patent: May 6, 2008

(54) CLEANER, AND PROCESS CARTRIDGE AND IMAGE FORMING APPARATUS USING THE CLEANER

(75) Inventors: Osamu Naruse, Yokohama (JP); Hidetoshi Yano, Yokohama (JP); Masahiko Shakuto, Kawasaki (JP); Kazuhiko Watanabe, Koganei (JP)

(73) Assignee: Ricoh Company, Limited, Tokyo (JP)

( * ) Notice: Subject to any disclaimer, the term of this patent is extended or adjusted under 35 U.S.C. 154(b) by 301 days.

(21) Appl. No.: 11/126,233

(22) Filed: May 11, 2005

(65) Prior Publication Data

US 2005/0254868 A1 Nov. 17, 2005

(30) Foreign Application Priority Data

May 11, 2004 (JP) ..... 2004-141653
May 12, 2004 (JP) ..... 2004-142191
May 21, 2004 (JP) ..... 2004-151225
Jun. 30, 2004 (JP) ..... 2004-194300

(51) Int. Cl.
*G03G 21/00* (2006.01)

(52) U.S. Cl. ..... 399/351; 399/350

(58) Field of Classification Search ..... 399/350, 399/351; 15/97.1, 93.1, 236.01, 256.5
See application file for complete search history.

(56) References Cited

U.S. PATENT DOCUMENTS 4,803,752 A * 2/1989 Kasama ..... 399/350
4,969,015 A * 11/1990 Sanpe ..... 399/351
6,580,897 B2 * 6/2003 Sato et al. ..... 399/350
6,799,012 B2 9/2004 Shakuto et al.
6,907,210 B2 * 6/2005 Wazana et al. ..... 399/351
7,212,778 B2 * 5/2007 Hisakuni ..... 399/350
2002/0048473 A1 * 4/2002 Yamada et al. ..... 399/350
2003/0039494 A1 2/2003 Shakuto et al.

(Continued)

FOREIGN PATENT DOCUMENTS

JP 6-289760 10/1994

(Continued)

OTHER PUBLICATIONS

U.S. Appl. No. 10/943,980, filed Sep. 20, 2004, Osmau Naruse et al.

*Primary Examiner*—Susan Lee
(74) *Attorney, Agent, or Firm*—Oblon, Spivak, McClelland, Maier & Neustadt, P.C.

(57) ABSTRACT

A cleaner for cleaning a surface of a rotating material, including an elastic blade arranged to counter the rotating material while a tip of the elastic blade is contacted with the surface of the rotating material to clean the surface of the rotating material, wherein the elastic blade has a first surface facing the rotating material, and a second surface opposite to the first surface thereof, and wherein the elastic blade has a recessed portion, which has a bottom surface and a wall, in a rear portion of the second surface; and a support plate configured to support the elastic blade, wherein the support plate has a first surface facing the rotating material, a second surface opposite to the first surface and a tip surface, wherein the elastic blade is connected with the support plate in such a manner that the bottom surface and the wall of the recessed portion of the blade are contacted with the first surface and the tip surface of the support plate, respectively.

43 Claims, 28 Drawing Sheets

U.S. PATENT DOCUMENTS

| | | | | |
|---|---|---|---|---|
| 2004/0105710 | A1 | 6/2004 | Shakuto et al. | |
| 2004/0109712 | A1* | 6/2004 | Muto et al. | 399/350 |
| 2004/0170455 | A1* | 9/2004 | Shintani et al. | 399/350 |
| 2004/0197122 | A1 | 10/2004 | Nakano et al. | |
| 2004/0265024 | A1 | 12/2004 | Naruse et al. | |

FOREIGN PATENT DOCUMENTS

| | | | |
|---|---|---|---|
| JP | 2000-147970 | | 5/2000 |
| JP | 2001-312191 | | 11/2001 |
| JP | 2004053810 A | * | 2/2004 |

* cited by examiner

PERIPHERAL LENGTH : L1
AREA : S

CIRCLE WITH AREA OF S
PERIPHERAL LENGTH : L2

CLEANER, AND PROCESS CARTRIDGE AND IMAGE FORMING APPARATUS USING THE CLEANER

BACKGROUND OF THE INVENTION

1. Field of the Invention

The present invention relates to a cleaner for use in cleaning a material to be cleaned, and more particularly to a cleaner including a support and an elastic blade which is bonded with the support. In addition, the present invention also relates to a process cartridge and an image forming apparatus using the cleaner.

2. Discussion of the Background

Electrophotographic image forming apparatus typically include the following devices:

(1) an image bearing member (such as photoreceptors) configured to bear an electrostatic latent image;

(2) a charging device configured to charge the image bearing member;

(3) an irradiating device configured to irradiate the charged image bearing member with imagewise light to form an electrostatic latent image on the image bearing member;

(4) a developing device configured to develop the electrostatic latent image with a developer including a toner to prepare a toner image on the image bearing member;

(5) a transfer device configured to transfer the toner image onto a receiving material; and (6) a cleaning device configured to remove toner particles remaining on the image bearing member even after the image transfer process.

The cleaning device typically includes a cleaner having a cleaning blade. Specific examples of the blade include metal blades, and blades made of an elastic material such as urethane rubbers. Metal blades have a drawback in that the portion of the metal blades contacted with an image bearing member does not deform and thereby the tip of the metal blades cannot be closely contacted with the image bearing member. Therefore, small spaces are formed between the tip of the blade and the surface of the image bearing member if the tip has a poor dimensional accuracy or the image bearing member to be cleaned has a rough surface. When there are small spaces between the tip of the blade and the surface of the image bearing member, toner particles to be removed pass through the spaces, resulting in occurrence of a bad cleaning problem. In contrast, elastic blades can be deformed along the surface of the image bearing member and therefore the elastic blades can be closely contacted with the surface even when the tip of the blade has a poor dimensional accuracy or the image bearing member to be cleaned has a rough surface. Thus, the elastic blades have better cleanability than the metal blades. Specific examples of the materials for use in the elastic blades include rubbers.

Recently, a need exists for electrophotographic image forming apparatus capable of producing high quality images. In order to produce high quality images, it is important to use a toner having a spherical form and a small particle diameter. Specifically, spherical toners which are prepared by a polymerization method have been typically used now. Such spherical toners have an advantage of having better transfer efficiency than toners which are prepared by a pulverization method and have irregular forms. However, spherical toners have a drawback in that the toner particles remaining on an image bearing member cannot be well removed, resulting in occurrence of the bad cleaning problem (i.e., occurrence of a background fouling problem in that background areas of images are soiled with toner particles).

Then conventional cleaners for use in cleaning the surface of image forming members will be explained.

A cleaning blade is typically set so as to be contacted with a rotating image bearing member while the blade counters the rotating image bearing member to scrape off toner particles remaining on the image bearing member. Since elastic materials such as urethane rubbers used for such a cleaning blade typically have a high friction coefficient against image bearing members, the cleaning blade cannot smoothly slip on the surface of the image bearing member when the elastic materials are used as they are. Therefore, problems in that the tip of the blade is drawn by the rotated image bearing members (i.e., the tip is forcibly everted in the opposite direction, this problem is hereinafter referred to as an everted blade problem) or the tip vibrates occur. However, since toner particles and fine powders added to the toners as a fluidity improving agent are present at a nip between the blades and the surface of the image bearing members, the blades can slide on the image bearing members.

Some of toner particles scraped off an image bearing member still stay at the tip of the blade because the image bearing member is rotating. Such toner particles as staying at the tip of the blade decrease the friction coefficient between the blade and the image bearing member. Therefore, the cleaning operation can be well performed without causing the everted blade problem.

In contrast, spherical toners cannot stay at the tip of a blade. Therefore, it becomes impossible to decrease the friction coefficient between the blade and an image bearing member. In this case, the surface of the image bearing member is grounded, resulting in formation of a powder of the photosensitive layer of the image bearing member. The thus formed powder aggregates and adheres to the portion of the blade contacted with the image bearing member. Therefore, toner particles can easily pass through the contact portion, resulting in occurrence of the bad cleaning problem.

FIG. 1 is a schematic view illustrating a background cleaner. A cleaner 1A includes a support plate 2A and an elastic blade 3A which are bonded to each other. The elastic blade 3A makes a pressure-contact with the surface of a photoreceptor 4A serving as an image bearing member and rotating in a direction indicated by an arrow A. The blade 3A scrapes off toner particles T remaining on the surface of the photoreceptor 4A even after a transfer process. The elastic blade 3A is made of a material, for example, a polyurethane elastomer, and the support plate 2A is made of, for example, a metal. In this regard, a front portion of a surface 5A of the support plate 2A, which surface faces the surface of the photoreceptor 4A and which is hereinafter referred to as a first surface, is bonded with a rear portion 7A of a surface 6A of the blade 3A, which surface is hereinafter referred to as a back surface of the blade 3A (the back surface is sometimes referred to as a second surface). A front portion 8A of the elastic blade 3A extends from a tip surface 9A of the support plate 2A to the side of the photoreceptor 4A without being bonded with the support plate 2A.

In this regard, the blade 3A is pressed toward the surface of the photoreceptor 4A, and therefore the blade 3A receives a reactive force N from the photoreceptor 4A. Therefore, the elastic blade 3A is deformed so as to be curved as illustrated in FIG. 2 with exaggeration. Specifically, the blade 3A is sharply bent at a boundary portion 10A between a rear portion 7A and the front portion 8A as illustrated in FIG. 2.

Therefore, the entire of the first portion of a front surface 11A of the blade 3A is contacted with the surface of the photoreceptor 4A at a contact area of AR. Namely, the body of the blade 3A contacts the surface of the photoreceptor 4A. In this case, the pressure of the blade 3A applied to the surface of the photoreceptor 4A is low, and thereby the cleanability of the blade 3A deteriorates. Particularly, in a case of a spherical toner having a high circularity, the spherical toner is rotated when the toner is contacted with the blade 3A, and thereby the toner invades the nip between the blade 3A and the surface of the photoreceptor 4A while rotating. Finally, such toner particles pass through the nip, and thereby the background fouling problem occurs. Namely, the cleaner 1A has poor cleanability.

In attempting to solve the problem, a cleaner 1B illustrated in FIG. 3 is proposed in published unexamined Japanese patent application No. (hereinafter referred to as JP-A) 2000-147970. The cleaner 1B also has an elastic blade 3B and a support plate 2B. The blade 3B has a groove 12B into which the support plate 2B is inserted. The entire surface of the groove 12B is bonded with the support plate 2B. In this cleaner, the elastic blade 3B receives a reactive force N from a photoreceptor 4B, and therefore the blade 3B tends to be bent in a direction indicated by an arrow M. However, the bottom surface of the groove 12B of the blade 3B is bonded with a tip surface 9B of the support plate 2B, and thereby the blade 3B is not bent so largely as in the case of the blade 3A. Namely, the area of the portion of a surface 11B of the blade 3B contacted with the surface of the photoreceptor 4A is not so large as that in the case of the blade 3A.

In this case, since a back surface 13B of the support plate 2B inserted into the groove 12B is also bonded with a surface 14B of the groove 12B, the surface 14B cannot slip in a direction indicated by an arrow B. Therefore, the blade 3B receives a force so as not to be bent. As a result, the amount of deformation of the blade 3B is small. In this case, the area of the portion of the blade 3B contacted with the photoreceptor 4B is excessively small, and therefore the pressure of the blade 3B applied to the photoreceptor 4B greatly varies in a longitudinal direction of the blade 3B (i.e., a direction perpendicular to the surface of the sheet including FIG. 3). Therefore, the cleaner 1B has poor cleanability. In particular, when the toner is a spherical toner, the cleaner has very poor cleanability.

Therefore, in order to impart good cleanability to a cleaner, it is necessary that the blade thereof is properly bent so that the tip of the blade is contacted with a material to be cleaned such as photoreceptors at a proper contact area, which results in increase of the contact pressure of the blade and uniformity the pressure of the blade in the longitudinal direction thereof.

JP-A 2001-312191 discloses an image forming apparatus which uses a spherical toner having a form factor SF-1 of from 100 to 140 and another form factor SF-2 of from 100 to 120 and a cleaner having a cleaning blade which is contacted with the surface of the image bearing member so as to counter the image bearing member relative to the rotation direction of the image bearing member. In this image forming apparatus, various conditions are controlled to prevent toner particles remaining on the image bearing member from passing through the nip between the blade and the surface of the image bearing member. Specifically, the conditions are as follows:

(1) linear pressure of blade: 20 to 60 gf/cm (i.e., 0.196 to 0.588 N/cm);
(2) hardness of blade: 50 to 80°; and
(3) repulsion elasticity: 10 to 50%.

JP-A 06-289760 discloses an image bearing apparatus having a cleaning device in which a cleaning metal blade held by a holding mechanism is contacted with the surface of an image bearing member and which has a pressing mechanism located between the tip of the blade and the holding mechanism. In this image forming apparatus, the holding mechanism presses the tip of the blade to the surface of the image bearing member and the pressing mechanism supplementarily presses the tip of the blade to the surface of the image bearing member.

However, as a result of the present inventors' study, it is found that the technique disclosed in JP-A 2001-312191 cannot sufficiently prevent residual spherical toner particles from passing through the nip because the linear pressure is less than 60 g/cm (0.588 N/cm). Therefore, the present inventors have investigated the mechanism of the bad cleaning problem as mentioned above. As a result thereof, the present inventors discover that the mechanism is the following.

FIG. 4 is a schematic view illustrating the configuration of a cleaning blade and an image bearing member (i.e., a photoreceptor). The tip of a cleaning blade 3 contacts the surface of a photoreceptor drum 4 so as to counter the photoreceptor drum 4 which rotates in a direction A. In this regard, the blade 3 contacts the surface of the photoreceptor drum 4 at an initial contact angle of θ, while the blade is deformed in an amount of (d).

The initial contact angle is defined as the angle formed by a line F (i.e., the line of the first surface of the blade 3 when the blade 3 is not contacted with the photoreceptor 4) and a line G which is a tangent line at an intersection C of the line F and the surface of the photoreceptor 4. In addition, the deformation amount (d) is defined as the distance between the line G and a line H which is parallel to the line G and includes an edge 3*b* of the blade 3 when the blade is not contacted with the photoreceptor.

When the cleaning blade 3 is set so as to have such a configuration as illustrated in FIG. 4, the procedure is as follows.

(1) at first, the edge 3*b* of the blade 3 is brought into contact with the surface of the photoreceptor 4; and
(2) then the blade 3 is moved so as to approach the surface along the normal line of the photoreceptor at the contact point without changing the posture of the blade so that the cleaner has the configuration as illustrated in FIG. 4.

The rear portion of the cleaning blade 3 is adhered to a metal plate 2 which serves as a support member and which is fixed to a casing (not shown). The blade 3 preferably has a thickness t1 of from 0.5 mm to 2.0 mm. The front portion of the blade 3 preferably has a length t4 of from 3.0 mm to 10.0 mm. Suitable materials for use in the blade 3 include elastic materials such as rubbers. More preferably, polyurethane having a hardness of from 65° to 80° and a repulsion elasticity of from 20 to 60% is used for the blade 3.

FIG. 5 is a schematic cross sectional view illustrating the tip portion of the blade 3 at a time the photoreceptor 4 is not rotated. In this case, the cleaning blade 3 is contacted with the photoreceptor 4 while deformed in an amount of (d). This state is hereinafter referred to as a slip state.

FIG. 6 is a schematic cross sectional view illustrating the tip portion of the blade when the photoreceptor 4 is rotated in a direction A. In this case, the edge 3*b* of the cleaning blade 3 is allowed to move in the direction A due to friction force between the blade and the surface of the photoreceptor, and finally a portion of the tip surface of the blade contacts the surface of the photoreceptor 4. This state is hereinafter referred to as a stick state. Numeral 3*a* represents a first surface of the tip portion of the blade 3.

In this case (i.e., when the photoreceptor 4 is rotated), the restoring force of the deformed portion of the blade 3 is balanced with the dynamic friction between the blade 3 and the photoreceptor 4. In contrast, when the photoreceptor is stopped, the tip portion of the blade is maintained to be deformed due to the static friction between the blade 3 and the photoreceptor 4 which is greater than the restoring force of the deformed portion of the blade 3. Therefore, when the dynamic friction does not vary and in addition the static friction is greater than the restoring force of the deformed tip portion of the blade, the stick state is maintained.

In the stick state, the area of the portion of the blade 3 contacted with the surface of the photoreceptor drum 4 is smaller than that in the slip state. In addition, in the stick state, the edge portion of the tip of blade is deformed as illustrated in FIG. 6 due to the friction force received from the photoreceptor 4. This deformation is not caused when the blade is in a slip state. The restoring force acts in such a direction that the pressure of the blade 3 to the photoreceptor 4 increases. Thus, in the stick state, the area of the portion of the blade contacted with the photoreceptor is small and in addition the compressive elasticity of the blade acts such that the pressure of the blade to the photoreceptor increases. Therefore, the pressure in the stick state is greater than that in the slip state, and thereby the toner passing problem hardly occurs. Therefore, it is preferable to stably maintain the stick state during the cleaning operation.

The present inventors made an experiment in which a cleaning blade is contacted with a surface of a transparent cylinder having the same frictional property as that of a photoreceptor drum to carefully observe the contact portion of the blade and the cylinder. Specifically, the contact portion of the blade and the transparent cylinder on which toner particles are present was observed with a camera set inside the transparent cylinder while the cylinder was rotated to determine how toner particles pass through the nip therebetween. As a result of the experiment, it was found that toner particles pass through some portions of the contact portion in the longitudinal direction of the blade, and at the portions the blade makes a stick-slip movement. The stick-slip movement means that when the position of the edge 3*b* of the blade 3 in the stick state as illustrated in FIG. 6 is 0 (i.e., an original point), the edge 3*b* moves to a point in a range of from +8 μm to +15 μm in an upstream region relative to the rotation direction of the cylinder.

As a result of the experiment and other experiments, it was found that the blade starts to make a stick-slip movement just after one or several spherical toner particles pass through a portion of the contact portion.

FIG. 7 is a schematic view illustrating the contact portion of the blade 3 and the surface of the photoreceptor 4 through which spherical toner particles are passing through. In FIG. 7, toner particles fed by the rotation of the photoreceptor drum 4 are stopped once at the contact portion of the blade 3 and the photoreceptor 4. Then the toner particles stopped by the blade 3 starts to rotate. In this case, the driving force of the rotation of the toner particles is a friction force caused by the rotation of the photoreceptor 4. Then the rotated toner particles invade into the nip between the blade 3 and the photoreceptor 4. The toner particles move through the nip while rotating in a direction indicated by an arrow and deforming the blade 3. Thus, the toner particles pass through the blade 3.

As mentioned above, the edge of the blade 3 is elastically deformed in a stick state as illustrated in FIG. 6. When spherical toner particles pass through the blade in this state, the reactive force of the photoreceptor 4, which has acted against the restoring force of the blade due to deformation of the blade, does not act on the blade. Therefore, the edge 3*b* of the blade 3 moves in the upstream direction relative to the rotation direction of the photoreceptor 4 due to the restoring force and has the shape of the blade in the stick state. As a result thereof, the portion of the blade has a slip state. The portion is illustrated as 3*b*' surrounded by a dotted line I in FIG. 8. The portions adjacent to the portion 3*b*' maintain the stick state as illustrated in FIG. 8. Therefore, the force to be applied to the portion 3*b*' is diffused to the adjacent portions. As a result, a sufficient pressure does not act on the portion 3*b*' achieving the slip state. Therefore, toner particles continuously pass through the portion 3*b*'. The edge portion of the portion 3*b*' having the slip state is moved in the downstream direction to achieve again the stick state. However, the edge of portion 3*b*' starts to move again in the upstream direction in the midway between the slip state position and the stick state position due to the toner particles passing through the nip, i.e., due to the restoring force of the blade. Therefore, the portion 3*b*' repeats the stick-slip movement until there is no toner particle passing through the portion 3*b*' of the blade. Thus, many toner particles pass through such a portion at a time, resulting in occurrence of the bad cleaning problem, i.e., occurrence of the background fouling problem in that background area of images is soiled with toner particles.

In addition, as a result of the present inventors' experiments, it was found that even when the blade does not make the stick-slip movement, the bad cleaning problem can be caused although depending on the material used for the blade.

Specifically, the toner particles stopped once by the blade 3 starts to rotate and pushes a portion of the blade 3 while deforming the portion of the blade. Finally the toner particles pass through the portion of the blade. Just after the toner particles pass through the portion, occurrence of the stick-slip movement can be prevented if the blade has low repulsion elasticity. However, even in this case, the bad cleaning problem is caused when the blade has a high hardness. Although the mechanism will be explained below in detail, the summary of the mechanism is as follows.

When the blade has a low hardness and a low repulsion elasticity, the portion of the blade deformed by toner particles passing therethrough is greatly deformed and in addition the restoring speed is slow. Therefore, when the deformed portion is restored, other toner particles pass through the portion. Therefore, the restoring action is obstructed by the following toner particles. Thus, many toner particles continuously pass through the portion, resulting in occurrence of the bad cleaning problem.

In this regard, the higher contact pressure a blade has, the better toner particle removing effect the blade has. Therefore, if the contact pressure can be set to be very high, the toner passing problem can be perfectly avoided. However, when the contact pressure is too high, the load on the image bearing member seriously increases, and thereby it becomes difficult to stably rotate the image bearing member. In addition, a problem in that the surface of the image bearing member is seriously abraded, resulting in shortening of the life of the image bearing member. Therefore, there is an upper limit of the contact pressure.

Thus, it is difficult to perfectly prevent the toner passing problem at the present time.

In addition, the stick-slip movement is also caused when the friction coefficient of an image bearing member changes and as a result the friction force formed between the blade and the surface of the image bearing member changes. Specifically, when the friction coefficient decreases, the restoring force of the blade becomes larger than the friction force formed between the blade and the surface of the image bearing member, and thereby the blade achieves the slip state. When the blade achieves the slip state, the restoring force becomes smaller than the friction force and thereby the blade is returned to the stick state due to the rotation of the image bearing member.

In contrast, when the friction coefficient of a portion of the image bearing member is relatively large compared to that of other portions, the friction force becomes larger than the restoring force of the deformed blade, and thereby the edge portion of the blade is further drawn by the image bearing member in the direction A illustrated in FIG. 6. When the portion having a large friction coefficient passes the blade, the restoring force of the blade becomes larger than the friction force, and thereby the blade achieves the slip state. When the blade achieves the slip state, the friction force becomes larger than the restoring force of the blade, and thereby the blade achieves the stick state due to rotation of the image bearing member. In this case, when the blade has the slip state, many toner particles pass through the nip between the cleaning blade and the image bearing member.

When toner particles prepared by a pulverization method are used, the toner particles stay at the contact portion of the blade and the image bearing member, and thereby the friction force formed between the edge 3*b* of the blade 3 and the surface of the image bearing member 4 is decreased. Therefore, the edge of the blade and the surface of the image bearing member can stably form a nip with hardly causing the stick-slip movement and thereby toner particles can be well scraped. In contrast, since spherical toner particles cannot stay at the blade, the blade repeats the stick-slip movement, and thereby an unstable nip is formed, resulting in occurrence of the bad cleaning problem.

Hereinbefore, the bad cleaning problem caused by the stick-slip movement of a blade is described. However, the cause for the bad cleaning problem is not limited to the stick-slip movement. In a background cleaner illustrated in FIG. 4, a stress is concentrated to a portion 3*s* of the blade 3 near an edge 2*b* of the metal support plate 2, resulting in occurrence of buckling of the portion 3*s* in that the blade 3 is sharply bent at the portion 3*s*.

In order to prevent the toner passing problem, the tip portion of the blade 3 contacting the photoreceptor drum 4 is pressed to the photoreceptor at a predetermined linear pressure. Therefore, the tip portion is curved outward (i.e., in the direction opposite to the photoreceptor 4) in an amount of (d), and thereby a bending stress is generated. The bending stress is maximized at the portion 3*s*. In addition, the stress applied to the blade 3 is not limited to the bending stress and includes compression stress which is applied in a direction parallel to the line F in FIG. 4. If the portion 3*s* cannot endure these stresses, the portion 3*s* is buckled. If the portion 3*s* is buckled, the blade 3 cannot apply the predetermined linear pressure to the photoreceptor 4, and thereby the bad cleaning problem is caused.

SUMMARY OF THE INVENTION

Accordingly, an object of the present invention is to provide a cleaner in which a blade is pressed to the surface of a material (such as photoreceptors) to be cleaned at a uniform linear pressure to scrape particles (such as toner particles) on the material and which hardly cause the bad cleaning problem in that many particles pass through the nip between the blade and the material at a time.

Another object of the present invention is to provide an image forming apparatus and a process cartridge which can stably produce high quality images without causing background fouling problem.

Briefly these objects and other objects of the present invention as hereinafter will become more readily apparent can be attained by a cleaner including:

an elastic blade arranged to counter the rotating material while a tip of the elastic blade contacting the surface of the rotating material to clean the surface of the rotating material, wherein the elastic blade has a first surface facing the rotating material, and a second surface opposite to the first surface, and wherein the elastic blade has a recessed portion, which has a bottom surface and a wall, in a rear portion of the second surface thereof; and a support plate configured to support the elastic blade, wherein the support plate has a first surface facing the rotating material, a second surface opposite to the first surface and a tip surface, wherein the elastic blade is connected with the support plate in such a manner that the bottom surface and the wall of the recessed portion of the blade are contacted with the first surface and the tip surface of the support plate, respectively.

The blade preferably satisfies the following relationship:

$$t1 < t2,$$

wherein t1 represents a thickness of a tip portion of the blade and t2 represents a maximum thickness of a front portion of the blade.

The cleaner preferably satisfies one of the following relationships:

$$t1 < t2 \leqq t3 + t1, \text{ or } t3 + t1 \leqq t2,$$

wherein t3 represents a thickness of the support plate.

The cleaner preferably satisfies the following relationship:

$$\theta 1 \leqq \theta 2,$$

wherein θ1 represents an angle formed by the first surface of the elastic blade and a tangent line to the surface of the rotating material at a contact point, in which the tip of the elastic blade is contacted with the surface of the rotating material; and θ2 represents an angle formed by the first surface of the elastic blade and a line connecting the contact point and an upper edge of the recessed portion.

The blade preferably has a JIS A hardness of from 65° to 80°.

The blade preferably has a repulsion elastic coefficient not greater than 30% at 24° C.±3° C., and a repulsion elastic coefficient variation not greater than 350% in a temperature range of from 10° C. to 40° C.

The cleaner preferably includes a reinforcement contacted with a portion of the second surface of the elastic blade.

The reinforcement is preferably connected with surface of the second surface of the elastic blade and the tip surface of the support plate.

The reinforcement is preferably bonded with surface of the second surface of the support plate and the wall of the recessed portion of the elastic blade.

The reinforcement preferably has a Young's modulus greater than that of the elastic blade.

The elastic blade preferably has an elastic reinforcement (such as elastic plates, elastic adhesives or a metal foil) on a portion of the second surface thereof, and wherein the elastic reinforcement is connected with the portion of the second surface of the elastic blade and a portion of the tip surface of the support plate.

The elastic reinforcement preferably has substantially the same width in a longitudinal direction of the cleaner.

The elastic reinforcement preferably has a width less than the length of the front portion of the blade.

The elastic reinforcement has a JIS A hardness not less than that of the blade.

Alternatively, a cleaner is provided which includes:

an elastic blade arranged to counter the rotating image bearing member while a tip of the elastic blade is contacted with the surface of the rotating material and achieves a stick state to remove the toner particles; and a support plate configured to support the elastic blade, wherein just after a toner particle passes through a portion of the tip of the elastic blade contacting a surface of the image bearing member, the portion of the tip of the elastic blade moves in a direction opposite to the rotation direction of the image bearing member at a length less than 8 μm.

The elastic blade preferably has a JIS A hardness of from 70° to 80°, and a repulsion elastic coefficient of from 8% to 30% at 23° C., and wherein the blade is pressed to the image bearing member at a linear pressure of from 0.784 N/cm (80 gf/cm) to 1.176 N/cm (120 gf/cm).

The cleaner preferably includes a pressing member configured to press a potion of a second surface of the elastic blade opposite to a first surface of the elastic blade facing the surface of the image bearing member in a normal line direction of the image bearing member at the contact point.

The pressing member preferably presses only a tip portion of the elastic blade, preferably in such a manner that the pressure is applied to the surface of the image bearing member from the normal line direction of the image bearing member.

The pressing member preferably presses only the tip portion of the elastic blade with an elastic member therebetween, wherein the elastic member has a repulsion elastic coefficient greater than that of the elastic blade.

Alternatively the pressing member includes a piezoelectric element, and a voltage controller configured to control a voltage applied to the piezoelectric element.

Alternatively the pressing member may include a metal plate having a thickness of from 0.1 mm to 0.5 mm and one of an end thereof is fixed to the metal plate, and wherein the metal plate is bent to press the tip portion of the elastic blade using a restoring force of the bent metal plate.

As another aspect of the present invention, a process cartridge is provided which includes:

an image bearing member configured to bear a toner image thereon;

a cleaner configured to clean a surface of the image bearing member, wherein the cleaner is any one of the cleaners mentioned above, and wherein the process cartridge is detachably set in an image forming apparatus.

The process cartridge preferably has a heat insulating structure.

As yet another aspect of the present invention, an image forming apparatus is provided which includes:

an image bearing member configured to bear an electrostatic latent image on a surface thereof;

a developing device configured to develop the electrostatic latent image with a developer comprising a toner to form a toner image on the surface of the image bearing member;

a transfer device configured to transfer the toner image onto a receiving material; and a cleaner configured to clean the surface of the image bearing member, wherein the cleaner is any one of the cleaners mentioned above.

Alternatively an image forming apparatus is provided which includes:

an image bearing member configured to bear a toner image on a surface thereof while rotating in a direction; and a cleaner configured to clean toner particles remaining on the surface of the image bearing member, wherein the cleaner comprises:

a support plate;

an elastic blade having a repulsion elastic coefficient of form 8.0% to 30% and a JIS A hardness of from 70° to 90°, wherein a second surface of the elastic blade opposite to a first surface thereof facing the surface of the image bearing member is connected with the support plate, and a reinforcement located on the second surface of the elastic blade while being contacted with the support plate, wherein the elastic blade is arranged so as to counter the rotating image bearing member while a tip of the blade is contacted with the surface of the image bearing member at a linear pressure of from 0.784 N/cm (80 gf/cm) to 1.176 N/cm (120 gf/cm).

The elastic blade preferably has a convex form, and a thick central portion of the elastic blade serves as the reinforcement, and wherein a rear wall of the thick central portion is contacted with a tip surface of the support plate.

The reinforcement is preferably located on the second surface of the elastic blade while a rear surface of the reinforcement is contacted with a tip surface of the support plate.

The elastic blade is preferably made of a polyurethane elastomer.

In addition, the toner may include a lubricant. Alternatively, the image forming apparatus may includes a lubricant applicator configured to apply a lubricant to a surface of the image bearing member. Alternatively, the photoreceptor may includes a lubricant, a filler and/or a crosslinked resin in an outermost layer thereof. The crosslinked resin preferably includes a charge transport moiety in a molecule thereof.

These and other objects, features and advantages of the present invention will become apparent upon consideration of the following description of the preferred embodiments of the present invention taken in conjunction with the accompanying drawings.

BRIEF DESCRIPTION OF THE DRAWINGS

FIG. 7 is a schematic view illustrating the contact portion of the blade and the surface of the image bearing member through which spherical toner particles are passing through;

DETAILED DESCRIPTION OF THE INVENTION

Before explaining the cleaner of the present invention, the image forming apparatus for which the cleaner can be used will be explained.

Figure 9:
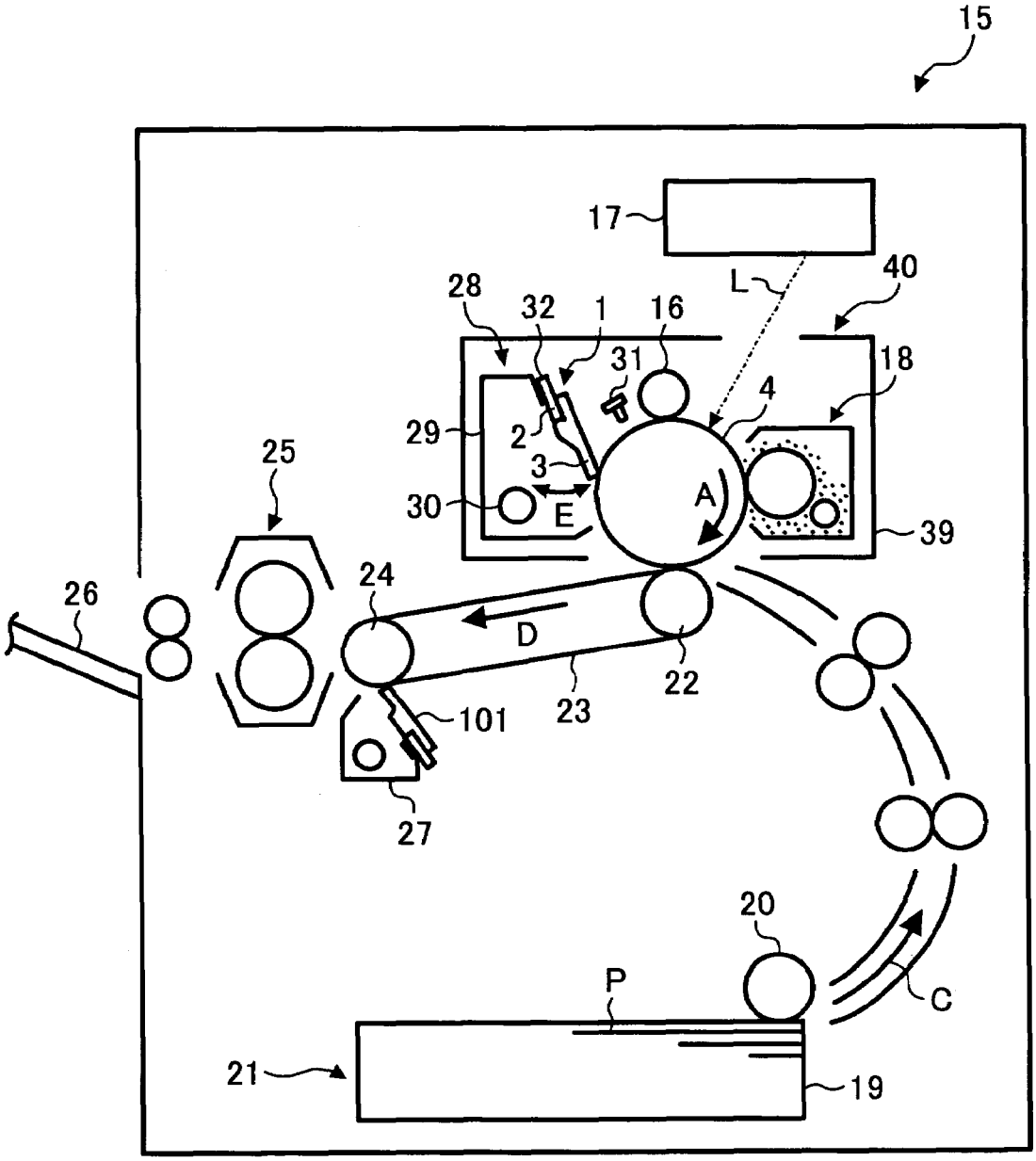
FIG. 9 is a schematic view illustrating the main body of an embodiment of the image forming apparatus of the present invention.

FIG. 9 is the main body of an embodiment of the image forming apparatus of the present invention. A main body 15 includes a photoreceptor drum 4 serving as an image bearing member. The photoreceptor drum 4 is rotated in a direction A. At first, the photoreceptor drum 4 is charged with a charger 16 such that the surface thereof have a charge with a predetermined polarity. A light irradiator 17 irradiates the charged surface of the photoreceptor drum 4 with a laser light beam L, resulting in formation of an electrostatic latent image on the surface of the photoreceptor drum 4. The electrostatic latent image is developed with a developing device 18, resulting in formation of a toner image on the photoreceptor drum 4.

In a lower portion of the main body 15, a paper feeding device 21 including a paper cassette 19 and a feed roller 20 is arranged. An uppermost paper sheet P of paper sheets set in the paper cassette 19 is fed in a direction C by the feed roller 20. The paper sheet P are fed by plural pair of feed rollers to a nip between a transfer belt 23, which is rotated in a direction D by rollers 22 and 24 while stretched, and the photoreceptor drum 4. Since a transfer voltage is applied to the roller 22 which serves as a transfer roller, the toner image formed on the photoreceptor drum 4 is transferred to the paper sheet P. The paper sheet P bearing the toner image thereon is fed to a fixing device 25 by the transfer belt 23 and the toner image is fixed by the fixing device 25. The paper sheet P passing the fixing device 25 is discharged from the main body 15 and stacked on a tray 26. Toner particles and paper dust adhered to the transfer belt 23 is cleaned with a cleaning device 27 having a cleaner 101.

Toner particles remaining on the photoreceptor drum 4 even after the transfer process are scraped with a cleaner 1 of a cleaning device 28 so as to be removed from the surface of the photoreceptor drum 4. The toner particles thus removed from the surface of the photoreceptor drum 4 are fed with a toner feeding device 30 arranged in a casing 29 of the cleaning device 28. Then a discharging lamp 31 irradiates the surface of the photoreceptor drum 4 with light to decrease the amount of charges remaining on the surface of the photoreceptor drum 4 so that the photoreceptor drum 4 has an initial surface voltage.

Figure 10:
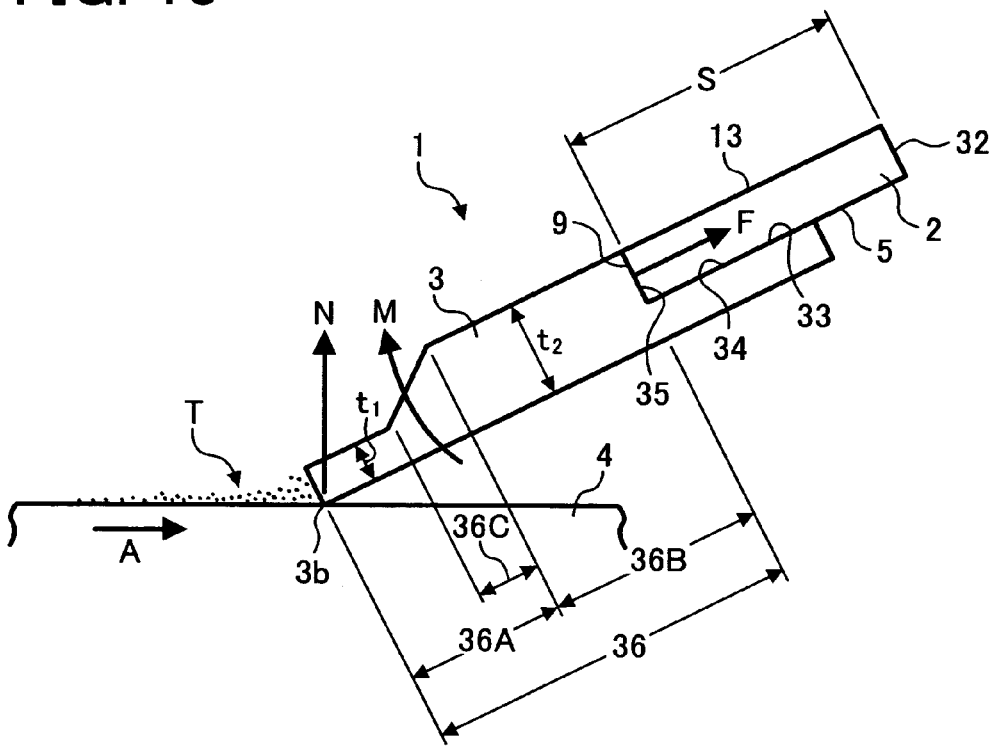
FIGS. 10 and 11 are schematic views illustrating an embodiment of the cleaner of the present invention.
Figure 11:
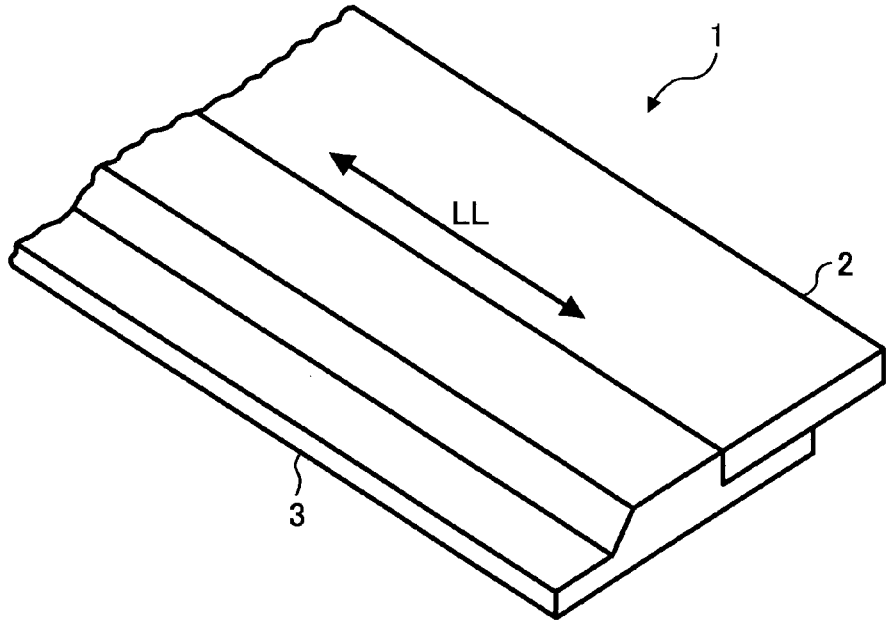

Then the cleaner 1 will be explained in detail. FIGS. 10 and 11 are schematic views illustrating an embodiment of the cleaner of the present invention. As illustrated in FIGS. 10 and 11, the cleaner 1 has a support plate 2 and an elastic blade 3. As illustrated in FIG. 11, the support plate 2 is a long thin plate which extends in a longitudinal direction LL thereof and which is typically constituted of a material having a high stiffness such as metals and hard resins. The elastic blade 3 is typically constituted of a material having an elastic material such as polyurethane elastomers.

As illustrated in FIG. 9, a rear portion 32 of the support plate 2 is fixed to the casing 29 of the cleaning device 28. In addition, as illustrated in FIG. 10, an edge 3*b* of a tip portion of the elastic blade 3 is brought into pressure-contact with the surface of the photoreceptor 4, i.e., a material to be cleaned, to clean the surface of the photoreceptor by removing residual toner particles T on the photoreceptor drum 4. In this regard, the blade 3 is set so as to counter the photoreceptor drum 4 rotating in the direction A.

As mentioned above, the rear portion 32 of the support plate 3 of the cleaner 1 is fixed to the casing 29 of the cleaning device 28. However, it is possible that the cleaner is supported by the casing 29 so as to be able to be oscillated in a direction indicated by an arrow E in FIG. 9 or a direction parallel to the axis of the photoreceptor drum 4.

Referring to FIG. 10, numerals 5 and 13 denote a first surface of the support plate 2 facing the photoreceptor drum 4 and a back surface opposite to the first surface 5, respectively. In addition, numeral 9 denotes a tip surface of the front portion of the support plate 2, which is opposite to the rear portion 32.

The elastic blade 3 has a recessed portion 33. The recessed portion 33 is defined by a first surface (i.e., a bottom surface) 34 and a second surface (i.e., a wall) 35. In this embodiment illustrated in FIG. 10, the angle formed by the bottom surface 34 and the wall 35 is about 90°. The entire of the bottom surface 34 is bonded with the first surface 5 of the support plate 2, and the entire of the wall 35 is bonded with the tip surface 9 of the support plate 2. Thus, the elastic blade 3 is connected with the support plate 3 via the bottom surface 34 and the wall 35. The elastic blade 3 is bonded with the support plate 3 by, for example, using an adhesive or subjecting the elastic blade and the support plate 3 to integral molding.

As the former bonding method, for example, a method in which an elastic plate, which is made of a polyurethane elastomer and which is cut so as to have the predetermined dimension, is adhered to a support plate using an adhesive can be used. As the latter bonding method, for example, a method in which a support plate on which an adhesive has been coated and then dried is set in a die, and then a polyurethane elastomer forming liquid is fed into the die, followed by crosslinking of the elastomer can be used.

Figure 1:
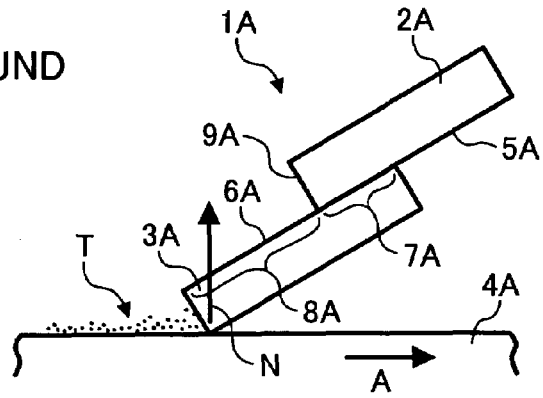
FIG. 1 BACKGROUND ART
FIG. 1 is a schematic view illustrating a background cleaner.
Figure 2:
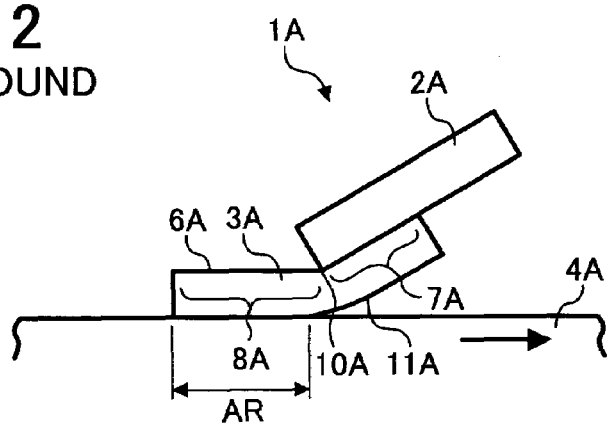
FIG. 2 BACKGROUND ART
FIG. 2 is a schematic view illustrating the cleaner illustrated in FIG. 1, which achieves a deformed state by being pressed.

As illustrated in FIG. 10, the tip edge 3*b* of the elastic blade 3 of the cleaner 1 contacts the surface of the photoreceptor drum 4 while pressing the surface, and therefore the blade 3 receives a reactive force N from the surface of the photoreceptor drum 4. Thereby the blade 3 is deformed so as to bend in a direction M. When the blade 3 is deformed, the wall 35 of the blade 3 applies a force F to the tip surface 9 of the support plate 2. Since the wall 35 is connected with the tip surface 9 of the support plate 2, the force F is received by the tip surface 9 of the support plate 2. Therefore, the blade 3 is not excessively deformed, which is different from the conventional blade 3A illustrated in FIG. 1. Therefore, the blade 3 of the cleaner 1 of the present invention does not cause a problem in that the area of the contact portion of the blade with the photoreceptor excessively increases and thereby the pressure of the blade excessively decreases. Thus, the blade 3 can press the photoreceptor at a high pressure, and therefore the cleaner 1 has good cleanability.

Figure 3:
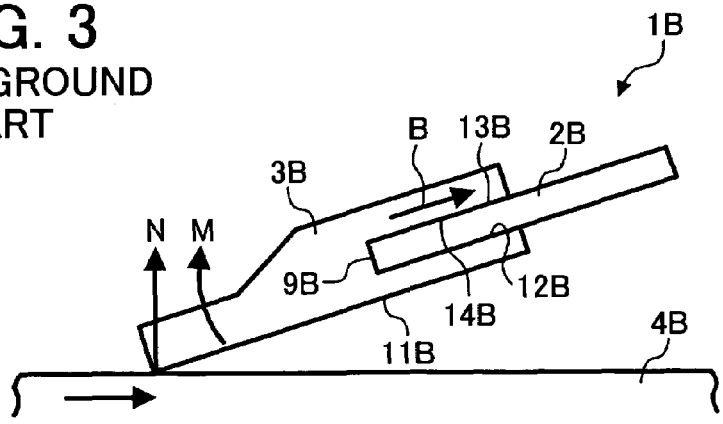
FIG. 3 BACKGROUND ART
FIG. 3 is a schematic view illustrating another background cleaner.

In addition, since the elastic blade 3 is not connected with the back surface 13 of the support plate 2, which is different from the conventional blade 3B illustrated in FIG. 3, the blade is not prevented from bending. Therefore, the blade 3 is properly bent, and the portion of the blade 3 contacted with the surface of the photoreceptor drum 4 has a proper area. Therefore, the blade 3 can apply a uniform pressure to the surface of the photoreceptor drum 4 in a longitudinal direction LL (illustrated in FIG. 11) of the blade 3. Therefore, the elastic blade can efficiently remove toner particles T remaining on the surface of the photoreceptor drum 4 even when the toner is a spherical toner.

As illustrated in FIG. 10, any portion of the blade 3 is not connected and contacted with a region S of the back surface 13 of the support plate 2. Therefore, the amount of the elastic material used for the blade 3 can be decreased, resulting in reduction in cost of the elastic blade 3.

Figure 12:
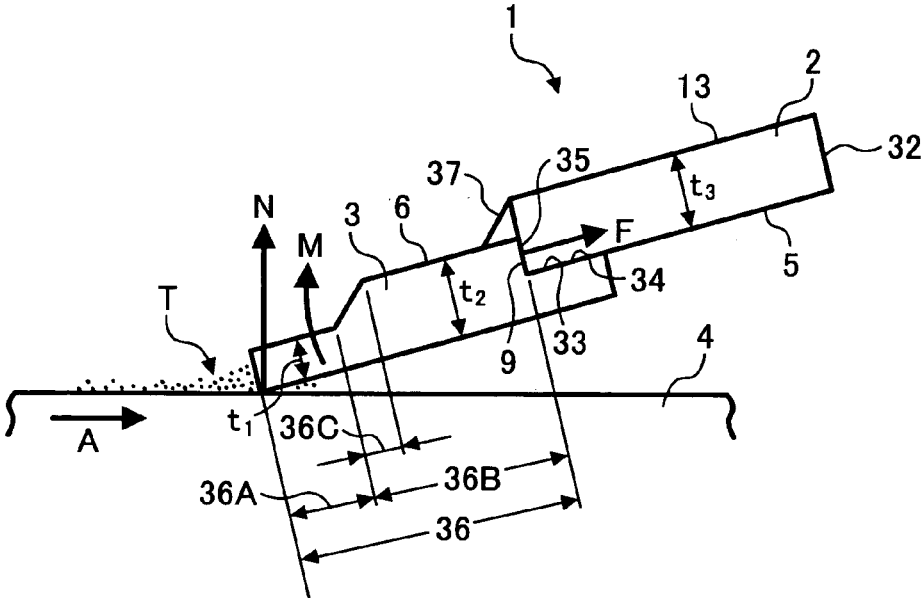
FIGS. 12 and 13 are schematic views illustrating other embodiments of the cleaner of the present invention.
Figure 13:
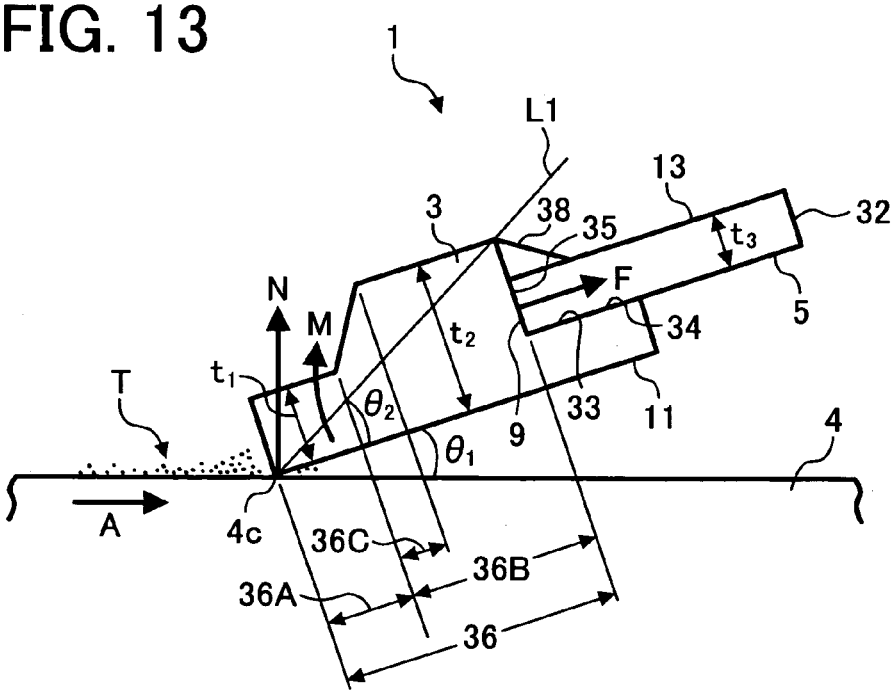

FIGS. 12 and 13 are schematic views illustrating other embodiments of the cleaner of the present invention. The cleaners illustrated in FIGS. 12 and 13 have substantially the same configuration as that of the cleaner illustrated in FIG. 10. Since parts having the same reference numbers are the same, the parts illustrated in FIG. 10 will not be explained here.

In the cleaners 1 illustrated in FIGS. 10-13, numeral 36 denotes an extending portion of the blade 3, which extends toward the photoreceptor 4 to be cleaned. The extending portion 36 has a tip portion 36A and the other portion 36B. In this case, the thickness t1 of the tip portion 36A is smaller than the maximum thickness t2 of the other portion (i.e., $t1<t2$). When $t1<t2$, the stick-slip movement of the blade 3 can be prevented when the cleaner 1 removes residual toner particles T which move in the direction A, and thereby the residual toner particles T can be stably removed from the surface of the photoreceptor drum 4.

In addition, as illustrated in FIGS. 10-13, a front portion 36C of the other portion 36B of the blade 3, which is near the tip portion 36A, is tapered, i.e., the thickness of the portion 36C gradually changes. Therefore, a problem in that the blade is sharply bent at a point in the portion 36 can be avoided even when the blade 3 has portions having different thicknesses t1 and t2.

Provided that the support plate 2 has a thickness t3 as illustrated in FIGS. 12 and 13, the cleaner 1 illustrated in FIG. 12 satisfies the relationship, $t3+t1 \geqq t2>t1$. When this relationship is satisfied, the thickness of the entire of the blade 3 can be decreased. In this case, the difference in level between the surfaces of the portions 36A and 36B can be decreased. Therefore, when the blade is prepared by crosslinking a material, the degree of deformation of the material in the crosslinking process can be minimized, and thereby a blade having a high preciseness can be provided.

In contrast, the cleaner 1 illustrated in FIG. 13 satisfies a relationship, $t3+t1 \leqq t2$. In this case (where the other portion 36B of the blade has a large thickness), the area of the wall 35 of the recessed portion 33 can be widened. Therefore, the tip surface 9 of the support plate 2 can securely and stably receive the wall 35, and the problem in that the blade is sharply bent at a portion can be securely avoided.

As illustrated in FIG. 13, provided that an angle formed by a first surface 11 of the blade 3, which faces the photoreceptor 4, and a tangent line at a point 4*c* on the surface of the photoreceptor 4 in which the photoreceptor contacts the blade 3 is θ1, and an angle formed by a line L1 connecting the uppermost end of the wall 35 and the contact point 4*c*, and the first surface 11 of the blade 3 is θ2, a relationship $\theta 1 \leqq \theta 2$ is preferably satisfied. When the angle θ2 increases, the area of the wall 35 of the recessed portion 33 also increases, and thereby the problem in that the blade is sharply bent at a point and thereby the body of the blade contacts the photoreceptor can be securely avoided. In addition, the everted blade problem in that the tip portion of the blade 3 is drawn by the rotated photoreceptor drum 4 can be avoided, and thereby a good cleanability can be imparted to the cleaner 1. The angle θ2 is preferably from 20 to 30°.

The angle θ1 is preferably from 15 to 25°. When the angle θ1 is too small, the body of the blade 3 contacts the surface of the photoreceptor 4, and thereby an ability of the blade to scrape residual toner particles deteriorates. In contrast, when the angle θ1 is too large, the everted blade problem caused by large friction force between the blade 3 and the surface of the photoreceptor 4 tends to occur. When the tip portion of the blade is drawn by the photoreceptor 4, not only the defective cleaning problem occurs but also the cleaner does not function. Therefore, the image forming apparatus achieves an abnormal state.

Figure 14:
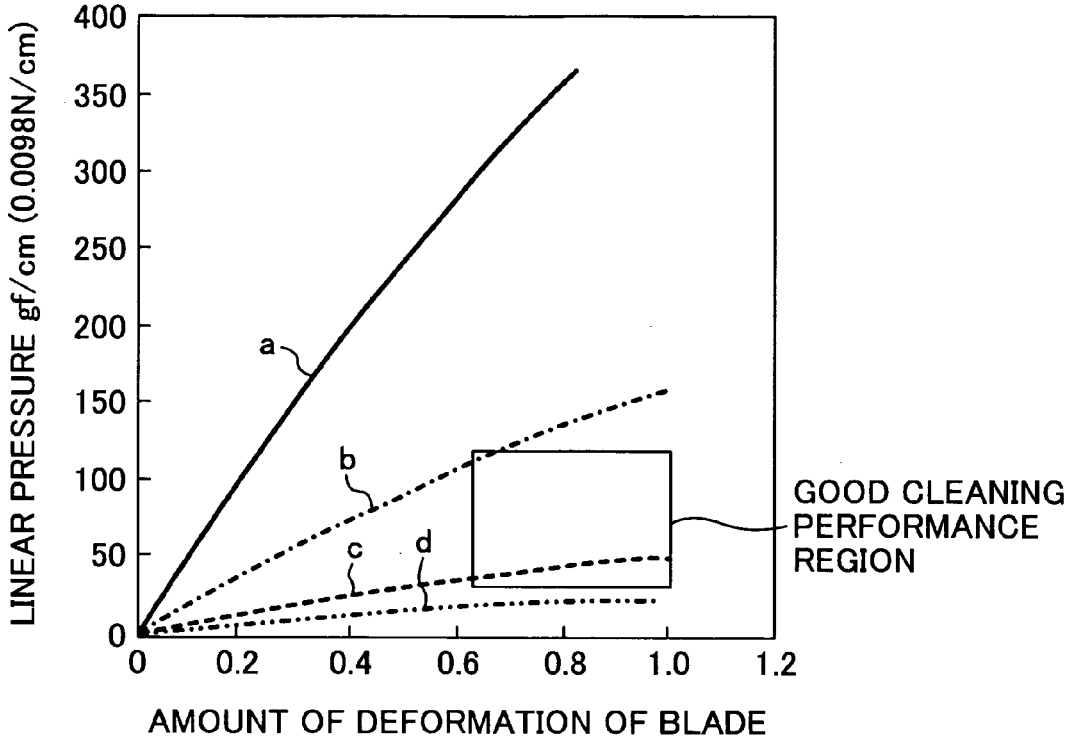
FIG. 14 is a graph illustrating the relationship between the JIS A hardness of the elastic blade and the linear pressure of the blade applied to the surface to be cleaned.

FIG. 14 is a graph illustrating the relationship between the amount of deformation of the elastic blade 3 (illustrated in FIGS. 10-13), which is proportional to JIS A hardness of the blade, and the linear pressure of the blade 3 applied to the surface of the photoreceptor 4. In FIG. 14, a blade having a JIS A hardness of 90° behaves in a manner illustrated by a solid line (a), and a blade having a JIS A hardness of 80° behaves in a manner illustrated by a dashed line (b). In addition, blades having JIS A hardness of 70° and 60°, respectively, behave in a manner illustrated by a dotted line (c) and a chain double-dashed line (d), respectively. It is clear from FIG. 14 that the higher hardness the blade has, the higher linear pressure the blade applies.

However, when the hardness of the blade is too high, the blade tends to unevenly contact the surface of the photoreceptor 4, resulting in occurrence of a problem in that cleaning cannot be uniformly performed. In addition, when the hardness is greater than 80°, the blade itself tends to creep, and thereby a problem in that the linear pressure and the elasticity of the blade decrease with time tends to occur.

In contrast, when the hardness of the blade is too low, the rate of change of the linear pressure is small, i.e., the variation of the linear pressure is little. However, in order to increase the linear pressure, the elastic blade has to be largely deformed. In this case, the area of the contact portion of the blade with the photoreceptor has to be increased and in addition the pressure distribution becomes even because the blade has a low hardness. Therefore, the JIS A hardness of the blade 3 is preferably from 65 to 80° and the linear pressure is preferably from 40 to 120 gf/cm (0.392 to 1.176 N/cm). In this case, the cleaner has good cleanability.

Since the elastic blade 3 has a repulsion elasticity, the elastic blade can repel residual toner particles contacting the blade in the cleaning operation. When spherical toner particles are removed from the surface of the photoreceptor 4, it is preferable to use a blade having a high repulsion elasticity. However, spherical toner particles invade into the nip between the edge of the blade and the surface of the photoreceptor before being repelled by the blade. Therefore, toner removing efficiency cannot be enhanced even when a blade having a high repulsion elastic coefficient is used. Rather, when a blade having a low repulsion elastic coefficient is used, it is difficult for spherical toner particles to invade into the nip, resulting in improvement in cleanability. Therefore, it is preferably to use a blade having a low repulsion elasticity to remove spherical toner particles. Such a blade as having a low repulsion elasticity can be provided by increasing the content of hard segments in the polyurethane component.

In this regard, since the repulsion elasticity of an elastic blade increases as temperature rises, the blade is designed while considering the dependence of the repulsion elasticity of the material used on temperature. As a result of our experiments, it is found that when a blade having a repulsion elastic coefficient, which is not greater than 30% at normal temperature (24±3° C.) and whose rate of change is in a temperature range of from 10 to 40° C. is not greater than 350%, is used as the blade 3, the blade has good cleanability even when environmental temperature changes.

Figure 15:
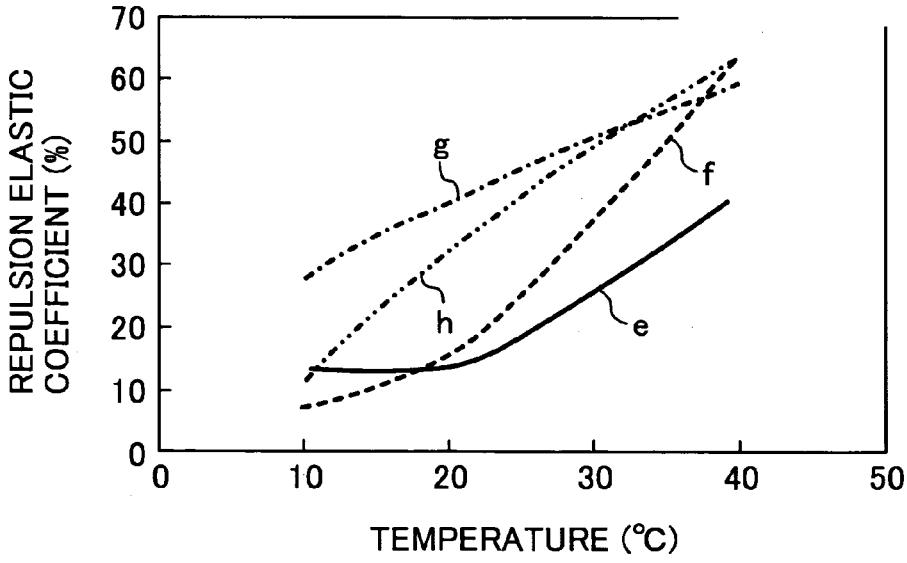
FIG. 15 is a graph illustrating the dependence of repulsion elastic coefficient of elastic blades on temperature.

FIG. 15 is a graph illustrating the dependence of repulsion elastic coefficient of elastic blades on temperature. Among elastic blades (e)-(h), only the elastic blade (e) has a repulsion elastic coefficient not greater than 30% at normal temperature and the rate of change thereof in a temperature range of from 10 to 40° C. is not greater than 350%. Therefore, it is preferable to use such a blade.

Referring to FIG. 12, the cleaner 1 has a reinforcement 37 which is bonded with the back surface 6 of the blade 3 and the tip surface 9 of the support plate 2. In this case, the tip surface 9 of the support plate 2 receives a force F not only from the wall 35 of the recessed portion 33 but also from the reinforcement 37. Therefore, the support plate 2 can receive the elastic blade more securely, and the problem in that the elastic blade is sharply bent at a certain point thereof can be securely avoided.

Referring to FIG. 13, the cleaner 1 has a reinforcement 38 which is bonded with the wall 35 of the recessed portion 33 of the blade 3 and the back surface 13 of the support plate 2. In this case, the force F applied by the second surface 35 can be received by the reinforcement 38 and the support plate 2. Therefore, the problem in that the elastic blade is sharply bent at a certain point thereof can be securely avoided.

Adhesive agents can be used as the reinforcements 37 and 38. When the reinforcements 37 and 38 have a low rigidity, the above-mentioned effects cannot be well produced. Therefore, it is preferable that the reinforcements 37 and 38 have a Young's modulus greater than that of the elastic blade 3. Specifically, when the blade 3 has a Young's modulus of from $5.88\times10^6$ to $1.47\times10^7$ Pa (i.e., 60 to 150 kgf/cm$^2$), epoxy resins having a Young's modulus of from $9.8\times10^8$ to $2.94\times10^9$ Pa (i.e., 10,000 to 30,000 kgf/cm$^2$) are preferably used as the reinforcements 37 and 38. It is preferable to coat such an epoxy resin when preparing the reinforcements 37 and 38.

The image forming apparatus illustrated in FIG. 9 includes a process cartridge in which the photoreceptor 4, a charger 16, a developing device 18, a cleaning device 28 and a discharge lamp 31 are united in a unit case 39. The process cartridge 40 can be detachably set in a main body 15 of the image forming apparatus. The process cartridge 40 is not limited thereto, and any process cartridge including as essential devices an image bearing member to be cleaned and the cleaning device 28, which are integrally assembled, can be used as the process cartridge 40.

The image bearing member may be a photoreceptor or an intermediate transfer medium on which toner images are transferred from a photoreceptor. In an image forming apparatus using an intermediate transfer medium, toner particles remaining on the intermediate transfer medium even after the toner images are transferred to a receiving material can be removed with the cleaner 1 mentioned above. In such an image forming apparatus, specific examples of the member to be cleaned with the cleaner of the present invention include the photoreceptor, the intermediate transfer medium and the transfer belt 23. As illustrated in FIG. 9, the surface of the transfer belt 23 is cleaned with a cleaning device 27 including the cleaner 101 having the same configuration as the cleaner 1.

Figure 16:
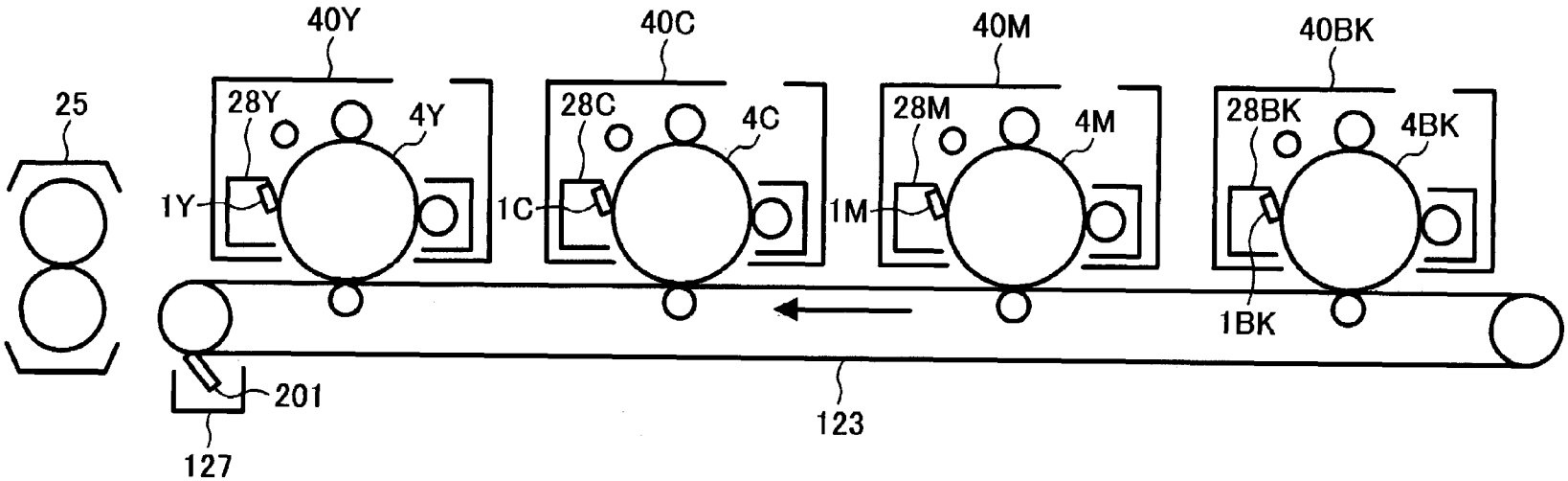
FIG. 16 is a schematic view illustrating another image forming apparatus of the present invention.

FIG. 16 is a schematic view illustrating another image forming apparatus for which the cleaner of the present invention is used. The image forming apparatus has four process cartridges 40Y, 40C, 40M and 40Bk which are arranged side by side. Yellow, cyan, magenta and black toner images are formed on photoreceptors 4Y, 4C, 4M and 4Bk, respectively. The color toner images are transferred onto a receiving paper fed by a transfer belt 123. Thus, a full color toner image is formed on the receiving paper. The full color toner image is then fixed on the receiving paper by a fixing device 25. This image forming apparatus includes cleaning devices 28Y, 28C, 28M and 28Bk, which include a cleaner 1Y, 1C, 1M and 1Bk (which is the cleaner of the present invention), respectively, and a cleaning device 127 for the transfer belt 123, which includes a cleaner 201 which is the cleaner of the present invention. These cleaners have the same configuration as the cleaner 1.

Figure 17:
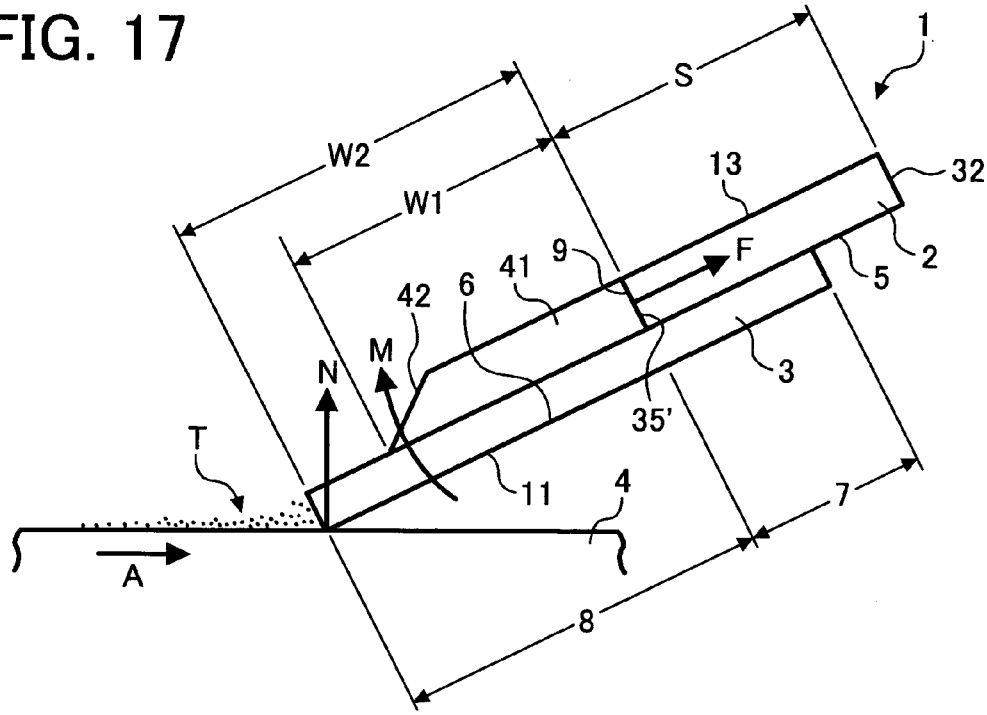
FIGS. 17 and 18 are schematic views illustrating another embodiment of the cleaner of the present invention.
Figure 18:
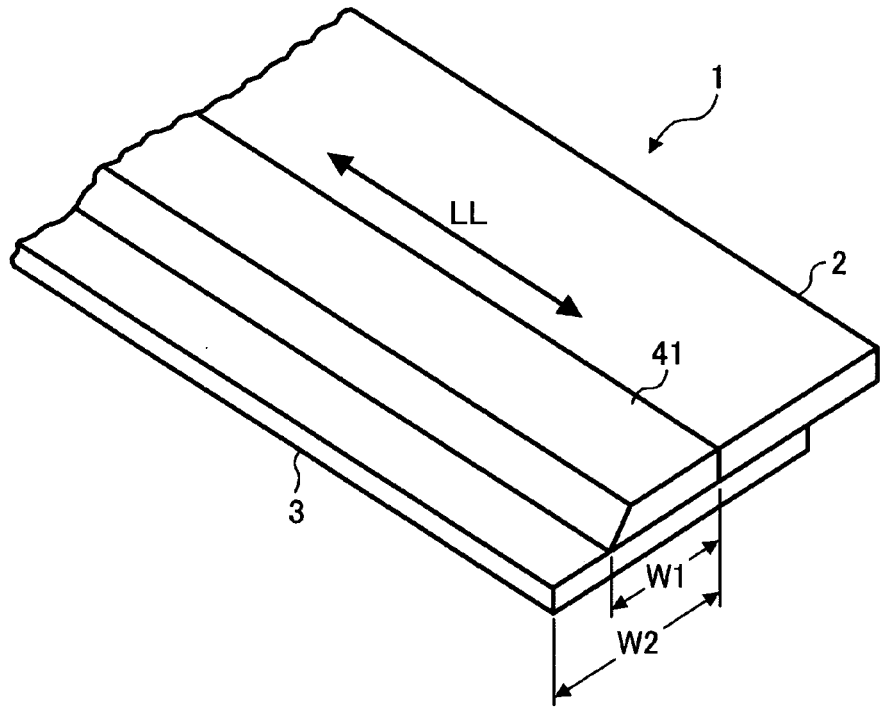

FIGS. 17 and 18 illustrate another embodiment of the cleaner of the present invention. Referring to FIG. 17, the cleaner 1 has a support plate 2, a blade 3 and an elastic reinforcement 41. Numerals 5, 13 and 9 denote a first surface of the support plate 2, which faces a photoreceptor 4 (i.e., a material to be cleaned), a back surface of the support plate 2 opposite to the surface 5, and a tip surface of the support plate 2. Numerals 11 and 6 denote a first surface of the elastic blade 3, which faces the photoreceptor 4, and a back surface opposite to the front surface 11. Numerals 7 and 8 denote a rear portion and a front portion of the elastic blade 3. As illustrated in FIG. 17, only the rear portion 7 of the back surface 6 is bonded with the support plate 2, and a portion of the front portion 8 of the elastic blade 3 is bonded with the elastic reinforcement 41. In this embodiment, the elastic reinforcement 41 is constituted of an elastic plate. The elastic reinforcement 41 may be made of the same material constituting the blade 3, and other low-cost rubbers such as natural rubbers, styrene rubbers and butadiene rubbers.

When the support plate 2, elastic blade 3 and elastic reinforcement 41 are bonded with each other, a method using an adhesive or an integral molding method can be used. The former method is as follows. An elastic blade made of, for example, a polyurethane elastomer, which is prepared by cutting a plate of polyurethane elastomer so as to have the desired dimension, is adhered to a support plate 2 made of steel to be united therewith. Then the elastic reinforcement 41 made of an elastic plate is adhered to the blade 3 and the support plate 2 using an adhesive to be united therewith. The latter method is as follows. An adhesive is coated on a support plate, and then dried. After the support plate is set in a die, a polyurethane elastomer forming liquid is fed into the die, and then crosslinked. Then an elastic reinforcement is adhered to the thus prepared combination of the elastic blade with the support plate using an adhesive to be united therewith.

As illustrated in FIG. 17, a tip edge of the elastic blade 3 of the cleaner 1 is contacted with the surface of the photoreceptor 4 while pressing the surface, and therefore the blade 3 receives a reactive force N from the surface of the photoreceptor drum 4. Thereby the blade 3 is deformed so as to bend in a direction M. In this case, since the elastic reinforcement 41 is bonded with the elastic blade 3 and the support plate 2, the elastic reinforcement 41 is also deformed together with the elastic blade 3.

When the blade 3 and reinforcement 41 are deformed, a rear surface 35' of the reinforcement 41 applies a force F to the tip surface 9 of the support plate 2. Since the second surface 35' is connected with the tip surface 9 of the support plate 2, the force F is received by the tip surface 9 of the support plate 2. Therefore, the blade 3 is not excessively deformed, which is different from the conventional blade 3A illustrated in FIG. 1. Therefore, the blade 3 of the cleaner 1 of the present invention does not cause a problem in that the area of the contact portion of the blade with the photoreceptor excessively increases and thereby the pressure of the blade excessively decreases. Thus, the blade 3 can press the photoreceptor at a high pressure, and therefore the cleaner 1 has good cleanability.

In addition, since the elastic blade 3 is not connected with the back surface 13 of the support plate 2, which is different from the conventional blade 3B illustrated in FIG. 3, the blade is not prevented from bending. Therefore, the blade 3 is properly bent, and the portion of the blade 3 contacted with the surface of the photoreceptor drum 4 has a proper area. Therefore, the blade 3 can apply a uniform pressure to the surface of the photoreceptor drum 4 in a longitudinal direction LL (illustrated in FIG. 18) of the blade 3. Therefore, the elastic blade can efficiently remove toner particles T remaining on the surface of the photoreceptor drum 4 even when the toner is a spherical toner.

Figure 19:
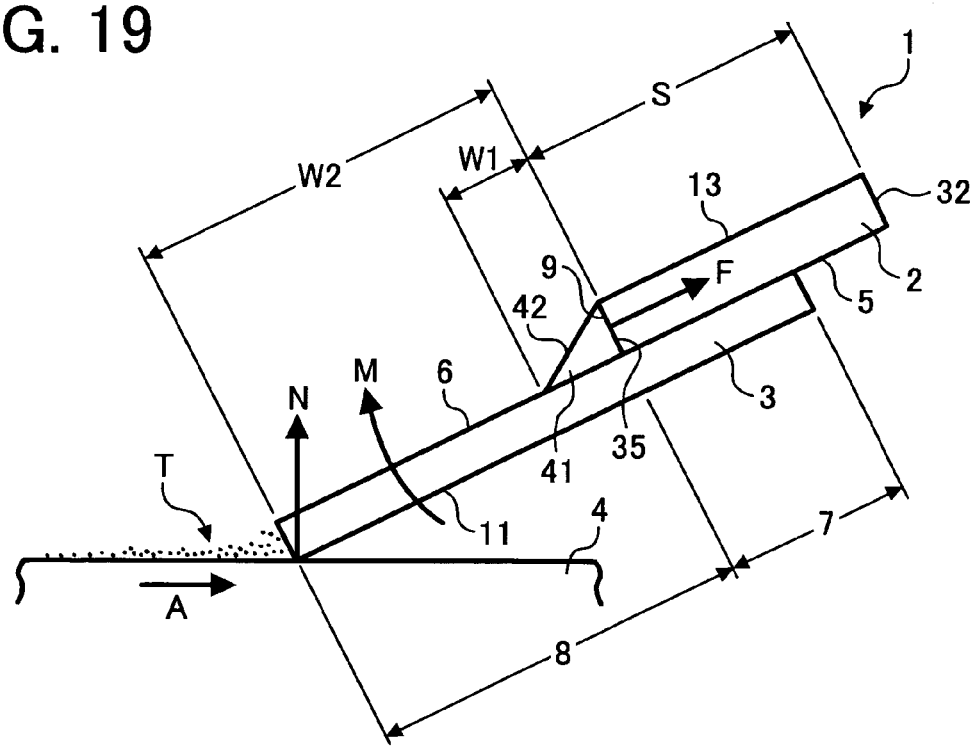
FIGS. 19-21 are schematic views illustrating other embodiments of the cleaner of the present invention.

As illustrated in FIG. 19, the elastic reinforcement 41 may be made of an elastic adhesive. Specific examples of the elastic adhesives include silicone modified polymer adhesives, urethane adhesives, epoxy adhesives, etc., which may be a single-component type adhesive or a two-component type adhesive. The elastic reinforcement 41 is formed by, for example, coating a liquid elastic adhesive at the corner formed by the tip surface 9 of the support plate 2 and the back surface 6 of the elastic blade 3 using a dispenser and then crosslinking the coated adhesive. By using an elastic adhesive, a proper bending property can be imparted to the blade 3 without causing a problem in that the elastic blade waves. Therefore, the blade has good planarity and good straightness. This is because when the adhesive is crosslinked, shrinkage of the adhesive is very little. The other structure and the fundamental operation of the cleaner 1 illustrated in FIG. 19 are the same as those of the cleaner 1 illustrated in FIG. 15, and therefore the explanation thereof will be omitted.

As illustrated in FIGS. 17 and 19, any portion of the blade 3 and the reinforcement 41 is not connected and contacted with a region S of the back surface 13 of the support plate 2. Therefore, the amount of the elastic material used for the blade 3 can be decreased, resulting in reduction in cost of the elastic blade 3.

As illustrated in FIG. 18, a width W1 of the reinforcement 41 is substantially constant in a longitudinal direction LL of the cleaner 1. Whether the elastic reinforcement 41 is made of an elastic adhesive or a metal foil which will be explained below, the cleaner 1 can have such a configuration When the cleaner has such a configuration, the elastic blade 3 can be uniformly contacted with the surface of the photoreceptor, and thereby good cleaning property can be imparted to the cleaner.

As illustrated in FIGS. 17 and 19, the width W1 of the reinforcement 41 is shorter than a width W2 of the front portion 8 of the blade 3. When the combination of the elastic reinforcement 41 and the elastic blade 3 is considered to be an elastic material, the thickness of the tip portion of the elastic material is less than the thickness of the central portion thereof. Therefore, when the cleaner 1 removes the residual toner particles T from the surface of the photoreceptor which rotates in the direction A, occurrence of the stick-slip movement can be prevented. Therefore, a good cleanability can be imparted to the cleaner 1.

As illustrated in FIGS. 17 and 19, the tip portion of the reinforcement 41 is tapered. Since the thickness of the reinforcement 41 decreases toward the back surface 6 of the blade 3, the problem in that the blade is sharply bend at a certain point can be securely avoided.

Figure 20:
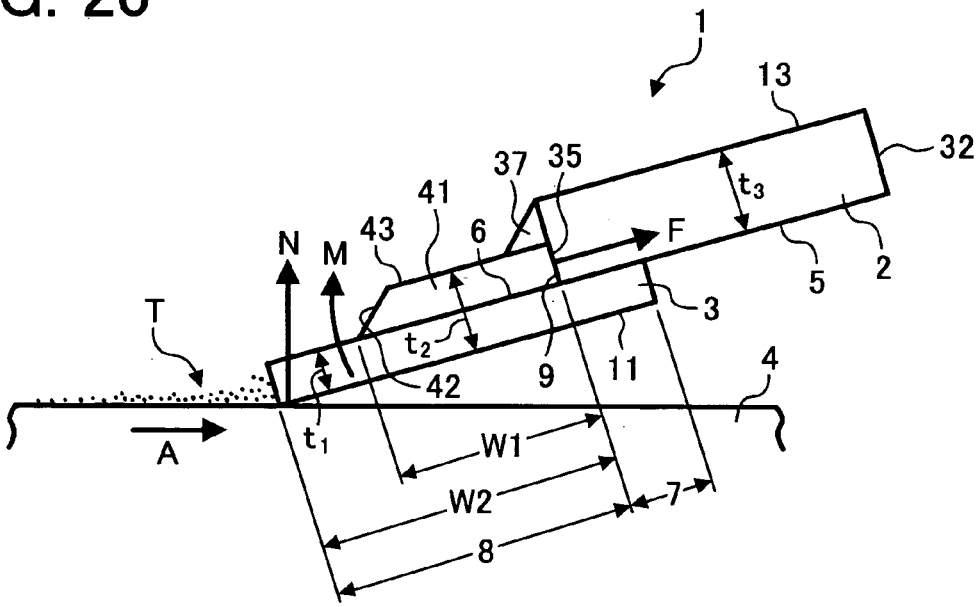
Figure 21:
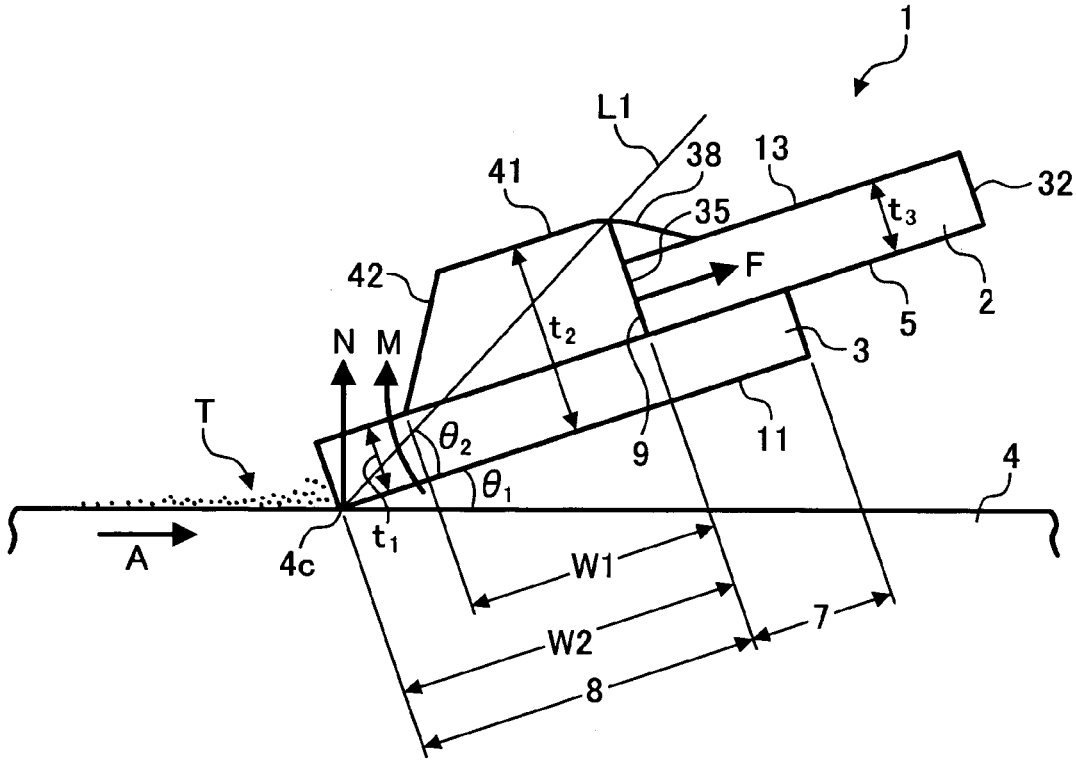

FIGS. 20 and 21 illustrate other embodiments of the cleaner of the present invention. Provided that the thickness of the elastic blade 3 is t1, the total thickness of the elastic blade 3 and the reinforcement 41 is t2, and the thickness of the support plate 2 is t3, the cleaner 1 illustrated in FIG. 20 satisfied the relationship, $t3+t1 \geqq t2 > t1$. In this case, the total thickness t2 of the blade 3 and the reinforcement 41 can be decreased.

In contrast, the cleaner illustrated in FIG. 21 satisfies the relationship, $t3+t1 \leqq t2$. In this case, the combination of the elastic blade 3 and the reinforcement 41 has a relatively large thickness, and thereby the area of the rear surface 35 of the reinforcement 41 can be widened. Therefore, the tip surface of the support plate 9 can securely and stably receive the rear surface 35 of the reinforcement 41. Therefore, the problem in that the blade is sharply bend at a certain point can be securely avoided.

As illustrated in FIG. 21, provided that an angle formed by a surface 11 of the blade 3, which faces the photoreceptor 4, and a tangent line at a point 4*c* on the surface of the photoreceptor 4 in which the photoreceptor contacts the blade 3 is θ1, and an angle formed by a line L1 connecting the uppermost end of the rear surface 35 and the contact point 4*c*, and the surface 11 of the blade 3 is θ2, a relationship $\theta 1 \leqq \theta 2$ is preferably satisfied. When the angle θ2 increases, the area of the rear surface 35 of the reinforcement 41 also increases, and thereby the problem in that the blade is sharply bent at a point and thereby the body of the blade contacts the photoreceptor can be securely avoided. In addition, the everted blade problem in that the tip portion of the blade 3 is drawn by the rotated photoreceptor drum 4 can be avoided, and thereby a good cleanability can be imparted to the cleaner 1. The angle θ2 is preferably from 20 to 30°.

The angle θ1 is preferably from 15 to 25°. When the angle θ1 is too small, the body of the blade 3 contacts the surface of the photoreceptor 4, and thereby the ability of the blade to scrape residual toner particles deteriorates. In contrast, when the angle θ1 is too large, the everted blade problem in that the tip portion of the blade 3 is drawn by the rotated photoreceptor drum 4 caused by large friction force between the blade 3 and the surface of the photoreceptor 4 tends to occur. When the tip portion of the blade is drawn by the photoreceptor 4, not only the defective cleaning problem occurs but also the cleaner does not function. Therefore, the image forming apparatus achieves an abnormal state.

The elastic reinforcement 41 preferably has a JIS A hardness not less than that of the elastic blade 3. In this case, the problem in that the blade is sharply bent at a point and thereby the body of the blade contacts the photoreceptor can be securely avoided.

The JIS A hardness (Hs) and Young's modulus (E) have the following relationship:

$$E=(7.32+Hs)/(0.454\times(100-Hs))[Mpa]$$

The elastic reinforcement can be made of a metal foil having a thickness of from 0.05 to 0.5 mm.

In this embodiment, the relationship illustrated in FIG. 14 is satisfied. Therefore, the JIS A hardness of the blade 3 is preferably from 65 to 80° and the linear pressure of the blade 3 is preferably from 40 to 120 gf/cm (0.392 to 1.176 N/cm). In this case, the cleaner has good cleanability.

Similar to the first embodiment of the cleaner, it is preferable to use a blade having a low repulsion elasticity to remove spherical toner particles. Such a blade as having a low repulsion elasticity can be provided by increasing the content of hard segments in the polyurethane component. In addition, it is preferable to use a blade having a repulsion elastic coefficient, which is not greater than 30% at normal temperature (24±3° C.) and whose rate of change is in a temperature range of from 10 to 40° C. is not greater than 350%. In this case, the blade has good cleanability even when environmental temperature changes.

In addition, similarly to the first embodiment, it is preferable to use the elastic blade (e) which has a repulsion elastic coefficient not greater than 30% at normal temperature and the rate of change thereof in a temperature range of from 10 to 40° C. is not greater than 350%.

When a reinforcement 37 is formed at a corner defined by the surface 43 of the elastic reinforcement 41 and the tip surface 9 of the support plate 2 as illustrated in FIG. 20 while bonded therewith, the tip surface 9 receives not only the force F from the surface 35 of the elastic-reinforcement 41 but also a force from the reinforcement 37. Therefore, the support plate 2 can securely receive the elastic reinforcement 41, and thereby the problem in that the blade is sharply bent at a point and thereby the body of the blade contacts the photoreceptor can be securely avoided.

When a reinforcement 38 is formed at a corner defined by the rear surface 35 of the elastic reinforcement 41 and the back surface 13 as illustrated in FIG. 21 while bonded therewith, the force F from the rear surface 35 of the elastic reinforcement 41 can be securely received by the reinforcement 38 as well as the tip surface 9 of the support plate 2, and thereby the problem in that the blade is sharply bent at a point and thereby the body of the blade contacts the photoreceptor can be securely avoided.

Similarly to the first embodiment of the cleaner mentioned above, adhesive agents can be used as the reinforcements 37 and 38. When the reinforcements 37 and 38 have a low rigidity, the above-mentioned effects cannot be well produced. Therefore, it is preferable that the reinforcements 37 and 38 have a Young's modulus greater than that of the elastic blade 3. Specifically, when the blade 3 has a Young's modulus of from $5.88\times10^6$ to $1.47\times10^7$ Pa (i.e., 60 to 150 kgf/cm$^2$), epoxy resins having a Young's modulus of from $9.8\times10^8$ to $2.94\times10^9$ Pa (i.e., 10,000 to 30,000 kgf/cm$^2$) are preferably used as the reinforcements 37 and 38. It is preferable to coat such an epoxy resin when preparing the reinforcements 37 and 38.

Similarly to the first embodiment of the cleaner mentioned above, the second embodiment of the cleaner can also be used for image forming apparatus (for example, the image forming apparatus illustrated in FIG. 9) and process cartridges (for example, the process cartridge illustrated in FIG. 16).

Then the third embodiment of the cleaner will be explained. At first, the printer for which the cleaner is used.

Figure 22:
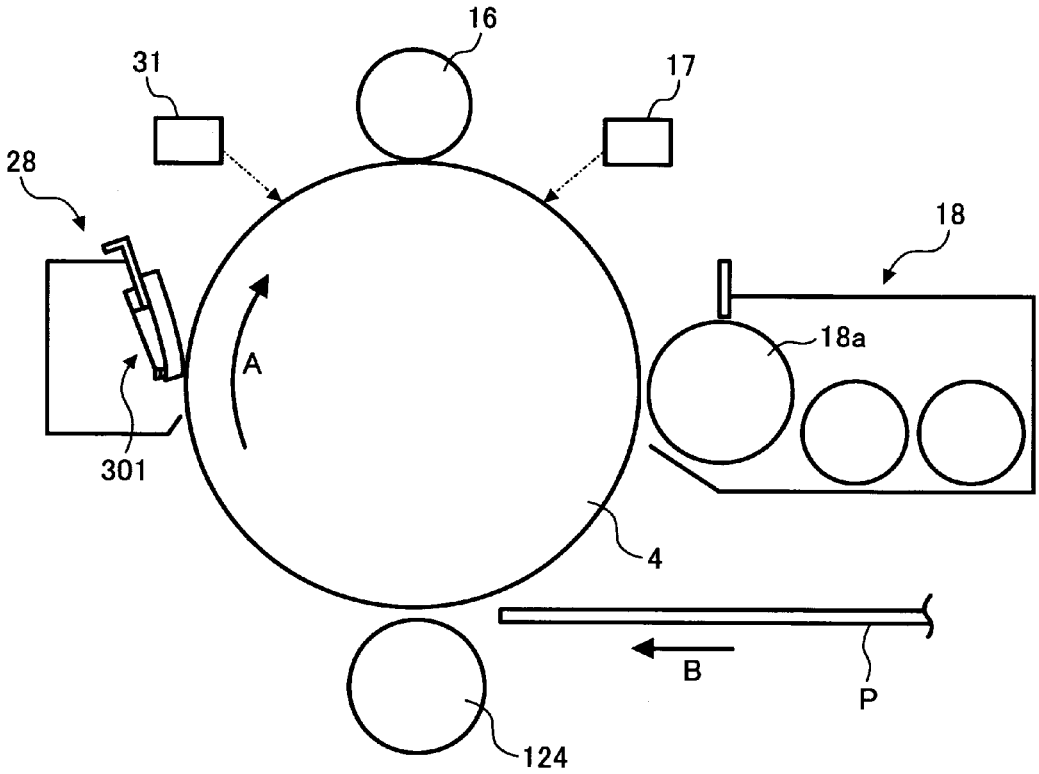
FIG. 22 is a schematic view illustrating another embodiment of the image forming apparatus of the present invention.

FIG. 22 is a schematic view illustrating an image forming apparatus (i.e., a printer) for which the cleaner of the present invention is used.

The printer includes an image bearing member 4 (i.e., a photoreceptor) while rotates in a direction A, a charger 16, a light irradiator 17, a developing device 18 having a developing roller 18*a*, a transfer device 124, a cleaning device 28 and a discharger 31. The cleaning device 28 includes a cleaner 301 which is the cleaner of the present invention. The photoreceptor 4 includes an aluminum cylinder; a photosensitive layer formed on the peripheral surface of the aluminum cylinder; and an outermost layer formed on the photosensitive layer and including a polycarbonate resin. The surface of the photoreceptor has a friction coefficient of from 0.3 to 0.6.

The charger 16 uniformly charges the surface of the photoreceptor 4. The charger 16 charges the photoreceptor 4 by applying a bias to a charging member while contacting the charging member with the surface of the photoreceptor or setting the charging member in close proximity to the surface of the photoreceptor, resulting in formation of a charge with desired polarity and voltage on the photoreceptor. Specific examples of the charging member include transfer rollers and belts made of an elastic material; and scorotron chargers using a wire electrode and a grid electrode. The charging member is not limited thereto, and various known chargers can be used therefor.

The light irradiator 17 irradiates the charge surface of the photoreceptor 4 with light modulated image data to form an electrostatic latent image on the photoreceptor 4. Specific examples of the light irradiator include devices including a laser diode (LD) or a light emitting diode (LED), but are not limited thereto.

The developing device 18 develops the electrostatic latent image with a developer including a toner to form a toner image on the photoreceptor 4. The developing device 18 includes the developing roller 18*a* which serves as a developer bearing member and in which a magnetic field generating member is fixedly arranged. The developing roller 18*a* rotates while bearing the developer on the surface thereof. Thus, the developer is fed to the developing region at which the developing roller 18*a* faces the photoreceptor 4. In this embodiment, a magnetic brush developing method using a two-component developer including a toner and a carrier is used. In the magnetic brush developing method, the carrier in the two-component developer is erected at the developing region by the magnet in the developing roller, resulting in formation of a magnetic brush. A developing bias may be applied to the developing roller 18*a*. In this case, a potential difference is formed between the surface of the developing roller 18*a* and the surface of the photoreceptor 4. Therefore, the toner in the developer is attracted by the electrostatic latent image, resulting in formation of a toner image. The developing device 18 is not limited thereto, and known developing devices can be used.

The transfer device 124 transfers a toner image formed on the photoreceptor 4 to a receiving material P which is fed in a direction B. The transfer device 124 brings a transfer member such as transfer rollers into contact with the photoreceptor 4 at a predetermined pressure, and thereby a nip is formed between the transfer member and the photoreceptor 4.

The transfer device 124 applies a transfer bias, whose polarity is opposite to that of charge of the toner used, to the receiving material P, resulting in formation of an electric field, and thereby the toner image on the photoreceptor 4 is transferred to the receiving material P. Specific examples of the transfer member include transfer rollers and belts made of an elastic material; and scorotron chargers using a wire electrode and a grid electrode. The transfer member is not limited thereto, and various known chargers can be used therefor. The receiving material bearing the toner image thereon is then fed to a fixing device at which the toner image is fixed to the receiving material P. Then the receiving material P bearing the fixed toner image thereon is discharged from the image forming apparatus.

The cleaning device 28 removes toner particles remaining on the surface of the photoreceptor 4 even after the transfer operation. The cleaning device 28 scrapes off the toner particles using a blade of the cleaner 301 of the present invention. The toner particles scraped by the blade falls in the cleaning device 28. The thus collected toner particles are fed by a toner feeding mechanism (not shown) to a waste toner bottle (not shown). The toner stored in the waste toner bottle is collected by a serviceman. Alternatively, the collected toner particles may be returned to the developing device 18 to be reused.

The discharger 31 removes charges remaining on the surface of the photoreceptor 4 even after the cleaning process such that the photoreceptor 4 can be ready for the next image forming operation. In this case, a device using a light emitting diode (LED) is used as the discharger 8, but the discharger is not limited thereto.

Recently, a need exist for an image forming apparatus which can produce high quality and high definition images. In order to produce high definition images, it is preferable to use a spherical toner having a small particle diameter. Therefore, in the third embodiment a toner including toner particles having particle diameters of from 2.0 to 10 μm and an average circularity not less than 0.98 is used. The circularity is determined by the following method:

(1) 100 to 150 ml of water, from which impurities have been removed, is mixed with 0.1 to 0.5 ml of a surfactant (alkylbenzene sulfonate), and 0.1 to 0.5 g of a sample is added thereto;

(3) the mixture is subjected to a dispersion treatment for 1 to 3 minutes using an ultrasonic dispersing machine to prepare a dispersion in which particles of the sample are present at a concentration of from 3,000 to 10,000 pieces/μl;

(4) the shape of the toner particles and the distribution of the shape is determined using a flow type particle image analyzer FPIA-2000 from Sysmex Corp., to determine the average circularity of the toner.

Figure 23A:
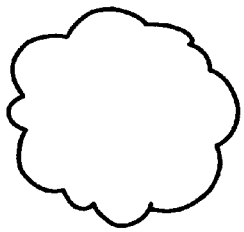
FIGS. 23A and 23*b* are schematic views for explaining the way to determine the circularity of a toner particle.
Figure 23B:
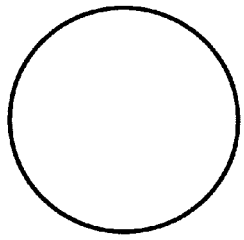

The circularity of a toner particle is determined by the following equation:

$$\text{Circularity}=L2/L1$$

wherein, as illustrated in FIGS. 23A and 23B, L1 represents the peripheral length of the image of a particle and L2 represents the peripheral length of the image of a circle having the same area (S) as that of the image of the particle.

Spherical toners can be produced by the following methods:

(1) toner having an irregular form, which is prepared by a method such as kneading/pulverization methods is subjected to a heat treatment; and (2) toner prepared by a polymerization method.

However, the method for manufacturing a spherical toner is not limited thereto.

It is difficult to perfectly remove such a spherical toner from the surface of a photoreceptor by a conventional cleaning blade.

As mentioned above, the cause for the defective cleaning problem is the stick-slip movement (i.e., micro vibration) of the tip of the blade used for removing toner particles. Therefore, it is considered that the problem in that a large amount of spherical toner particles pass through the nip between a blade and the surface of a photoreceptor can be avoided if occurrence of the stick-slip movement could be prevented. As a result of the present inventors' investigation, it was found that the repulsion elastic coefficient closely relates to the stick-slip movement. The present inventors' investigation will be explained below in detail.

Experiment 1

Figure 4:
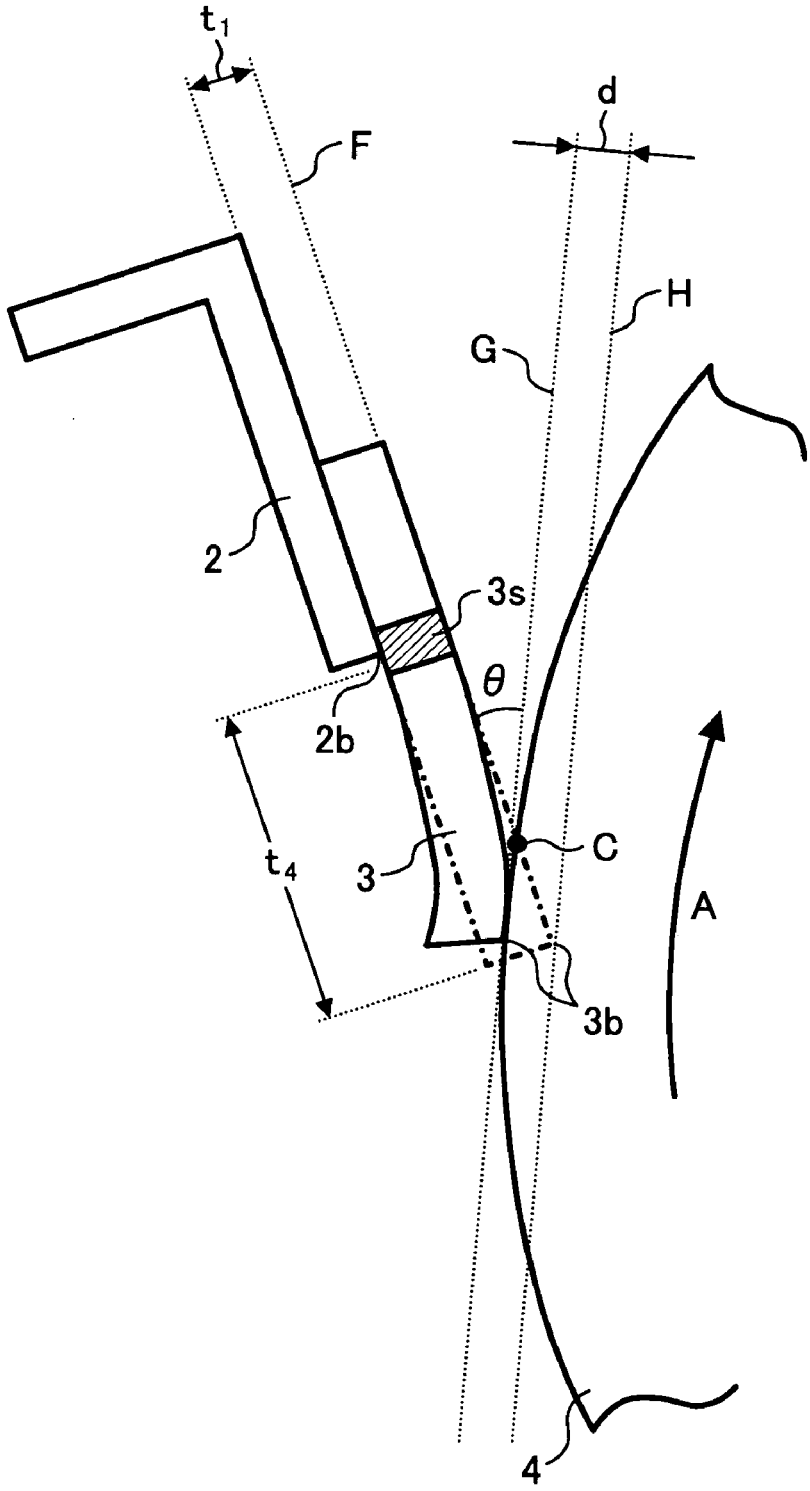
FIG. 4 is a schematic view for explaining how a background cleaner is set to an image bearing member.
Figure 5:
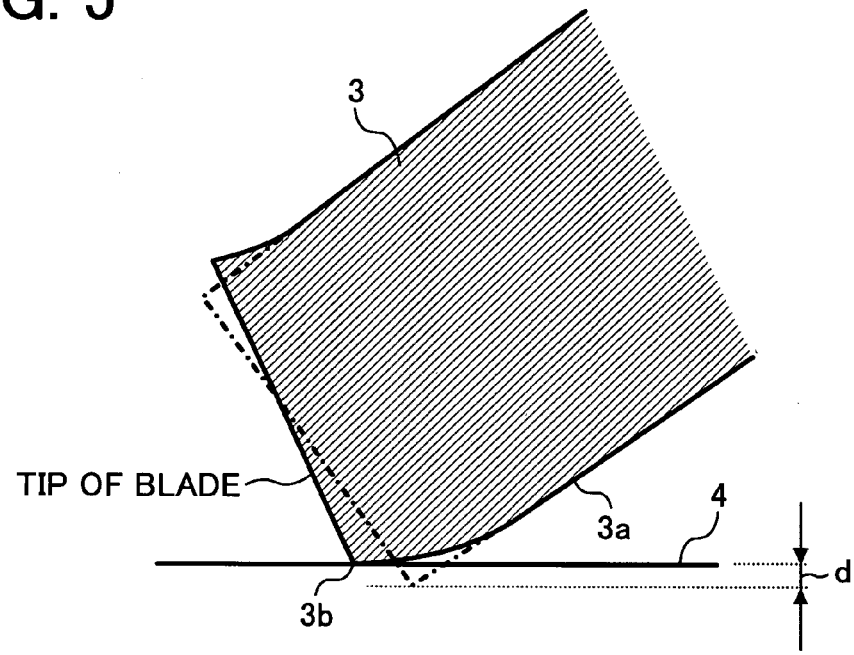
FIG. 5 is a schematic cross sectional view illustrating the tip portion of the blade illustrated in FIG. 4 when the image bearing member is not rotated.

The configuration of the cleaner used for Experiment 1 is illustrated in FIG. 4. The cleaning blade 3 is set so as to counter the photoreceptor 4 rotating in the direction A while having a contact angle of θ relative to the surface of the photoreceptor 4 (i.e., the line G). In addition, the tip edge of the blade 3 contacts the surface of the photoreceptor 4 while being deformed in an amount of (d).

In Experiment 1, each of twelve cleaning blades made of different materials and having different repulsion elasticity and hardness was adhered to a metal support plate serving as the support plate 3 and the cleaning property of the cleaning blades was evaluated. Specifically, a cleaning test in which spherical toner particles on the photoreceptor 4 are removed by each of the cleaning blades was performed while observing to determine whether the stick-slip movement occurs and whether the spherical toner particles can be removed. The cleaning conditions are as follows.

(1) Contact angle (θ): 20°

(2) Amount of deformation (d): 1.0 mm (3) Moving speed of surface of photoreceptor: 100 mm/sec (4) Thickness of blade (t1): 2.0 mm (5) Length of front portion (t4): 7.0 mm (6) Linear pressure of blade: 40 g/cm In this regard, the linear pressure is determined as follows.

1) a sheet-form pressure sensor having a thickness of 0.1 mm is set on a photoreceptor;

2) a cleaning blade is set on the pressure sensor such that the tip of the blade is in a stick state, to measure the load (in units of gram) on the sensor (i.e., on the photoreceptor); and 3) the thus determined load is divided by the length (in units of centimeter) of the blade in the longitudinal direction of the blade (i.e., in the direction of the axis of the photoreceptor) to determine the linear pressure of the blade.

The sheet-form sensor has a plurality of electrodes which are arranged in different two directions (i.e., X and Y directions) which are perpendicular to each other and which are covered with a film. These electrodes have a pressure sensitive resistance material and a charge generating material which are arranged like a lattice. When a pressure is applied to an intersection of the lattice, the resistance of the material changes depending on the pressure. The resistance can be determined by the currents flowing in the X and Y directions. Therefore, by checking the current, the load applied to the sensor can be determined.

The results of the experiment are shown in Table 1 below. The cleanability of the blades was evaluated as follows.

1) a vertical stripe image having an image area proportion of 5% which is to be formed on a A-4 size receiving sheet is formed on a photoreceptor; and 2) the toner image on the photoreceptor is removed by each of the blades without transferred to a receiving sheet;

3) the surface of the photoreceptor is observed to determine whether there remain toner particles on the surface of the photoreceptor.

The cleanability is classified into the following four grades:

⊙: Spherical toner particles are substantially perfectly removed from the surface of the photoreceptor.

○: Spherical toner particles are well removed from the surface of the photoreceptor.

Δ: There remain several spherical toner particles on the surface of the photoreceptor.

X: There remain many spherical toner particles on the entire surface of the photoreceptor.

TABLE 1

| Blade | Repulsion elastic Coefficient at 23° C. (%) | JIS A Hardness (°) | Stick-slip movement | Cleanability |
|---|---|---|---|---|
| No. 1 | 8 | 65 | No | Δ |
| No. 2 | 8 | 70 | No | ○ |
| No. 3 | 8 | 80 | No | ○ |
| No. 4 | 20 | 65 | No | Δ |
| No. 5 | 20 | 70 | No | ○ |
| No. 6 | 20 | 80 | No | ○ |
| No. 7 | 30 | 65 | No | Δ |
| No. 8 | 30 | 70 | No | Δ |
| No. 9 | 30 | 80 | No | ○ |
| No. 10 | 40 | 65 | YES | X |
| No. 11 | 40 | 70 | YES | X |
| No. 12 | 40 | 80 | YES | Δ |

It is clear from Table 1 that any blades having a repulsion elasticity not greater than 30% do not cause the stick-slip movement independently of the hardness thereof. In other words, any blades having a repulsion elastic coefficient not less than 40% causes the stick-slip movement independently of the hardness thereof. The reason therefore is considered to be as follows. When a portion of a blade with a high repulsion elasitic coefficient is deformed because of passage of toner particles therethrough, the portion is restored at a high speed. Therefore, the tip of the blade can easily move in the direction opposite to the direction A because the restoring energy of the blade is greater than the energy of friction between the blade and the surface of the photoreceptor.

In contrast, in the case of a blade with a low repulsion elasticity, the portion through which toner particles have passed is restored at a low speed. Therefore, the tip of the blade move slowly in the direction opposite to the direction A because the restoring energy of the blade is less than the energy of friction between the blade and the surface of the photoreceptor. Therefore, before achieving the slip state, the blade is returned to the stick state. Thus, the blades with a low repulsion elastic coefficient do not cause the stick-slip movement, and thereby the problem in that a large amount of toner particles pass through a blade at a time can be avoided.

Even when blades having the same repulsion elastic coefficient are used, the cleanability thereof increases as the hardness (JIS A hardness) of the blades increases. The reason is considered to be as follows. When a blade having a low hardness is used, the portion of the blade through which toner particles are passing is easily deformed, and thereby the toner particles can easily pass through the portion. In particular, in the case of the blades with a low repulsion elastic coefficient and a low hardness, the portion through which toner particles have passed is largely deformed and in addition the portion is restored at a low speed. Therefore, the following toner particle passes through the deformed portion. If toner particles pass through the portion which is under restoration, the portion is prevented from restoring, and the next toner particle passes through the portion. Thus, the deformation of the portion is maintained until there are no following toner particles, resulting in passage of many toner particles (i.e., the blades Nos. 1, 4 and 7 have a cleanability of the "Δ" grade). In contrast, when the blade has a high hardness, the portion through which toner particles pass is not easily deformed by the toner particles, and thereby the problem in that many toner particles continuously pass through the portion can be avoided.

Thus, it is found that by using a proper material for a blade, the blade can prevent occurrence of the stick-slip movement by not maintaining the deformation caused by pushing by toner particles, resulting in prevention of the problem in that many toner particles continuously pass through the deformed portion. Specifically, when the blade 3 has a hardness of from 70° to 80° and a repulsion elastic coefficient of from 8% to 30%, the bad cleaning problem can be avoided.

Figure 6:
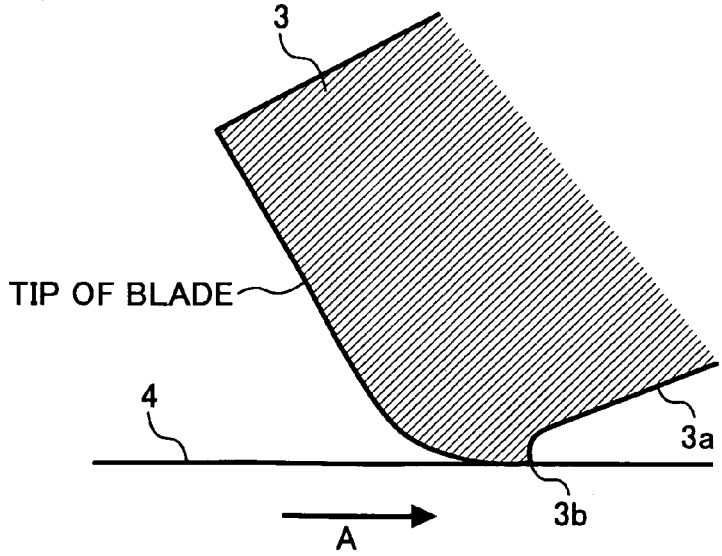
FIG. 6 is a schematic cross sectional view illustrating the tip portion of the blade illustrated in FIG. 4 when the image bearing member is rotated.
Figure 7:
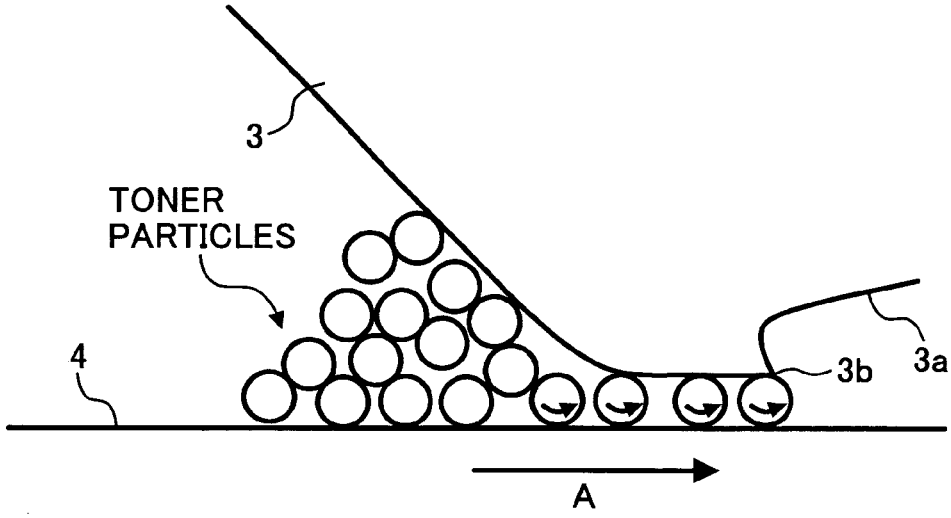
Figure 8:
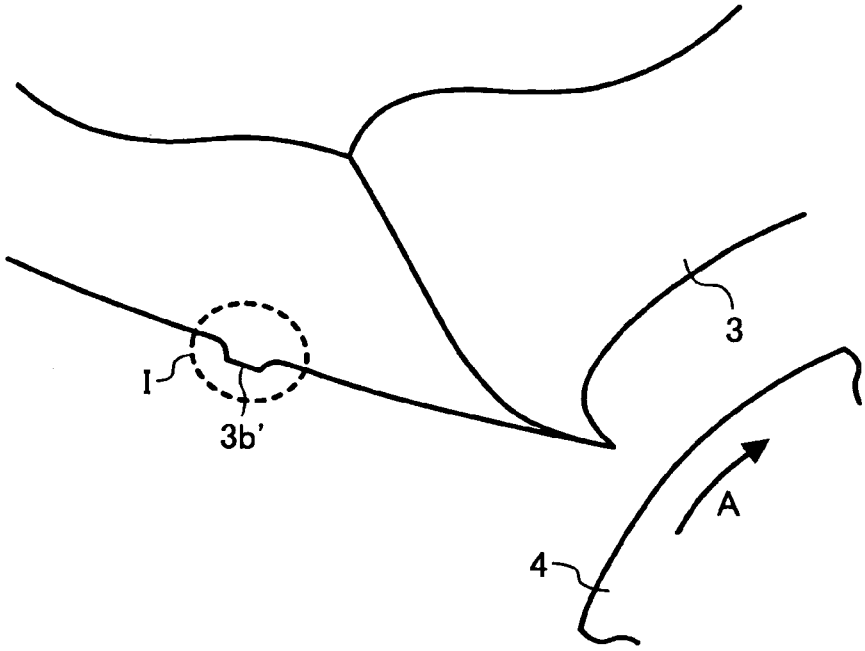
FIG. 8 is a perspective view illustrating the tip portion of the blade in which a portion of the blade achieves a slip state while other portions achieve a stick state.

As mentioned above, the stick-slip movement is defined as a phenomenon in that when the position of the tip edge 3*b* of the blade 3 in the stick state as illustrated in FIG. 6 is 0 (i.e., an original point), the tip edge 3*b* moves to a point in a range of from +8 μm to +15 μm in an upstream region relative to the rotation direction of the photoreceptor. Therefore, when the edge 3*b* moves to a point in a range of from 0 μm to +8 μm in an upstream region, the blade is defined as a blade not causing the stick-slip movement.

Experiment 2

Another experiment in which toner particles on a photoreceptor 4 are removed using each of the blades Nos. 2, 3, 5, 6 and 9, which have good cleanability, while changing the linear pressure of the blade to check the cleanabilty of the blades was performed.

The results are shown in Table 2.

TABLE 2

| Blade | Repulsion elastic coefficient (%) | Hardness | Linear pressure | Stick-slip movement | Cleanability |
|---|---|---|---|---|---|
| No. 2 | 8 | 70 | 40 | No | ○ |
| No. 2 | 8 | 70 | 60 | No | ○ |
| No. 2 | 8 | 70 | 80 | No | ◎ |
| No. 2 | 8 | 70 | 100 | No | ◎ |
| No. 2 | 8 | 70 | 120 | No | ◎ |
| No. 3 | 8 | 80 | 40 | No | ○ |
| No. 3 | 8 | 80 | 60 | No | ○ |
| No. 3 | 8 | 80 | 80 | No | ◎ |
| No. 3 | 8 | 80 | 100 | No | ◎ |
| No. 3 | 8 | 80 | 120 | No | ◎ |
| No. 5 | 20 | 70 | 40 | No | ○ |
| No. 5 | 20 | 70 | 60 | No | ○ |
| No. 5 | 20 | 70 | 80 | No | ◎ |
| No. 5 | 20 | 70 | 100 | No | ◎ |
| No. 5 | 20 | 70 | 120 | No | ◎ |
| No. 6 | 20 | 80 | 40 | No | ○ |
| No. 6 | 20 | 80 | 60 | No | ○ |
| No. 6 | 20 | 80 | 80 | No | ◎ |
| No. 6 | 20 | 80 | 100 | No | ◎ |
| No. 6 | 20 | 80 | 120 | No | ◎ |
| No. 9 | 30 | 80 | 40 | No | ○ |
| No. 9 | 30 | 80 | 60 | No | ○ |
| No. 9 | 30 | 80 | 80 | No | ◎ |
| No. 9 | 30 | 80 | 100 | No | ◎ |
| No. 9 | 30 | 80 | 120 | No | ◎ |

It is clear from Table 2 that whenever the linear pressure is from 80 to 120 g/cm, the cleaning blades 2, 3, 5, 6 and 9 have excellent cleanability (i.e., the "◎" grade). Namely, the blades could substantially perfectly remove spherical toner particles on the photoreceptor.

Experiment 3

Another experiment was performed to check the relationship between the contact angle θ (illustrated in FIG. 4) of the blade and the cleanability of the blade. The experimental conditions are as follows.

(1) Moving speed of surface of photoreceptor: 100 mm/sec (2) Thickness of blade (t1): 2.0 mm (3) Length of front portion (t4): 7.0 mm (4) Linear pressure of blade: 80 g/cm (5) Repulsion elastic coefficient of blade: 25%

(6) JIS A hardness of blade: 75°

The evaluation method is mentioned above in Experiment 1.

The results are shown in Table 3.

TABLE 3

| Contact angle θ (°) | Cleanability | Remarks |
|---|---|---|
| 14 | Δ | The first surface of the blade contacts the photoreceptor |
| 16 | Δ | The first surface of the blade contacts the photoreceptor |
| 18 | ◎ | Nothing abnormal |
| 20 | ◎ | Nothing abnormal |
| 22 | ◎ | Nothing abnormal |
| 24 | ◎ | Nothing abnormal |
| 26 | ◎ | Nothing abnormal |
| 28 | Δ | Abnormal noise (flattering sound) is generated. |
| 30 | X | The blade is drawn by the photoreceptor. |

It is clear from Table 3 that when the contact angle of the blade is from 18° to 26°, the blade has excellent cleanability, i.e., spherical toner particles can be substantially perfectly removed from the surface of the photoreceptor. When the contact angle is not higher than 16°, the blade has a cleability of the "Δ" grade, namely, a small amount of toner particles remain on the surface of the photoreceptor. This is because the first surface (i.e., the body) of the blade, which faces the photoreceptor, contacts the photoreceptor. In this case, the area of the contacted portion increases, and thereby the linear pressure of the blade decreases, resulting in deterioration of cleanability.

In contrast, when the contact angle is 28°, the blade generated flattering sound and the cleanability deteriorated. This is because the tip surface of the blade contacts the photoreceptor, and thereby an abnormal stick-slip movement is caused. When the contact angle is 30°, the tip of the blade was driven by the rotated photoreceptor, and thereby the surface of the photoreceptor was damaged. Thus, the contact angle of the blade is preferably from 18° to 26°.

If conventional cleaners are used, it is difficult to obtain such a high linear pressure as that (80 to 120 g/cm) of the cleaner of the present invention.

Then the fourth embodiment of the cleaner will be explained.

First Example of Fourth Embodiment

In order to increase the linear pressure of a blade, for example, a method in which the metal support 2 is set such that the tip thereof approaches the contact point. In this case, the deformation (d) of the blade increases. If the deformation is greater than a certain value, the problem in that the body of the blade contacts the photoreceptor occurs. Therefore, the contact area increases and thereby the linear pressure decreases. As a result, the linear pressure cannot be increased.

The first example of the fourth embodiment of the cleaner has a configuration in that the cleaner has a pressing member which presses the back surface of the blade in the longitudinal direction of the blade to increase the linear pressure of the blade.

Figure 24:
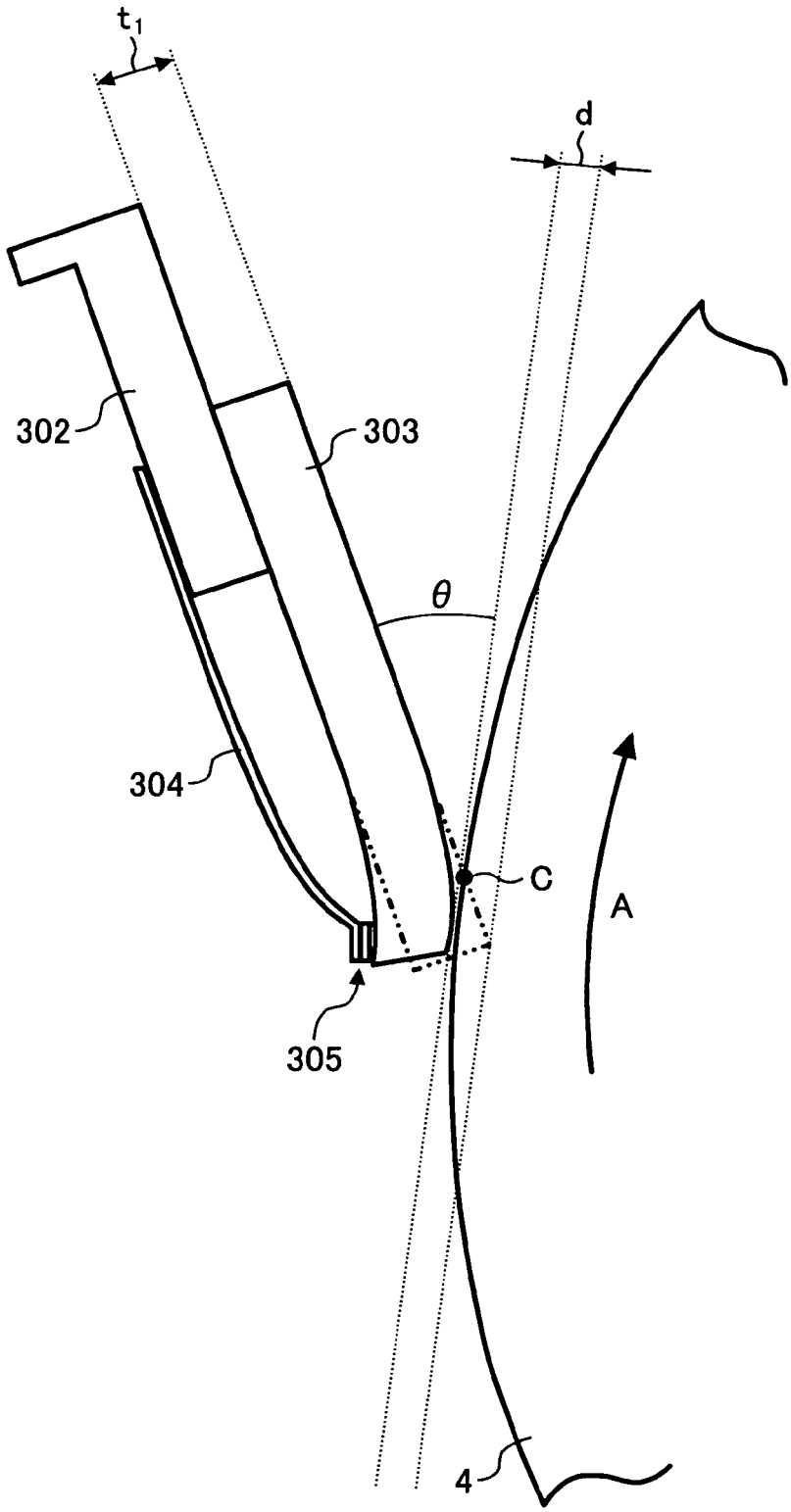
FIGS. 24 and 25 are schematic views illustrating another embodiment of the cleaner of the present invention.
Figure 25:
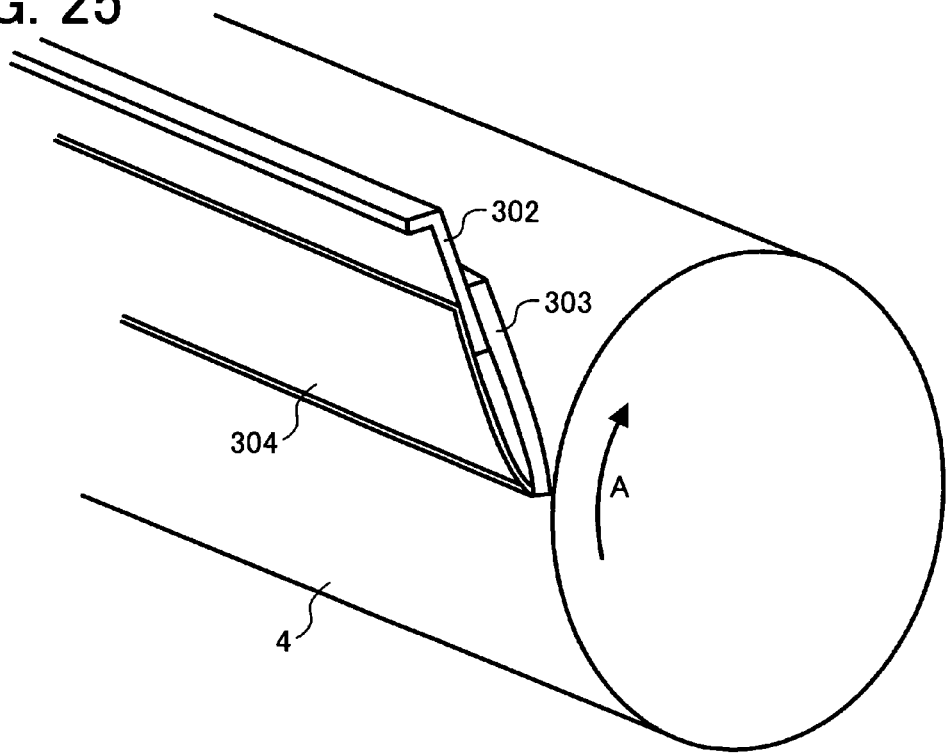

FIG. 24 is a schematic cross-sectional view illustrating the first example of the fourth embodiment of the cleaner of the present invention. FIG. 25 is a perspective view of the cleaner illustrated in FIG. 24.

A cleaning blade 303 is set so as to counter the photoreceptor 4 rotated in the direction A while the tip edge thereof is contacted with the photoreceptor at an angle of θ and is deformed in an amount of (d). The blade 3 is an elastic member made of a polyurethane rubber having a repulsion elastic coefficient of from 8 to 30% and a hardness of from 70° to 80°. The blade 303 preferably has a thickness (t1) of from 1.0 to 5.0 mm, and the deformation (d) thereof is preferably from 0.5 to 2.0 mm. In the first example, the contact angle (Θ) and the deformation amount (d) are set to be 20° and 1.0 mm, respectively.

Referring to FIGS. 24 and 25, a metal plate having a thickness of from 0.1 to 0.5 mm is provided as a backup member 304. The backup member 304 is set so as to face the back surface of the blade 304. One end of the backup member 304 is fixed to the support plate 302, and the other end is fixed to the tip portion of the blade 303 with a connector 305 therebetween. The backup member 304 presses only the tip portion of the back surface of the blade 303 using the restoring force thereof caused by bending thereof. Since the restoring force is applied to only the tip portion of the blade 303, the resultant linear pressure is greater than the pressure obtained by conventional methods in which only the deformation amount (d) is increased.

In this example, the restoring force of the backup member 304 can be efficiently transmitted to the tip portion of the blade and the contact point of the blade and the photoreceptor 4, and thereby a high linear pressure can be obtained.

The photoreceptor 4 often causes vibration during rotation, which is caused by decentering of the photoreceptor, and in addition the surface of the photoreceptor has small asperities and swells. In order that the blade can keep contacting with the surface of such a photoreceptor, the blade is made of an elastic material such as rubbers and in addition the blade is contacted with the surface while bending. In this first example, the pressing member of the backup member is fixed to the tip portion of the blade. If the backup member is rigid, the blade cannot keep contacting with the surface of the photoreceptor which causes vibration during rotation and has small asperities and swells. Therefore, a metal plate having a thickness of from 0.1 mm to 0.5 mm is used for the backup member while the metal plate is bent. When the backup member has such a configuration, the backup member does not prevent the blade from keeping contacting with the surface of such a photoreceptor as mentioned above. Suitable metals for use as the backup plate include stainless steels (SUS) and phosphor bronze.

In this example, the backup member 304 is set so as to be parallel with the back surface of the blade 303, the restoring force of the backup member acts in parallel with the normal line of the back surface of the blade. When the pressing member of the backup member is merely fixed to the back surface of the tip portion of the blade, the restoring force of the backup member is transmitted to a tip portion of the first surface of the blade opposite to the back surface thereof. However, in the stick state of the blade, the tip surface of the blade is contacted with the surface of the photoreceptor as illustrated in FIG. 6. Therefore, in this example, the restoring force of the backup member is transmitted to the contact portion of the blade by the following method.

Figure 26:
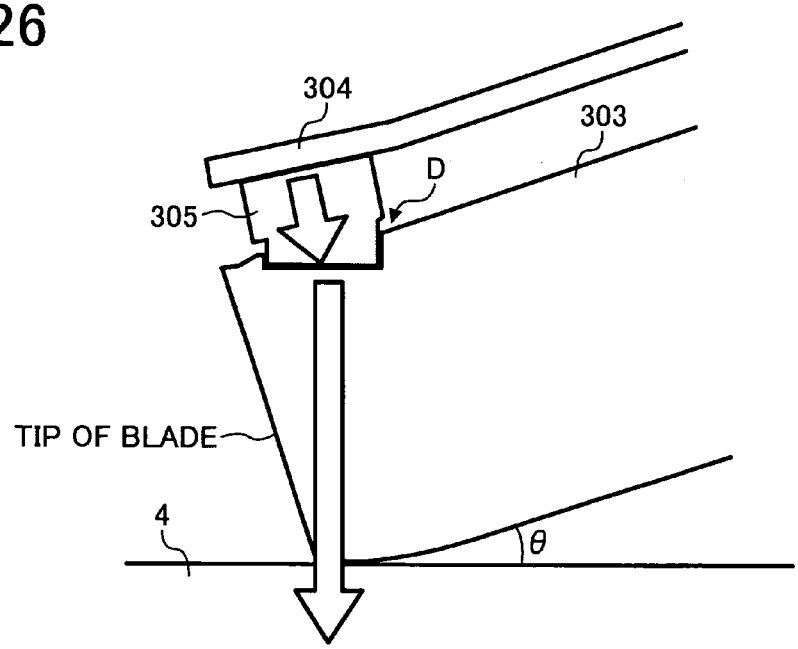
FIG. 26 is a schematic view illustrating the tip portion of the blade illustrated in FIGS. 24 and 25.

FIG. 26 is a schematic view illustrating the tip portion of the blade of this first example of the fourth embodiment of the cleaner. The cleaner has a connector 305 which is located between the backup member 304 and the tip potion of the blade 303 and which is bonded therewith using an adhesive. As illustrated in FIG. 26, the connector 305 is engaged with a recessed portion D of the blade 303. The bottom surface of the recessed portion D is parallel to the surface of the photoreceptor when the blade is contacted with the surface of the photoreceptor at an angle of θ. The entire of the upper surface of the connector 305 is connected with the surface of the backup member 304 and the entire of the lower surface of the connector is connected with the bottom surface of the recessed portion D. Therefore, the lower surface of the connector 305 is parallel to the surface of the photoreceptor 4.

The component of the restoring force of the backup member 304 in the direction parallel to the surface of the photoreceptor is cancelled by the reactive force from the wall of the recessed portion D. In contrast, the component of the restoring force of the backup member 304 in the direction parallel to the normal line of the surface of the photoreceptor 4 is straightly transmitted to the bottom surface of the recessed portion D. Thus, only the normal line component of the restoring force of the backup member 304 is transmitted to the contact portion of the blade. Therefore, a high linear pressure can be applied to the contact portion.

In this first example, a high pressure, specifically a pressure of from 80 to 120 gf/cm, can be applied to the photoreceptor.

Second Example of the Fourth Embodiment

Then the second example of the fourth embodiment will be explained.

Figure 27:
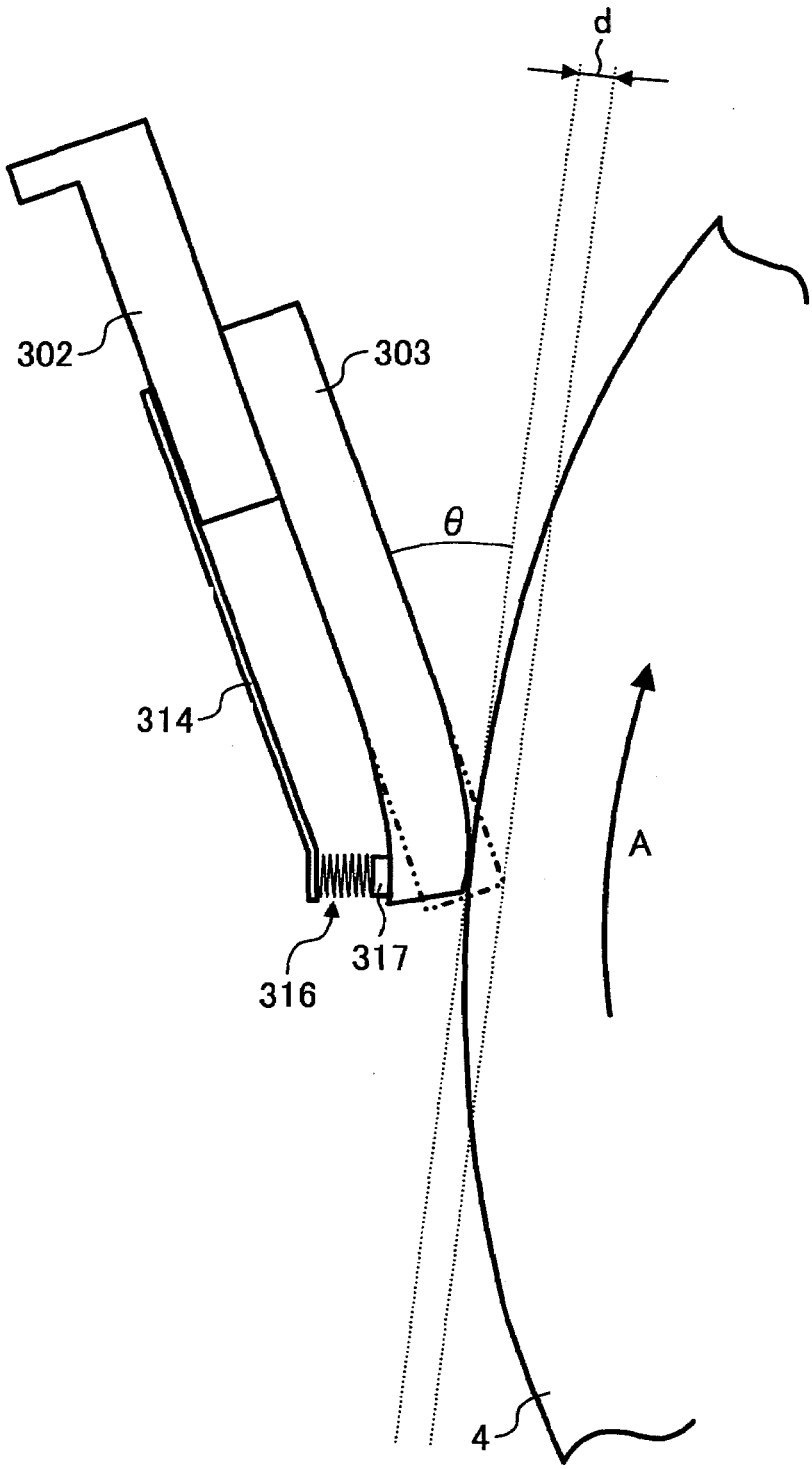
FIGS. 27 and 28 are schematic views illustrating another embodiment of the cleaner of the present invention.
Figure 28:
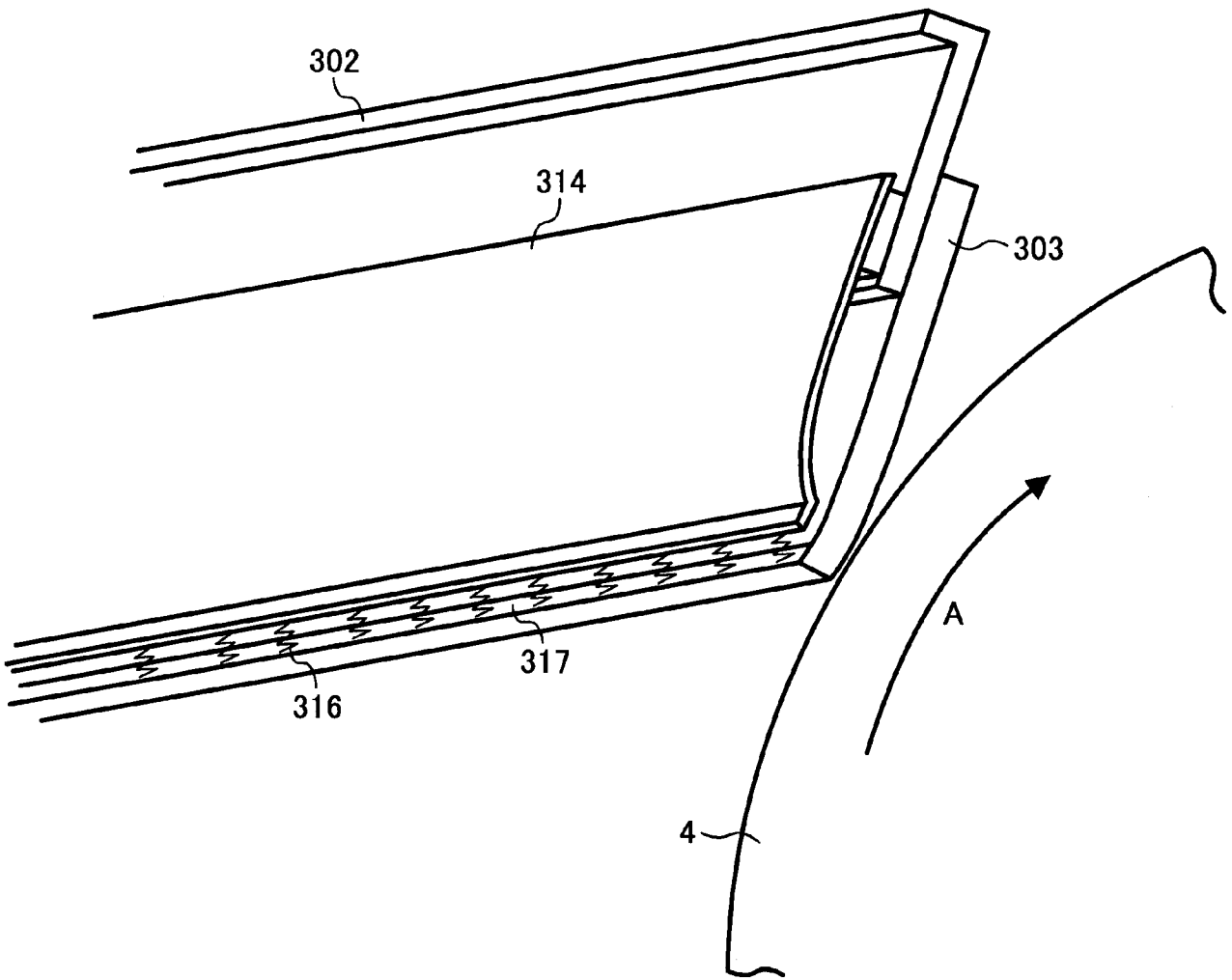

FIG. 27 is a schematic view illustrating the second example of the fourth embodiment of the cleaner of the present invention. FIG. 28 is a perspective view of the cleaner illustrated in FIG. 27.

This cleaner is the same as the first example mentioned above except that the pressing member has a structure different from that of the first example. Specifically, a backup member 314 is a plate constituted of a rigid material. A plurality of springs 316 are fixedly provided between the tip portion of the backup member 314 and the tip portion of the blade 303 at regular intervals in the longitudinal direction of the blade. Thus, the blade 303 is pressed to the surface of the photoreceptor 4 by the elasticity of the springs 316. The springs 316 is connected with the tip portion of the blade 303 with an adhesive layer 317 therebetween. In this second example, a coil-shaped compression spring having a wire having a thickness of from 0.5 to 1 mm is used as the springs 316.

In this second example, a high pressure, specifically a pressure of from 80 to 120 g/cm, can be applied to the photoreceptor.

Third Example of the Fourth Embodiment

Then the third example of the fourth embodiment of the cleaner of the present invention will be explained.

Figure 29:
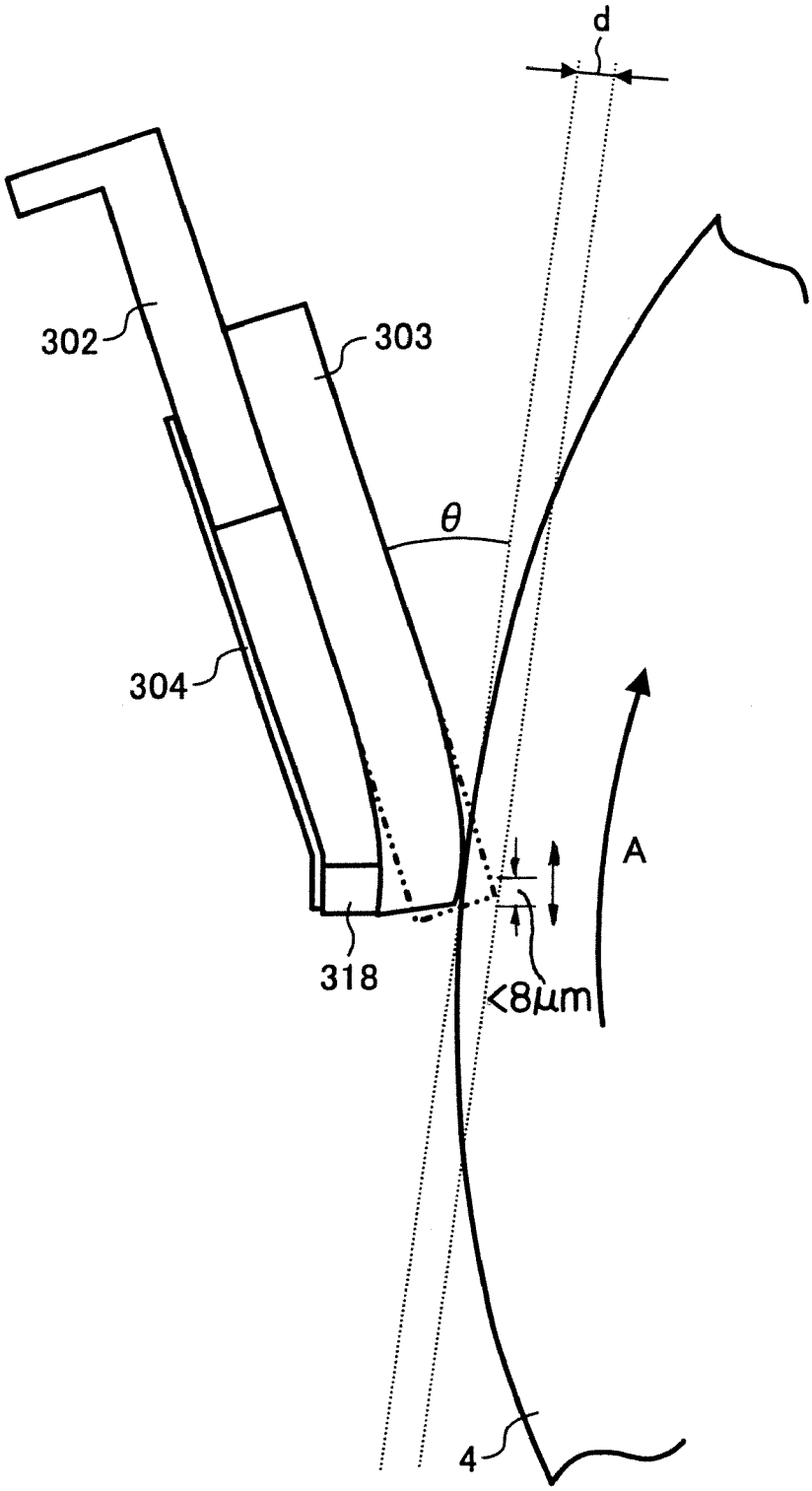
FIGS. 29 and 30 are schematic views illustrating other embodiments of the cleaner of the present invention.

FIG. 29 is a schematic view illustrating another example of the fourth embodiment of the cleaner.

This cleaner is the same as the first example mentioned above except that the connector 305 is replaced with an elastic member 318. Specifically, the elastic member 318 is made of an elastic material (such as rubbers) having a repulsion elasticity greater than that of the blade 303. Similarly to the first example, the restoring force of the backup member 304 can be efficiently transmitted to the contact portion of the tip portion of the blade 303 via the elastic member 318. Since the elastic member 318 has a large repulsion elasticity, the blade 303 can keep contacting with the surface of the photoreceptor even when the photoreceptor has asperities and swells.

When the surface of the photoreceptor 4 moves in such a direction as to approach the cleaning blade 303 due to uneven rotation of the photoreceptor and asperities and swells of the surface of the photoreceptor, the blade 303 is deformed so as to follow the surface of the photoreceptor 4, i.e., to keep contacting the surface of the photoreceptor 4. Since the blade has a relatively low repulsion elastic coefficient of from 8 to 30%, the blade has a low restoring speed. Therefore, when the photoreceptor 4 moves in such a direction as to release from the blade 303, there is a case where the blade cannot follow the movement of the photoreceptor. In order to prevent occurrence of such a problem, an elastic material having a repulsion elasticity greater than that of the blade 303 is used for the elastic member 318. When the blade 303 is deformed and restored due to uneven rotation of the photoreceptor and asperities and swells of the surface of the photoreceptor, the elastic member 318 follows the movement of the blade. Therefore, when the blade 303 is restored, the restoring force of the elastic member 318 is transmitted to the blade 303. Therefore, the restoring speed of the blade can be increased. Thus, when the photoreceptor 4 moves in such a direction as to release from the blade 303, the blade 303 can follow the movement of the photoreceptor.

Thus, the third example can follow the movement of the photoreceptor even when the photoreceptor 4 moves in such a direction as to approach or release from the blade 303.

Fourth Example of the Fourth Embodiment

Then the fourth example of the fourth embodiment of the cleaner of the present invention will be explained.

Figure 30:
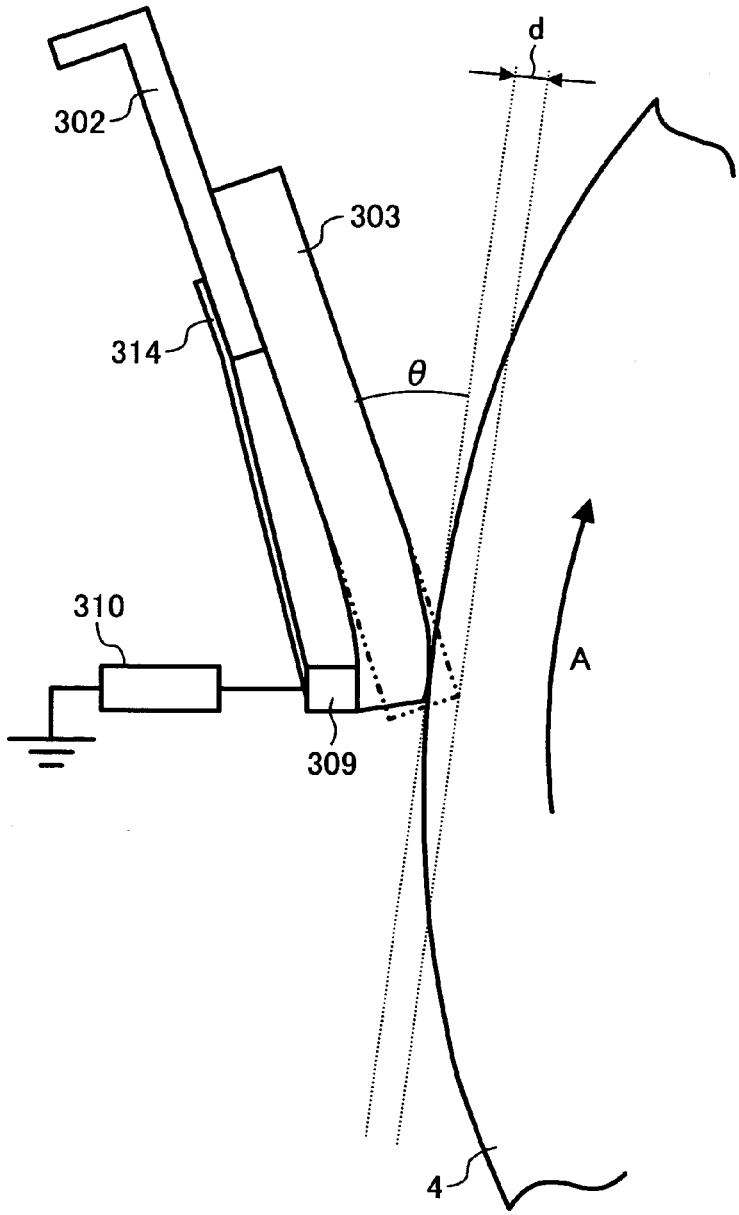

FIG. 30 is a schematic view illustrating another example of the fourth embodiment of the cleaner.

This cleaner is the same as the first example mentioned above except that the connector 305 is replaced with a piezoelectric element 309 and a voltage controller 310 which applies a voltage while controlling the voltage. In addition, this fourth example is different from the first example in that the backup member is made of a rigid plate similarly to the second example.

Multi-layered piezoelectric elements are preferably used for the piezoelectric element 309. These piezoelectric elements have a relatively high characteristic frequency of from 50 to 100 KHz. In addition, the piezoelectric elements can generate a large force. By using a relatively thick blade, the blade can respond to such a high frequency piezoelectric element. The piezoelectric element 309 is deformed by the voltage applied by the voltage controller 310 in such a direction as to widen or shorten the interval between the blade 303 and the backup member 304. Therefore, when a voltage is applied to the piezoelectric element 309 to deform the element in such a direction as to widen the interval between the blade 303 and the backup member 304, the pressure of the blade to the photoreceptor can be increased. By using such a piezoelectric element, a high pressure can be applied to the blade 303 and the photoreceptor 4 when desired. Specifically, when it is desired to clean the surface of the photoreceptor, a predetermined voltage is applied to the piezoelectric element 309. When it is not desired to clean the surface of the photoreceptor, no voltage or a relatively low voltage is applied to the piezoelectric element 309 to contact the blade at a low pressure. By using this method, the degree of abrasion of the surface of the photoreceptor 4 can be decreased, resulting in prolongation of life of the photoreceptor.

In this fourth example, the pressure of the blade 303 can be easily adjusted at a desired time by adjusting the voltage applied to the voltage controller 310. Therefore, for example, it becomes possible to adjust the pressure of the blade by adjusting the voltage applied to the piezoelectric element depending on the amount of residual toner particle on the photoreceptor which is determined by a detector such as optical sensors. For example, when the toner amount is greater than a predetermined amount, the voltage is controlled to increase the pressure of the blade. In contrast, when the toner amount is much smaller than the predetermined amount, the voltage is controlled to decrease the pressure of the blade. By using such a cleaning device, cleaning can be performed at a pressure as low as possible, and it becomes possible to prevent occurrence of bad cleaning problem while prolonging the life of the photoreceptor.

In the first to fourth examples, the cleaner is pressed at a relatively linear pressure of from 80 to 120 g/cm by providing a pressing member, but it is possible to obtain such a high linear pressure by adjusting the shape of the blade or the like method.

Experiment 4

The cleanability of the cleaners of first to fourth examples was evaluated.

Each of the cleaners was set in an image forming apparatus IMAGIO NEO 352 manufactured by Ricoh Co., Ltd. to evaluate the cleanability of the blades. In addition, the evaluation was performed under a low linear pressure condition for comparison. The procedure for evaluation of the blades is the same as that in Experiments 1 to 3.

The cleaning conditions for the blades of first to fourth examples are as follows:

(1) Contact angle (θ): 20°
(2) Amount of deformation (d): 1.0 mm
(3) Linear pressure of blade: 90 gf/cm
(4) Thickness of blade (t1): 2.0 mm
(5) Length of free end portion (t4): 7.0 mm
(6) Repulsion elasticity of blade: 25%
(7) JIS A hardness of blade: 75°

In addition, the cleaning conditions for the blades of comparative examples 1 and 2 are the same as those mentioned above except that the linear pressure is changed to 70 g/cm (comparative example 1) and 125 g/cm (comparative example 2).

The results are shown in Table 4.

TABLE 4

| | Cleanability | | | | |
|---|---|---|---|---|---|
| Cleaner | Start | After 10,000 copies | After 50,000 copies | After 100,000 copies | After 200,000 copies |
| First example | ◎ | ◎ | ◎ | ◎ | ◎ |
| Second example | ◎ | ◎ | ◎ | ◎ | ◎ |
| Third example | ◎ | ◎ | ◎ | ◎ | ◎ |
| Fourth example | ◎ | ◎ | ◎ | ◎ | ◎ |
| Comparative example 1 | Δ | X | X | X | X |
| Comparative example 2 | XX | — | — | — | — |

It is clear from Table 4 that the cleaners of first to fourth examples have a cleanability much better than that of the cleaner of comparative example 1. In addition, the cleaners of first to fourth examples have good durability, and therefore images having good image qualities could be stably produced for a long period of time. The blade of comparative example 2 caused the everted blade problem in that the blade is drawn by the photoreceptor and thereby the image forming apparatus is stopped. This is because the linear pressure is too high. As a result of the present inventors' experiments, it is found that the upper limit of the linear pressure is 120 gf/cm.

Then another embodiment of the image forming apparatus (printer) will be explained.

The printer includes a process cartridge in which at least a photoreceptor and a cleaning device including one of the cleaners of first to fourth examples are integrated and which can be detachably set in an image forming apparatus. The process cartridge may include another device such as charging devices and developing devices.

Figure 31:
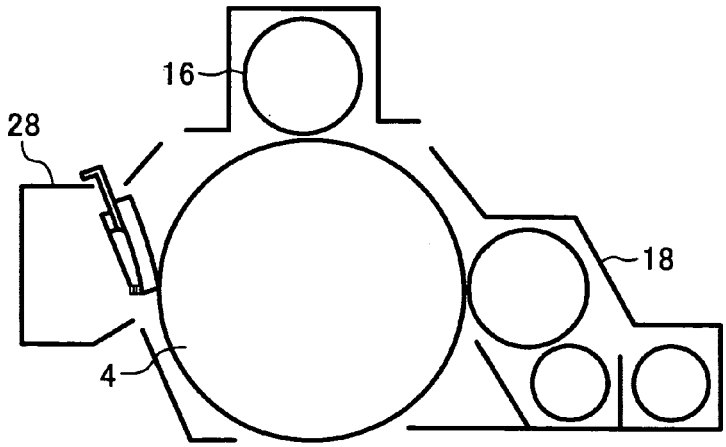
FIGS. 31 to 34 are schematic views illustrating other embodiments of the image forming apparatus of the present invention.

FIG. 31 is a schematic view illustrating another embodiment of the image forming apparatus of the present invention, which includes a process cartridge. The process cartridge includes a photoreceptor 4 serving as an image bearing member, a charger 16 configured to charge the photoreceptor 4, a developing device 18 configured to develop an electrostatic latent image on the photoreceptor 4 and the cleaning device 28. In general, process cartridges have a space for containing a waste toner collected by the cleaning device. However, since a spherical toner, which has a good transfer property, can be used for this printer, the amount of the waste toner is smaller than that in the case where a pulverization toner is used. Therefore, the volume of the space containing the waste toner can be decreased, and thereby the process cartridge can be miniaturized. In addition, conventional process cartridges have a complex structure and therefore it is difficult to replace a process cartridge with new one. However, the process cartridge of the present invention as illustrated in FIG. 31 has a good replacing property. Therefore, the process cartridge is superior in convenience.

Then another embodiment of the image forming apparatus (full color printer) will be explained.

Figure 32:
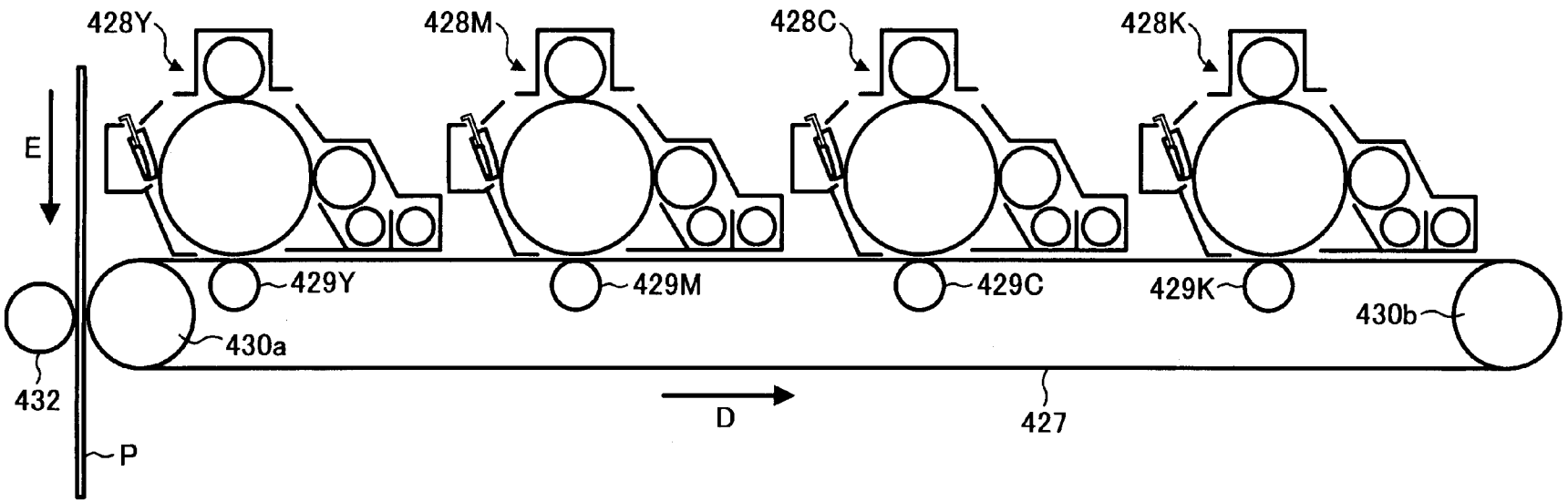

FIG. 32 is a schematic view illustrating the full color printer. The printer has an intermediate transfer medium 427 which is horizontally disposed and which is tightly stretched by plural rollers 430*a* and 430*b*. The intermediate transfer medium 427 is rotated in a direction D. Four process cartridges 428Y, 428M, 428C and 428K, which have the same structure as that illustrated in FIG. 31 and each of which has the cleaning device of the present invention, are arranged side by side along the intermediate transfer medium 427. The process cartridges 428Y, 428M, 428C and 428K use yellow, magenta, cyan and black color toners, respectively. Color toner images are primarily transferred to the intermediate transfer medium by transfer electric fields formed by primary transfer devices 429Y, 429M, 429C and 429K, resulting in formation of a full color toner image in which the yellow, magenta, cyan and black toner images are overlaid on the intermediate transfer medium 427. The full color toner image is fed to the secondary transfer region at which a secondary transfer device 432 faces the intermediate transfer medium 427. The full color toner image is secondarily transferred to a receiving paper P, which is timely fed to the secondary transfer region in a direction E, by a transfer electric field formed by the secondary transfer device 432. The receiving paper P bearing the full color toner image thereon is then fed to a fixing device (not shown) so that the toner image is fixed to the receiving paper. The receiving paper P having a fixed full color toner image is then discharged from the image forming apparatus.

The arrangement order of the process cartridges for yellow, magenta, cyan and black color images is not limited to the order illustrated in FIG. 32, and the process cartridges can be arranged in any order.

Then another embodiment of the image forming apparatus (full color printer) will be explained.

Figure 33:
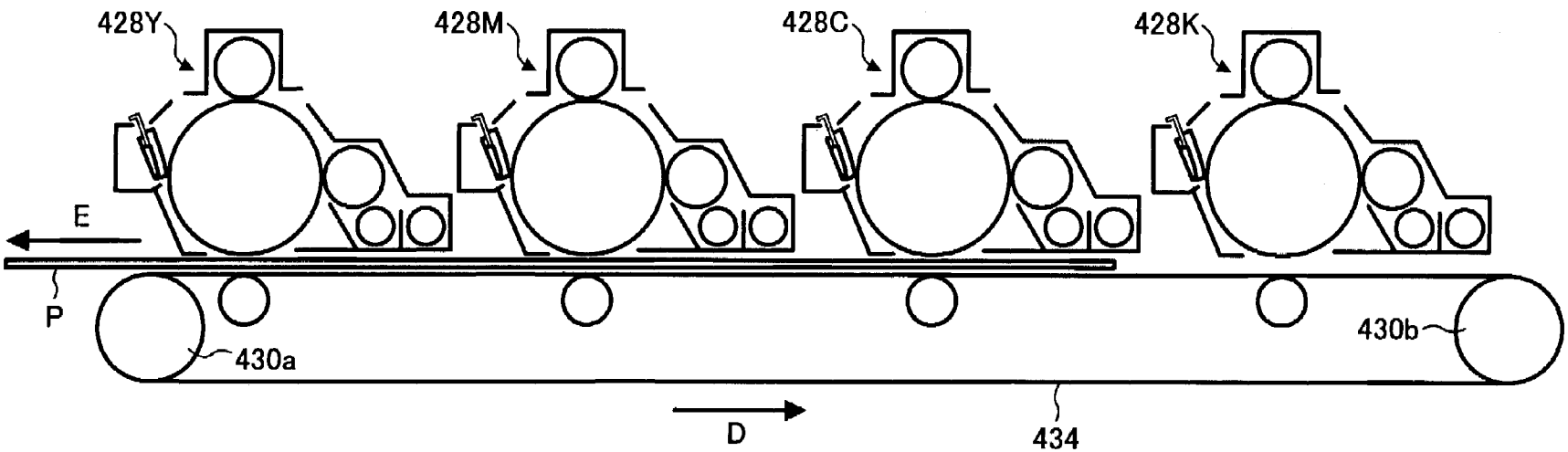

FIG. 33 is a schematic view illustrating the full color printer. The printer also has the four color process cartridges 428Y, 428M, 428C and 428K, each of which has the cleaning device of the present invention. The printer uses a feeding belt 434 instead of an intermediate transfer medium. The feeding belt 434 is rotated by a plurality of rollers 430*a* and 430*b* while tightly stretched to transport a receiving paper P. Color toner images formed on four photoreceptors are sequentially transferred to the receiving paper P so that the color toner images are overlaid, resulting in formation of a full color toner image. As mentioned above, the process cartridges can be arranged in any order.

Then another embodiment of the image forming apparatus (full color printer) will be explained.

Figure 34:
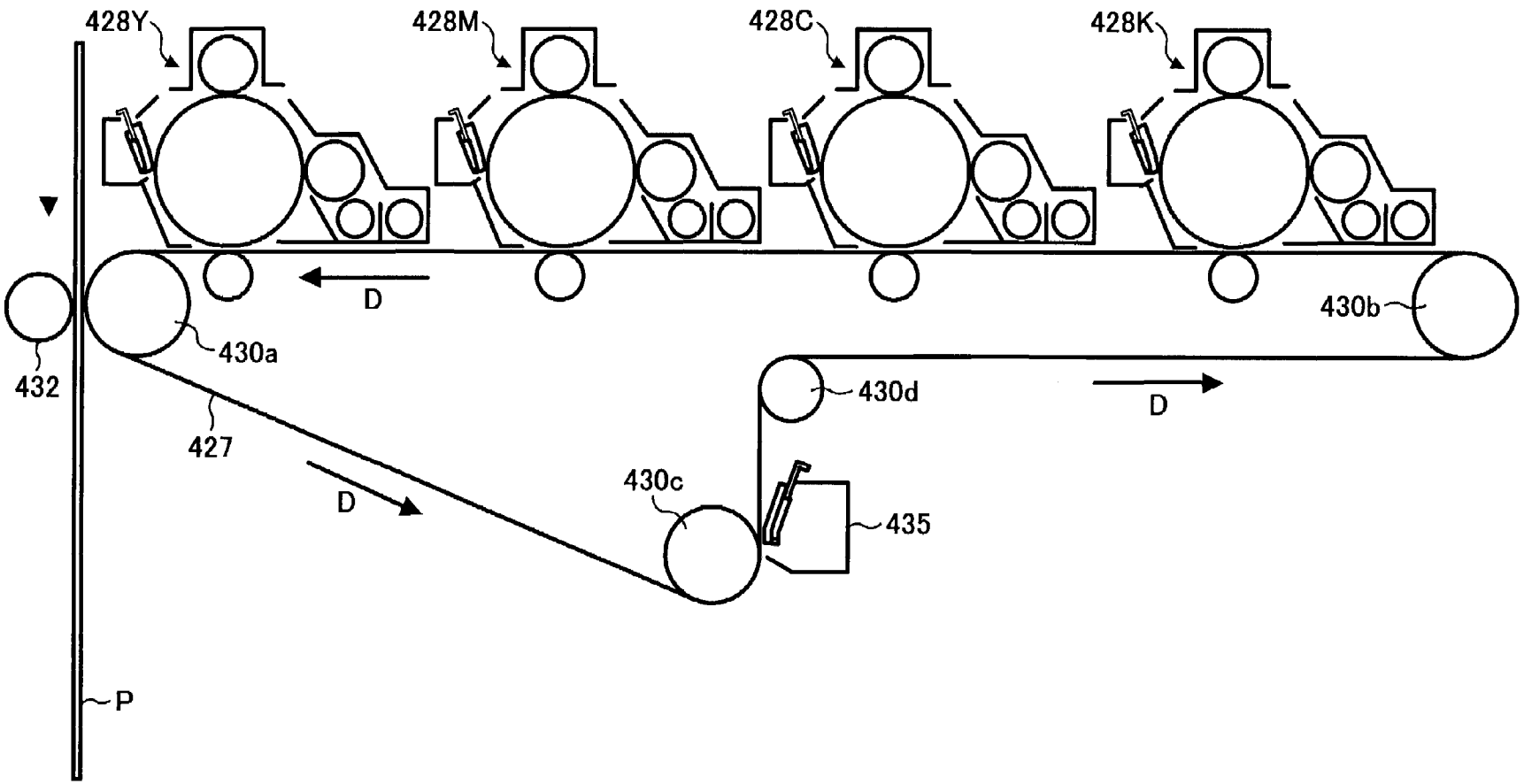

FIG. 34 is a schematic view illustrating the full color printer. The printer has a structure similar to that of the full color printer illustrated in FIG. 32 except that the printer has a belt cleaning device 435 configured to remove toner particles remaining on the surface of the intermediate transfer medium 427 which is tightly stretched by rollers 430*a*, 430*b* and 430*c*. The belt cleaning device 435 has the same structure as that of the cleaning devices of the first to fourth examples. A cleaning blade of the belt cleaning device 435 is configured to contact a surface of the intermediate transfer medium 427 on the roller 430*c*. Since the cleaning device 435 is the cleaning device of the present invention, spherical toner particles remaining on the surface of the intermediate transfer medium can be well removed.

Then the photoreceptor for use in the image forming apparatus of the present invention will be explained.

FIGS. 35 to 38 are schematic cross-sectional views illustrating examples of the photoreceptor for use in the image forming apparatus of the present invention.

Figure 35:
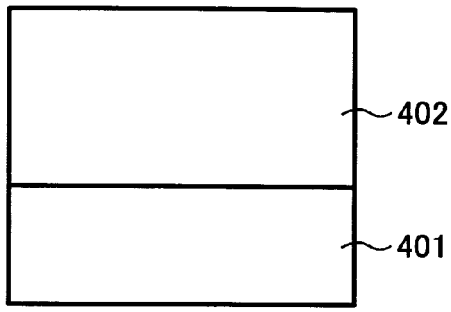
FIGS. 35 to 38 are schematic cross-sectional views illustrating examples of the photoreceptor for use in the image forming apparatus of the present invention.

A photoreceptor illustrated in FIG. 35 has an electroconductive substrate 401, and a single-layered photosensitive layer 402 which is located on the electroconductive substrate 401 and which includes a charge generation material and a charge transport material.

Figure 36:
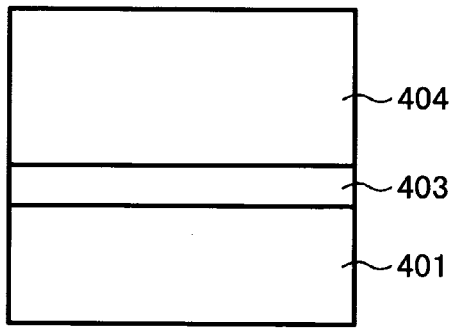

A photoreceptor illustrated in FIG. 36 has an electroconductive substrate 401, and a charge generation layer including a charge generation material and a charge transport layer including a charge transport material, which are located on the electroconductive substrate 401 in this order.

Figure 37:
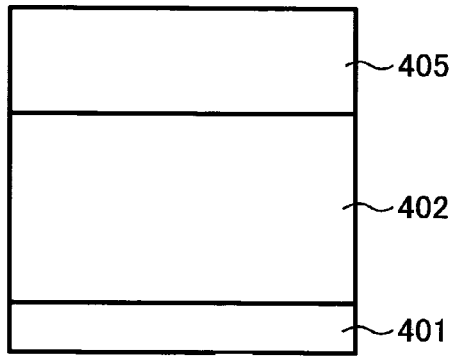

A photoreceptor illustrated in FIG. 37 has an electroconductive substrate 401, the single-layered photosensitive layer 402, and a filler-reinforced charge transport layer 405 which is located on the photosensitive layer 402 and which includes a filler in a surface portion thereof.

Figure 38:
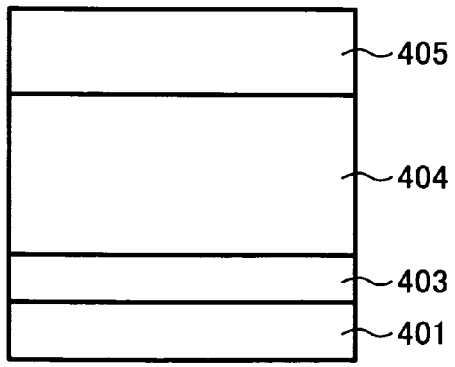

A photoreceptor illustrated in FIG. 38 has an electroconductive substrate 401, the charge generation layer 403, the charge transport layer 404 and the filler-reinforced charge transport layer 405 which is located on the charge transport layer 404.

It is possible that photosensitive layer 402 illustrated in FIG. 35 and the charge transport layer 404 illustrated in FIG. 36 include a filler in a surface portion thereof to improve the mechanical strength.

Suitable materials for use as the electroconductive substrate 401 include materials having a volume resistivity not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is formed by deposition or sputtering. In addition, a plate of a metal such as aluminum, aluminum alloys, nickel and stainless steel can be used. A metal cylinder can also be used as the substrate 401, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like can also be used as the substrate 401.

Furthermore, substrates, in which a coating liquid including a binder resin and an electroconductive powder is coated on the supports mentioned above, can be used as the substrate 401. Specific examples of such an electroconductive powder include carbon black, acetylene black, powders of metals such as aluminum, nickel, iron, nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON), with an electroconductive material, can also be used as the substrate 401.

Next, the photosensitive layer of the photoreceptor of the present invention will be explained.

In the photoreceptor of the present invention, the photosensitive layer 402 may be a mixture type photosensitive layer in which both a charge generation material (CGM) and a charge transport material (CTM) are dispersed, or a multi-layered photosensitive layer having a CGL and a CTL.

At first, the multi-layered photosensitive layer including the charge generation layer (CGL) 403 and the charge transport layer (CTL) 404 will be explained.

The CGL 403 includes a CGM as a main component, and optionally includes a binder resin. For the CGL 403, known CGMs such as inorganic CGMs and organic CGMs can be used. Specific examples of the inorganic CGMs include crystalline selenium, amorphous selenium, selenium-tellurium, selenium-tellurium-halogen, selenium-arsenic compound, amorphous silicon, etc. In addition, amorphous silicon in which a dangling bond is terminated with a hydrogen atom or a halogen atom or in which a boron atom, a phosphorous atom is doped can be preferably used.

Specific examples of the organic CGMs include phthalocyanine pigments such as metal phthalocyanine and metal-free phthalocyanine; azulenium salt type pigments; squaric acid methyne pigments; azo pigments having a carbazole skeleton; azo pigments having a triphenyl amine skeleton; azo pigments having a diphenyl amine skeleton; azo pigments having a dibenzothiophene skeleton; azo pigments having a fluorenone skeleton; azo pigments having an oxadiazole skeleton; azo pigments having a bisstilbene skeleton; azo pigments having a distyryloxadiazole skeleton; azo pigments having a distyrylcarbazole skeleton; perylene pigments; anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoide pigments, benzimidazole pigments, and the like organic pigments.

These CGMs can be used alone or in combination.

Suitable binder resins, which are optionally included in the CGL, include polyamide, polyurethane, epoxy resins, polyketone, polycarbonate, polyarylate, silicone resins, acrylic resins, polyvinyl butyral, polyvinyl formal, polyvinyl ketone, polystyrene, poly-N-vinylcarbazole, polyacrylamide, and the like resins.

These resins can be used alone or in combination.

In addition, charge transport polymers can be used as the binder resin of the CGL. Further, low molecular weight CTMs can be added to the CGL if desired.

The CGL 403 can include a CTM.

CTMs are classified into positive-hole transport materials and electron transport materials. In addition, CTMs can also be classified into low molecular weight CTMs and charge transport polymers.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, and the like.

These electron transport materials can be used alone or in combination.

Specific examples of the positive-hole transport materials include oxazole derivatives, oxadiazole derivatives, imidazole derivatives, triphenyl amine derivatives, 9-(p-diethylaminostyrylanthrathene), 1,1-bis-(4-dibenzylaminophenyl) propane, styryl anthrathene, styryl pyrazoline, phenyl hydrazone, α-phenyl stilbene derivatives, thiazole derivatives, triazole derivatives, phenazine derivatives, acridine derivatives, benzofuran derivatives, benzimidazole derivatives, thiophene derivatives, etc.

The positive-hole transport materials can be used alone or in combination.

The following charge transport polymers can also be used. For example, polymers having a carbazole ring such as poly-N-vinylcarbazole; polymers having a hydrazone skeleton disclosed in, for example, JP-A 57-78402; polysilylene compounds disclosed in, for example, JP-A 63-285552; and polymers having a triaryl amine skeleton disclosed in, for example, 07-325409.

The CGL includes a CGM and a binder resin as main components, but can include additives such as sensitizers, dispersants, surfactants and silicone oils.

Suitable methods for forming the CGL include thin film forming methods in a vacuum, and casting methods.

Specific examples of such thin film forming methods in a vacuum include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods for forming the CGL typically include the following steps:

(1) preparing a coating liquid by mixing one or more inorganic or organic CGMs mentioned above with a solvent such as tetrahydrofuran, cyclohexanone, dioxane, dichloroethane, butanone and the like, optionally together with a binder resin and an additive, and then dispersing the materials with a ball mill, an attritor, a sand mill or the like, to prepare a CGL coating liquid;

(2) coating the CGL coating liquid, which is diluted if necessary, on a substrate by a method such as dip coating, spray coating, bead coating and ring coating; and (3) drying the coated liquid to form a CGL.

The thickness of the CGL is preferably from about 0.01 to about 5 μm, and more preferably from about 0.05 to about 2 μm.

Then the CTL 404 will be explained.

The CTL is typically prepared by preparing a CTL coating liquid in which a mixture of a CTM and a binder resin or a charge transport polymer material is dissolved or dispersed in a solvent, and then coating the coating liquid followed by drying. The thickness of the CTL is preferably from 10 to 100 μm. When high resolution images are produced, the thickness is preferably from 10 to 30 μm.

Specific examples of the polymers for use as the binder resin of the CTL include thermoplastic resins and thermosetting resins such as polystyrene, styrene/acrylonitrile copolymers, styrene/butadiene copolymers, styrene/maleic anhydride copolymers, polyester, polyvinyl chloride, vinyl chloride/vinyl acetate copolymers, polyvinyl acetate, polyvinylidene chloride, polyarylate, polycarbonate, cellulose acetate resins, ethyl cellulose resins, polyvinyl butyral, polyvinyl formal, polyvinyl toluene, acrylic resins, silicone resins, fluorine-containing resins, epoxy resins, melamine resins, urethane resins, phenolic resins and alkyd resins, but are not limited thereto.

These polymer materials can be used alone or in combination. The polymers may be copolymerized with a CTM.

Specific examples of the CTMs for use in the CTL 404 include the low molecular weight electron transport materials, positive hole transport materials and charge transport polymers mentioned above. When a low molecular weight CTM is used, the added amount is from 20 to 200 parts by weight, and preferably from 50 to 100 parts by weight, per 100 parts by weight of the polymer component included in the CTL. When a charge transport polymer is used, polymers in which 100 parts by weight of a charge transport component is copolymerized with a resin component of form 0 to 500 parts by weight are preferably used.

Suitable solvents for use in the CTL coating liquid include ketone such as methyl ethyl ketone, acetone, methyl isobutyl ketone, and cyclohexanone; ethers such as dioxane, tetrahydrofuran, and ethyl cellosolve; aromatic solvents such as toluene, and xylene; halogen-containing solvents such as chlorobenzene, and dichloromethane; esters such as ethyl acetate and butyl acetate; etc. These solvents can be used alone or in combination.

The CTL 404 is formed if the filler-reinforced CTL 405 mentioned below is not formed. The CTL may include a filler in a surface portion thereof.

As the filler for use in the CTL 404, organic fillers and inorganic fillers can be used. Suitable organic fillers include powders of fluorine-containing resins such as polytetrafluoroethylene, silicone resin powders, amorphous carbon powders, etc.

Specific examples of the inorganic fillers include powders of metals such as copper, tin, aluminum and indium; metal oxides such as silica, tin oxide, zinc oxide, titanium oxide, alumina, zirconia, indium oxide, antimony oxide, bismuth oxide, calcium oxide, tin oxide doped with antimony, indium oxide doped with tin; metal fluoride such as tin fluoride, calcium fluoride and aluminum fluoride; potassium titanate, boron nitride, etc. These fillers can be used alone or in combination.

Among these fillers, inorganic fillers are preferably used because of having high hardness and low light scattering property. Among these inorganic fillers, silica, titanium oxide and alumina are preferably used. These fillers can be subjected to a surface treatment so as to be well dispersed in a CTL coating liquid and the resultant CTL.

One or more of these fillers are mixed with a binder resin, a solvent, etc. using a proper dispersion machine to prepare a CTL coating liquid. The average primary particle diameter of the filler in the CTL is preferably from 0.01 to 0.8 μm so that the CTL has good transparency and abrasion resistance.

The filler can be uniformly included in the CTL. However, there is a case where a lighted portion of the CTL which is exposed to imagewise light has a relatively high residual electric potential. In order to avoid such a problem, the concentration of the filler may be changed by gradation such that the concentration in the surface portion is higher than that in the bottom portion of the layer. Alternatively, the CTL may include plural layers such that the concentration of the filler in a layer is heightened by gradation in the upward (surface) direction.

When a filler is included in a surface portion of the CTL, the thickness (i.e., depth) of the portion is preferably not less than 0.5 μm, and more preferably not less than 2 μm.

When a filler-reinforced CTL 405 is formed, the CTL 404 is prepared by coating a coating liquid which is prepared by dissolving or dispersing a mixture including a CTM and a binder resin or a copolymer including a CTM unit and a binder unit in a proper solvent, followed by drying. The thickness of the CTL 404 is preferably from 10 to 100 μm, and from 10 to 30 μm when producing images having high resolution. Specific examples of the materials for use as the binder resin of the CTL 404 include thermoplastic resins and thermosetting resins mentioned above. These polymers can be used alone or in combination. In addition, copolymers including a CTM component and a binder component can also be used.

Specific examples of the CTMs for use in the CTL 404 include the low molecular weight CTMs and the charge transport polymers mentioned above for use in the CGL 403.

The CTL 404 can include additives such as low molecular weight additives (e.g., antioxidants, plasticizers, lubricants and ultraviolet absorbents), and leveling agents. These additives can be used alone or in combination. The added amount of the low molecular weight additives is from 0.1 to 200 parts by weight, and preferably from 0.1 to 30 parts by weight, per 100 parts by weight of the polymer materials included in the CTL 404. The added amount of the leveling agents is from 0.001 to 5 parts by weight per 100 parts by weight of the polymer materials.

Then the filler-reinforced CTL 405 will be explained.

The filler-reinforced CTL (FR-CTL) 405 includes at least a CTM, a binder resin and an inorganic filler. The FR-CTL 405 has a functional layer having a combination of good charge transport ability and good mechanical durability. The FR-CTL 405 has a high charge mobility which is almost the same as that of conventional CTLs, and therefore the FR-CTL 405 is different from a conventional protective layer.

The FR-CTL 405 is used as an outermost layer of a layered photoreceptors including a functionally-separated CTL having plural layers. Namely the FR-CTL 405 is used in combination with the CTL 404 including no inorganic filler, i.e., the FR-CTL 405 is not used alone. Therefore the FR-CTL 405 is distinguished from single CTLs in which an inorganic filler is dispersed as an additive.

As the filler for use in the FR-CTL 405, the inorganic fillers mentioned above for use in the CTL 404 can also be used. In particular, silica, titanium oxide and alumina are preferably used alone or in combination.

Similarly to the above-mentioned CTL 404, the inorganic fillers may be treated with a surface treatment agent to improve the dispersibility thereof.

A coating liquid for the FR-CTL 405 can be prepared by mixing an inorganic filler, a binder resin, a low molecular weight CTM and a solvent, and then dispersing them using a proper dispersion machine. The average primary particle diameter of the filler in the FR-CTL 405 is preferably from 0.01 to 0.8 μm because the resultant FR-CTL 405 has good transparency and good abrasion resistance. Suitable coating methods include dip coating methods, spray coating method, ring coating methods, roll coating methods, gravure coating methods, nozzle coating methods, screen coating methods, etc.

The thickness of the FR-CTL 405 is preferably not less than 0.5 μm, and more preferably not less than 2 μm.

Next, the single-layered photosensitive layer 402 will be explained.

The single-layered photosensitive layer 402 can be typically formed by the following method:

(1) constituents such as a CGM, a CTM and a binder resin are dissolved or dispersed in a proper solvent to prepare a coating liquid; and (2) the coating liquid is coated and dried to form the photosensitive layer 402.

The coating liquid can include additives such as plasticizers, leveling agents and antioxidants.

Specific examples of the binder resin include the resins mentioned above for use in the CTL 404, and the resins mentioned above for use in the CGL 403 which are used in combination with the resins mentioned above for use in the CTL 404. In addition, the above-mentioned charge transport polymers can also be used.

The added amount of the CGM is preferably from 5 to 40 parts by weight per 100 parts by weight of the binder resins included in the photosensitive layer 402. The added amount of the CTM is preferably from 0 to 190 parts by weight, and more preferably from 50 to 150 parts by weight, per 100 parts by weight of the binder resins included in the photosensitive layer 402.

The photosensitive layer 402 is typically prepared by the following method:

(1) a CGM, a CTM and a binder resin are dissolved or dispersed in a solvent such as tetrahydrofuran, dioxane, dichloroethane and cyclohexane, to prepare a coating liquid; and (2) the coating liquid is coated by a method such as dip coating methods, spray coating methods and bead coating methods, and dried to form the photosensitive layer 402.

The thickness of the single-layered photosensitive layer 402 is preferably from 5 to 25 μm.

When the photosensitive layer 402 is an outermost layer, the photosensitive layer 402 can include a filler in a surface portion thereof. In this case, the filler can be uniformly included in the layer 402. However, similar to the case of the CTL 404, the concentration of the filler may be changed by gradation such that the concentration in the surface portion is higher than that in the bottom portion of the layer. Alternatively, the photosensitive layer 402 may include plural layers such that the concentration of the filler in a layer is heightened by gradation in the upward (surface) direction.

The photoreceptor for use in the image forming apparatus of the present invention may include an undercoat layer which is formed between the electroconductive substrate 401 and the photosensitive layer 402 or the CGL 403. The undercoat layer is formed, for example, to improve adhesion of the photosensitive layer to the substrate 401, to prevent formation of moiré in the resultant image, to improve the coating quality of the upper layer, to decrease residual potential in the resultant photoreceptor, and/or to prevent charge injection from the substrate 401 to the photosensitive layer.

The undercoat layer mainly includes a resin. Since a photosensitive layer coating liquid, which typically includes an organic solvent, is coated on the undercoat layer, the resin used in the undercoat layer preferably has good resistance to popular organic solvents.

Specific examples of such resins for use in the undercoat layer include water-soluble resins such as polyvinyl alcohol, casein and sodium polyacrylate; alcohol-soluble resins such as nylon copolymers, and methoxymethylated nylons; and crosslinkable resins such as polyurethane resins, melamine resins, alkyd-melamine resins, and epoxy resins.

In addition, the undercoat layer may include a fine powder such as metal oxides (e.g., titanium oxide, silica, alumina, zirconium oxide, tin oxide, and indium oxide). The undercoat layer is typically formed using these materials, a proper solvent, and a proper coating method similarly to the photosensitive layer.

In addition, a metal oxide layer which is formed, for example, by a sol-gel method using a silane coupling agent, titanium coupling agent or a chromium coupling agent can also be used as the undercoat layer.

Further, a layer of aluminum oxide which is formed by an anodic oxidation method, and a layer of an organic compound such as polyparaxylylene or an inorganic compound such as SiO, $SnO_2$, $TiO_2$, ITO or $CeO_2$, which is formed by a vacuum evaporation method, are also preferably used as the undercoat layer.

The thickness of the undercoat layer is preferably from 0 to 20 μm and more preferably from 1 to 10 μm.

Each of the layers mentioned above may include an additive such as antioxidants, plasticizers, lubricants, ultraviolet absorbents, low molecular weights CTMs and leveling agents.

Specific examples of the antioxidants include the following.

(a) Phenolic Compounds 2,6-di-t-butyl-p-cresol, 2,4,6-tri-t-butylphenol, n-octadecyl-3-(4'-hydroxy-3',5'-di-t-butylphenol)propionate, styrenated phenol, 4-hydroxymethyl-2,6-di-t-butylphenol, 2,5-di-t-butylhydroquinone, cyclohexyl phenol, butylhydroxyanisole, 2,2'-methylene-bis-(4-ethyl-6-t-butylphenol), 4,4'-isopropylidenebisphenol, 1,1-bis(4-hydroxyphenyl)cyclohexane, 4,4'-methylene-bis(2,6-di-t-butylphenol), 2,6-bis(2'-hydroxy-3'-t-butyl-5'-methylbenzyl)-4-methylphenol, 1,1,3-tris-(2-methyl-4-hydroxy-5-t-butylphenyl)butane, 1,3,5-trismethyl-2,4,6-tris(3,5-di-t-butyl-4-hydroxybenzyl)benzene, tetrakis-[methylene-3-(3',5'-di-t-butyl-4-hydroxyphenyl)propionate]methane, tris(3,5-di-t-butyl-4-hydroxyphenyl)isocyanate, tris [β-(3,5-di-t-butyl-4-hydroxyphenyl)propionyl-oxyethyl]isocyanate, 4,4'-thiobis(4-methyl-6-t-butylphenol), 4,4'-thiobis(4-methyl-6-t-butylphenol,) etc.

(b) Amine Compounds phenyl-α-naphthylamine, phenyl-β-naphthylamine, N,N'-diphenyl-p-phenylenediamine, N,N'-di-β-naphthyl-p-phenylenediamine, N-cyclohexyl-N'-phenyl-p-phenylenediamine, N-phenylene-N'-isopropyl-p-phenylenediamine, aldol-α-naphthylamine, 6-ethoxy-2,2,4-trimethyl-1,2-dihydroquinoline, etc.

(c) Sulfur-Containing Compounds thiobis(β-naphthol), thiobis(N-phenyl-β-naphthylamine), 2-mercaptobenzothiazole, 2-mercaptobenzimidazole, dodecylmercaptan, tetramethylthirammonosulfide, tetramethylthiramdisulfide, nickeldibutylthiocarbamate, isopropylxanthate, dilaurylthiodipropionate, distearylthiodipropionate, etc.

(d) Phosphorus-Containing Compounds triphenyl phosphite, diphenyldecyl phosphite, phenyl isodecyl phosphite, tri(nonylphenyl)phosphite, 4,4'-butylidene-bis(3-methyl-6-t-butylphenyl-ditridecylphosphite), distearyl-pentaerythritol diphosphite, trilauryl trithiophosphite, etc.

Suitable plasticizers for use in the layers of the photoreceptor include the following compounds but are not limited thereto:

(a) Phosphoric Acid Esters triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic Acid Esters dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonyl phthalate, diisononyl phthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic Carboxylic Acid Esters trioctyl trimellitate, tri-n-octyl trimellitate, octyl oxybenzoate, and the like.

(d) Dibasic Fatty Acid Esters dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty Acid Ester Derivatives butyl oleate, glycerin monooleate, methyl acetylricinolate, pentaerythritol esters, dipentaerythritol hexaesters, triacetin, tributyrin, and the like.

(f) Oxyacid Esters methyl acetylricinolate, butyl acetylricinolate, butylphthalylbutyl glycolate, tributyl acetylcitrate, and the like.

(g) Epoxy Compounds epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric Alcohol Esters diethylene glycol dibenzoate, triethylene glycol di-2-ethylbutyrate, and the like.

(i) Chlorine-Containing Compounds chlorinated paraffin, chlorinated diphenyl, methyl esters of chlorinated fatty acids, methyl esters of methoxychlorinated fatty acids, and the like.

(j) Polyester Compounds polypropylene adipate, polypropylene sebacate, acetylated polyesters, and the like.

(k) Sulfonic Acid Derivatives p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric Acid Derivatives triethyl citrate, triethyl acetylcitrate, tributyl citrate, tributyl acetylcitrate, tri-2-ethylhexyl acetylcitrate, n-octyldecyl acetylcitrate, and the like.

(m) Other Compounds terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbons liquid paraffins, paraffin waxes, micro waxes, low molecular weight polyethylenes, and the like.

(b) Fatty Acids lauric acid, myristic acid, palmitic acid, stearic acid, arachidic acid, behenic acid, and the like.

(c) Fatty Acid Amides

Stearic acid amide, palmitic acid amide, oleic acid amide, methylenebisstearamide, ethylenebisstearamide, and the like.

(d) Ester Compounds lower alcohol esters of fatty acids, polyhydric alcohol esters of fatty acids, polyglycol esters of fatty acids, and the like.

(e) Alcohols cetyl alcohol, stearyl alcohol, ethylene glycol, polyethylene glycol, polyglycerol, and the like.

(f) Metallic Soaps lead stearate, cadmium stearate, barium stearate, calcium stearate, zinc stearate, magnesium stearate, and the like.

(g) Natural Waxes

Carnauba wax, candelilla wax, beeswax, spermaceti, insect wax, montan wax, and the like.

(h) Other Compounds silicone compounds, fluorine compounds, and the like.

Suitable ultraviolet absorbing agents for use in the layers of the photoreceptor include the following compounds but are not limited thereto.

(a) Benzophenone Compounds 2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate Compounds phenyl salicylate, 2,4-di-t-butylphenyl-3,5-di-t-butyl-4-hydroxybenzoate, and the like.

(c) Benzotriazole Compounds (2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano Acrylate Compounds ethyl-2-cyano-3,3-diphenyl acrylate, methyl-2-carbomethoxy-3-(paramethoxy) acrylate, and the like.

(e) Quenchers (Metal Complexes)

nickel(2,2'-thiobis(4-t-octyl)phenolate)-n-butylamine, nickeldibutyldithiocarbamate, cobaltdicyclohexyldithiophosphate, and the like.

(f) HALS (Hindered Amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-but yl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Then an example of preparing a photoreceptor will be explained, but the preparation method is not limited thereto.

Formation of Undercoat Layer

The following components were mixed to prepare an undercoat layer coating liquid.

| | |
|---|---|
| Alkyd resin solution (BEKKOZOL 1307-60-EL, manufactured by Dainippon Ink and Chemicals Inc.) | 6 parts |
| Melamine resin (SUPER BEKKAMINE G-821-60, manufactured by Dainippon Ink and Chemicals Inc.) | 4 parts |
| Titanium oxide (CR-EL manufactured by Ishihara Sangyo Kaisha Ltd.) | 40 parts |
| Methyl ethyl ketone | 200 parts |

The undercoat layer coating liquid was coated on an aluminum drum having a diameter of 30 mm and then dried. Thus, an undercoat layer having a thickness of 3.5 μm was prepared.

Formation of CGL

The following components were mixed to prepare a CGL coating liquid.

| | |
|---|---|
| Oxotitanium phthalocyanine pigment | 2 parts |
| Polyvinyl butyral resin (XYHL, manufactured by Union Carbide Corp.) | 0.2 parts |
| Tetrahydrofuran | 50 parts |

The CGL coating liquid was coated on the undercoat layer and then dired to prepare a CGL having a thickness of 0.2 μ.

Formation of CTL including no inorganic filler

The following components were mixed to prepare a first CTL coating liquid.

| | |
|---|---|
| Z-form polycarbonate (viscosity average molecular weight of 50,000 manufactured by Teijin Chemicals Ltd.) | 12 parts |
| CTM having the following formula (A) | 10 parts |

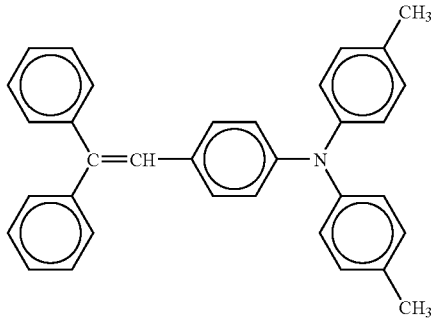

(A)

| | |
|---|---|
| Tetrahydrofuran | 100 parts |
| 1% tetrahydrofuran solution of silicone oil (silicone oil: KF50-100CS from Shin-Etsu Chemical Co., Ltd.) | 1 part |

The first CTL coating liquid was coated on the CGL and then dried to prepare a first CTL including no inorganic filler and having a thickness of 28 μm.

Formation of FR-CTL

The following components were mixed and dispersed for 2 hours using a paint shaker including zirconia beads to prepare a FR-CTL coating liquid including an inorganic filler.

| | |
|---|---|
| Z-form polycarbonate (viscosity average molecular weight of 50,000 manufactured by Teijin Chemicals Ltd.) | 4 parts |
| CTM having formula (A) | 3 parts |
| α-alumina (SUMICORUNDUM AA-03 from Sumitomo Chemical Co., Ltd.) | 0.7 parts |
| Cyclohexanone | 280 parts |
| Tetrahydrofuran | 80 parts |

The FR-CTL coating liquid was coated on the first CTL by a spray coating method and then dried to prepare a FR-CTL having a thickness of 1.5 μm.

Thus a photoreceptor was prepared.

The photoreceptor can have a protective layer as an outermost layer. Specific examples thereof include a protective layer which is prepared by forming an amorphous silicon layer on the surface of a photoreceptor, and a protective layer which includes a filler such as alumina and tin oxides and which is formed on a charge transport layer.

Alternatively, a protective layer having a crosslinked structure can also be used. Such a crosslinked structure can be obtained by using a reactive monomer having plural crosslinking functional groups in a molecule which is crosslinked upon application of heat and light beams thereto. The crosslinked protective layer has a high abrasion resistance.

In view of electric stability, durability and life of the resultant protective layer (i.e., the resultant photoreceptor), it is preferable to use a reactive monomer having a charge transport function in a portion or the entire portion thereof. By using such a monomer, the resultant protective layer has a good combination of charge transport ability and durability.

Suitable reactive monomers for use in the protective layer are as follows:

(1) compounds having a charge transport component and a silicon atom having a hydrolyzable substituent in a molecule;
(2) compounds having a charge transport component and a hydroxyl group in a molecule;
(3) compounds having a charge transport component and a carboxyl group in a molecule;
(4) compounds having a charge transport component and an epoxy group in a molecule; and
(5) compounds having a charge transport component and an isocyanate group in a molecule.

These compounds can be used alone or in combination.

More preferably, reactive monomers having a triarylamine structure are preferably used as a monomer having a charge transport ability because the resultant polymers have good electric and chemical stability and high carrier mobility. In addition, known monofunctional or difunctional monomers or oligomers can be used in combination with the reactive monomers, to adjust the viscosity of the coating liquid, to relax the stress applied to the crosslinked CTL, and to impart low surface energy and low friction coefficient to the resultant layer.

When crosslinking reaction is performed by heat, a thermal polymerization reaction initiator is preferably used to efficiently perform the crosslinking reaction at a relatively low temperature.

When crosslinking reaction is performed by light, a photopolymeriztion reaction initiator is preferably used. Suitable materials for use as the photopolymerization reaction initiator include materials which absorb ultraviolet light with a wavelength not greater than 400 nm to generate a radical or an ion. Such a photopolymeriztion reaction initiator can be used in combination with the thermal polymerization reaction initiators mentioned above.

Such a crosslinked protective layer has good abrasion resistance but often has cracks due to volume decrease of the layer in the crosslinking reaction if the layer is thick. In order to prevent occurrence of such a problem, a multi-layered protective layer having a lower layer including a low molecular weight polymer in which a filler is dispersed and an upper layer having a crosslinked structure can be formed.

One example of the protective layer is as follows.

The following components were mixed to prepare a protective layer coating liquid.

| | |
|---|---|
| Methyltrimethoxysilane | 182 parts |
| Dihydroxymethyltriphenylamine | 40 parts |
| 2-propanol | 225 parts |
| 2% acetic acid | 106 parts |
| aluminum trisacetylacetonate | 1 part |

The coating liquid was formed on a CTL, and dried. Then the resultant layer was subjected to a heat crosslinking treatment at 110° C. for 1 hour. Thus, a crosslinked protective layer having a thickness of 3 μm was prepared.

Another example of the protective layer is as follows.

The following components were mixed to prepare a protective layer coating liquid.

Positive hole transport material having the following formula — 30 parts

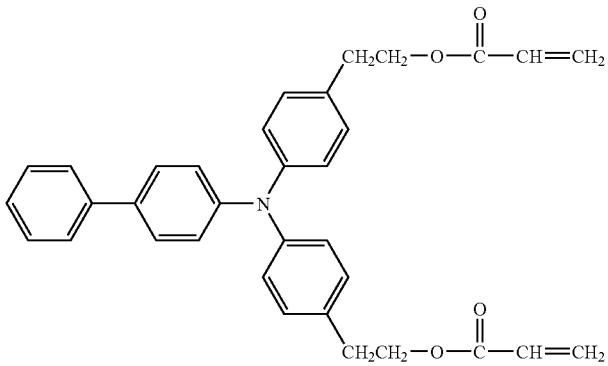

Acrylic monomer having the following formula — 30 parts

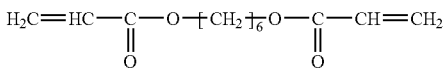

| | |
|---|---|
| 1-hydroxy-cyclohexyl-phenyl-ketone (photopolymerization reaction initiator) | 0.6 parts |
| Monochlorobenzene | 50 parts |
| Dichloromethane | 50 parts |

The coating liquid was coated on a CTL by a spray coating method. Then the coated layer was exposed to light emitted by a metal halide lamp having an intensity of 500 mW/cm$^2$ for 30 seconds to be crosslinked. Thus, a crosslinked protective layer having a thickness of 5 μm was prepared.

Then the fifth embodiment of the cleaner will be explained.

As mentioned above, the cause for the bad cleaning problem is the stick-slip movement (i.e., micro vibration) of the tip of the blade used for removing toner particles.

Whether or not the stick-slip movement is caused depends on the friction force (Fbp) generated between the photoreceptor 4 and cleaning blade 3 and the restoring force (Fbr) of the elastic cleaning blade 3.

Specifically, when Fbp is larger than Fbr (i.e., Fbp>Fbr), the tip portion of the cleaning blade is moved along the surface of the photoreceptor 4 in a direction (A) illustrated in FIG. 22 (i.e., the blade is stuck). In contrast, when Fbp<Fbr, the tip of the cleaning blade is moved in the opposite direction (i.e., the blade slips). As a result of the present inventors' experiments, it was found that when the blade slips, toner particles pass through the nip between the blade and the surface of the photoreceptor.

It was also found that when a toner prepared by a kneading/pulverization method is removed from a surface of a photoreceptor, the stick-slip movement occurs with low frequency. Therefore, even when a spherical toner is used, a good cleaning operation can be realized by preventing occurrence of the stick-slip movement. Specifically, by decreasing the frequency of occurrence of the stick-slip movement and in addition by decreasing the moving distance of the tip of the blade in a stick-slip movement, the toner passing problem in that toner particles pass through the nip between the blade and the photoreceptor can be avoided. However, when a blade made of an elastic material such as urethane rubbers is contacted with the photoreceptor drum 4, occurrence of the stick-slip movement cannot be prevented. The present inventors discover a cleaner, which can well remove spherical toner particles from the surface of a photoreceptor even when the blade causes a stick-slip movement.

Figure 39A:
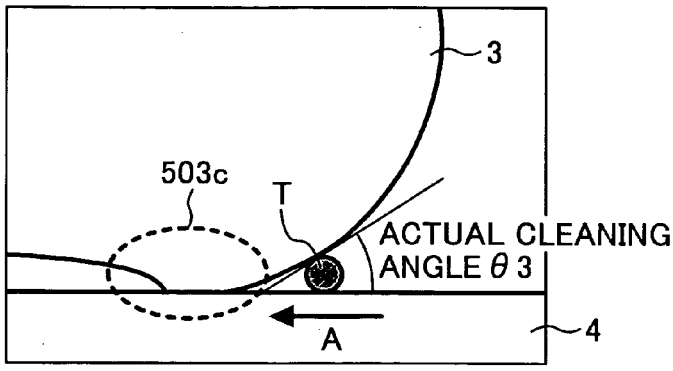
FIGS. 39A-39C are schematic enlarged views illustrating the portion of the blade contacted with the photoreceptor.

In order to examine the stick-slip movement, the tip edge of the blade which contacts the surface of the photoreceptor 4 is carefully observed using a lens with a high power magnification. The result of the observation is as follows. As illustrated in FIG. 39A, the edge of a blade 3 forms an everted portion 503*c* due to contact with the surface of the photoreceptor 4. The load applied to the blade 3 is concentrated to the everted portion 503*c*. Thus the blade 3 achieves a stick state due to the friction force formed between the photoreceptor 4 and the edge of the blade 3, and moves in a rotation direction A of the photoreceptor 4. When the restoring force of the blade 3 becomes larger than the friction force, the blade 3 achieves a slip state, and moves in the direction opposite to the direction A. Thus the edge of the blade 3 makes the stick-slip movement, i.e., a back and forth movement.

In this regard, an angle θ3 (i.e., an actual cleaning angle) formed by the blade and the surface of the photoreceptor 4 also changes. Specifically, when the blade achieves a stick state (i.e., when the edge is drawn by the photoreceptor 4 in the direction A), the angle θ3 decreases. When the blade 3 achieves a slip state, the angle is relatively large compared to the angle in the stick state. Therefore, when the smaller the amplitude of the stick-slip movement of the blade, the smaller the variation (dθ) of the angle θ3. The present inventors consider that the smaller the variation (dθ), the better the cleaning stability.

$$\text{Cleaning Stability} \propto (1/d\theta)$$

In this regard, the actual cleaning angle θ3 and variation (dθ) are defined as follows. The cleaning angle is determined from the picture illustrating the contact portion. Specifically, as illustrated in FIG. 39A, the cleaning angle is defined as an angle formed by the tangent line at a contact point in which the blade contacts a spherical toner particle having a particle diameter of 7 μm and the tangent line at a contact point in which the photoreceptor contacts the spherical toner particle. More specifically, a circle having a diameter of 7 μm is depicted in the photograph of the edge portion of the blade to determine the contact points and then the tangent lines are drawn at the contact points. Then the angle (i.e., the cleaning angle) formed by the two tangent lines is measured.

Figure 39B:
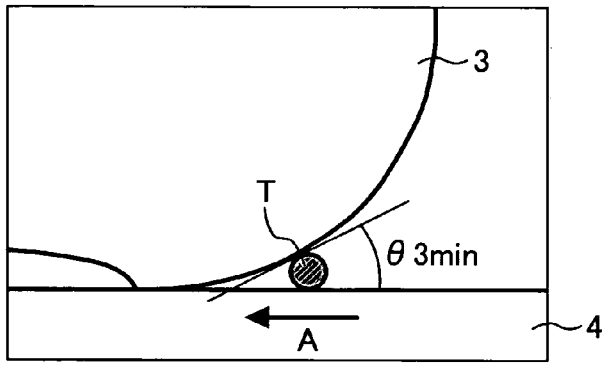
Figure 39C:
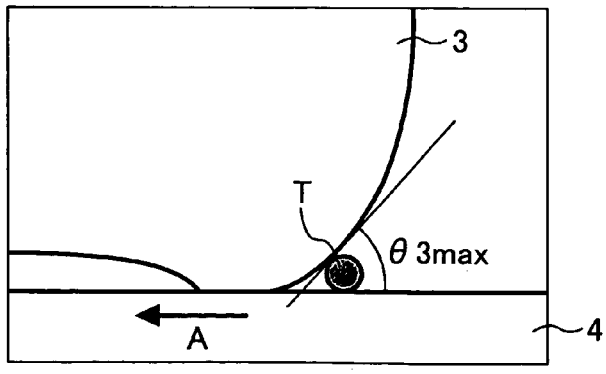

The variation (dθ) is defined as the difference between the maximum (θ3 max) and the minimum (θ3 min) of the actual cleaning angle θ3, which are illustrated in FIGS. 39B and 39C.

$$\text{Variation}(d\theta) = \theta 3\text{max} - \theta 3\text{min}$$

When a spherical toner is removed, the toner does not stay at the nip portion of the edge of the blade and the photoreceptor and therefore the friction force hardly acts on the edge of the blade. Therefore, the stick-slip movement is seriously performed. At least the cleaning blade 3, the photoreceptor 4 and the toner T complexly influence the stick-slip movement.

The present inventors further perform several experiments while attracting attention to the repulsion elasticity and hardness of the blade to develop a cleaning blade which does not cause the stick-slip movement. Specifically, as the repulsion elasticity of the blade increases, the stick-slip movement is seriously made. As the hardness of the blade increases, the deformation of the blade is decreased, and thereby the stick-slip movement is hardly caused.

Experiment 5

This experiment was performed to check the relationship between the physical properties of the blade and the stick-slip movement of the blade.

The present inventors made an experiment in which the cleaning blade illustrated in FIG. 4 is contacted with a surface of a rotating transparent cylinder having the same friction coefficient as that of a photoreceptor drum to carefully observe the contact portion of the blade and the cylinder. Specifically, the contact portion of the blade and the transparent cylinder on which toner particles are present was observed to evaluate the cleanability of the blade and to understand the relationship between the repulsion elasticity and hardness of the blade and the variation (dθ) of the actual cleaning angle. The experimental conditions are as follows.

(1) Deformation amount: 1.0 mm (2) Friction coefficient (μ) of rotating cylinder: 0.3 to 0.6 (measured by an Euler belt method)

(3) Moving speed of surface of cylinder: 100 mm/sec (4) Contact angle β: 20°

(5) Thickness of blade (t1): 2.0 mm (6) Length of free end portion (t4): 7.0 mm The results are shown in Table 5.

TABLE 5

| Blade | REC* (%) | Hardness (°) | θ 3 | θ 3 min | θ 3 max | d θ | Cleanability |
|---|---|---|---|---|---|---|---|
| No. 13 | 8 | 70 | 44 | 38 | 52 | 14 | Δ |
| No. 14 | 47 | 72 | 46 | 23 | 47 | 29 | X |
| No. 15 | 11 | 81 | 50 | 47 | 57 | 10 | ○ |
| No. 16 | 50 | 78 | 48 | 23 | 53 | 30 | X |
| No. 17 | 63 | 70 | 43 | 35 | 66 | 31 | X |
| No. 18 | 17 | 71 | 44 | 33 | 52 | 19 | Δ |
| No. 19 | 18 | 80 | 51 | 42 | 58 | 16 | ○ |
| No. 20 | 23 | 72 | 45 | 38 | 51 | 18 | Δ |
| No. 21 | 24 | 79 | 49 | 44 | 66 | 20 | ○ |
| No. 22 | 30 | 81 | 46 | 45 | 66 | 21 | ○ |
| No. 23 | 35 | 79 | 41 | 39 | 62 | 23 | X |
| No. 24 | 45 | 83 | 38 | 32 | 61 | 29 | X |

REC*: repulsion elastic coefficient

The cleanability is classified into the following four grades:

○: Spherical toner particles are perfectly removed from the surface of the cylinder.

Δ: There remain streak-like toner particles on a portion of the cylinder or a slight amount of spherical toner particles on the entire surface of the cylinder.

X: There remain streak-like spherical toner particles or a large amount of on the entire surface of the photoreceptor.

It is clear from Table 5 that the blades Nos. 15, 19, 21 and 22, which have a hardness of about 80° and a repulsion elastic coefficient not greater than 30%, have a variation (dθ) not greater than 20° (i.e., the stick-slip movement has a low amplitude), and therefore the blades have good cleanability. In contrast, the blades having a repulsion elastic coefficient not less than about 35% have a large variation (dθ), and therefore the blades have poor cleanability. Thus, blades having a low repulsion elastic coefficient have good cleanability.

In addition, it is clear from Table 5 that in general, the smaller variation (dθ) a blade has, the better spherical toner cleanability the blade has. However, the blades Nos. 13, 18 and 20 have a variation not greater than 20° but the blades have a poor cleanability. In order to clear the reason therefor, the present inventors made another experiment in which the cleanability of the blades Nos. 13-24 is evaluated under conditions of 20° in contact angle, and 1.0 mm and 0.7 mm in deformation amount (d) while measuring the linear pressure of the blades. The results are shown in Table 6.

TABLE 6

| Blade | REC (%) | Hardness | Linear Pressure (d = 1.0 mm) | Cleanability | Linear Pressure (d = 0.7 mm) | Cleanability |
|---|---|---|---|---|---|---|
| No. 13 | 8 | 70 | 0.49 | Δ | 0.3234 | X |
| No. 14 | 47 | 72 | 0.7056 | X | 0.5292 | X |
| No. 15 | 11 | 81 | 0.7938 | ○ | 0.5096 | X |
| No. 16 | 50 | 78 | 0.9604 | X | 0.784 | X |
| No. 17 | 63 | 70 | 0.5194 | X | 0.3332 | X |
| No. 18 | 17 | 71 | 0.6762 | Δ | 0.392 | X |
| No. 19 | 18 | 80 | 0.833 | ○ | 0.4802 | X |
| No. 20 | 23 | 72 | 0.7154 | Δ | 0.5488 | X |
| No. 21 | 24 | 79 | 0.7742 | ○ | 0.588 | X |
| No. 22 | 30 | 81 | 0.8036 | ○ | 0.5096 | X |
| No. 23 | 35 | 79 | 0.8134 | X | 0.5096 | X |
| No. 24 | 45 | 83 | 0.784 | X | 0.4802 | X |

By comparing the data of the blades Nos. 13 and 15, the blades Nos. 10-18 and 19, and the blades Nos. 20 and 21, which have similar repulsion elastic coefficients but have different cleanability, the following is found.

The blade No. 13 has a linear pressure of 0.49 N/cm (50 gf/cm) whereas the blade No. 15 has a linear pressure of 0.7938 N/cm (81 gf/cm). The blade No. 18 has a linear pressure of 0.6762 N/cm (69 gf/cm) whereas the blade No. 19 has a linear pressure of 0.833 N/cm (85 gf/cm). The blade No. 20 has a linear pressure of 0.7154 N/cm (73 gf/cm) whereas the blade No. 21 has a linear pressure of 0.784 N/cm (80 gf/cm). Thus, as the hardness of the blades decreases, the linear pressure decreases.

Even when a blade has a stable nip, spherical toner particles tend to invade the nip if the linear pressure of the blade is low. Therefore, it is necessary to increase the linear pressure of the blade to prevent spherical toner particles from invading the nip. Since spherical toner particles can invade into the nip relatively easily compared to toner particles prepared by a pulverization method, a relatively high linear pressure has to be applied to the nip.

The blade No. 16 has a hardness of 78° and a linear pressure of 0.9601 N/cm (98 gf/cm), which is sufficient to prevent spherical toner particles from invading the nip. However, since the blade has a high repulsion elastic coefficient of 50%, the blade makes the stick-slip movement, and thereby spherical toner particles cannot be well removed. The blade No. 23 has a linear pressure of 0.7938 N/cm (81 gf/cm) which is sufficient to prevent spherical toner particles from invading the nip. However, since the blade has a high repulsion elastic coefficient of 35%, the blade makes the stick-slip movement, and thereby spherical toner particles cannot be well removed.

The blades Nos. 15 and 19 have good cleanability under a condition not greater than 20% in repulsion elastic coefficient and 1.0 mm in deformation amount. However, the blades have poor cleanability when the deformation amount is 0.7 mm. The reason therefor is considered to be that since the deformation amount decreases, the linear pressure decreases to 0.784 N/cm (80 gf/cm) or less and thereby invasion of spherical toner particles cannot be prevented.

Therefore, the conclusion of the experiment is that in order to remove spherical toner particles from a surface of a material having a friction coefficient of from 0.3 to 0.6, the following conditions are preferable.

Repulsion elastic coefficient of blade: 8.0 to 30% (at 23° C.)

Hardness: 70 to 90°

Linear pressure: not less than 0.784 N/cm (80 gf/cm)

Then the shape of the cleaning blade is studied.

Figure 40:
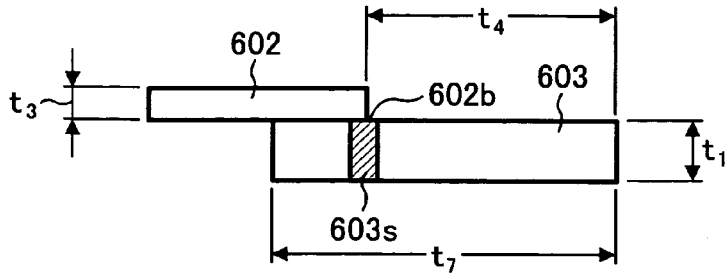
FIG. 40 illustrates a cleaner having a conventional structure such that a metal support is connected with a strip cleaning blade.

FIG. 40 illustrates a cleaner having a conventional structure such that a metal support plate 602 is connected with a strip cleaning blade 603. When such a cleaning blade is used, a stress is concentrated to a portion 603*s* of the blade 603, which is near an end 602*b* of the metal support plate 602. In this case, if the portion 603*s* has an insufficient mechanical strength, a problem in that the portion 603*s* is buckled before the lives of the blade 603 and other parts expire. When the blade is buckled, a high linear pressure cannot be applied to the contact point at which the blade is contacted with the surface of a material to be cleaned, and thereby the problem in that toner particles pass through the nip between the blade and the surface of the material cannot be avoided.

For example, when the blade 13 listed in Tables 5 and 6, which has a hardness of 70°, is used under a condition of 1.0 mm in deformation amount (d) and 20° in contact angle β, the linear pressure applied to the blade is 0.49 N/cm (50 gf/cm), which is much less than the lower limit (0.784 N/cm) of the linear pressure. By using a reinforcement for the cleaner, the buckling problem can be avoided. Then the improved cleaner will be explained.

Figure 41:
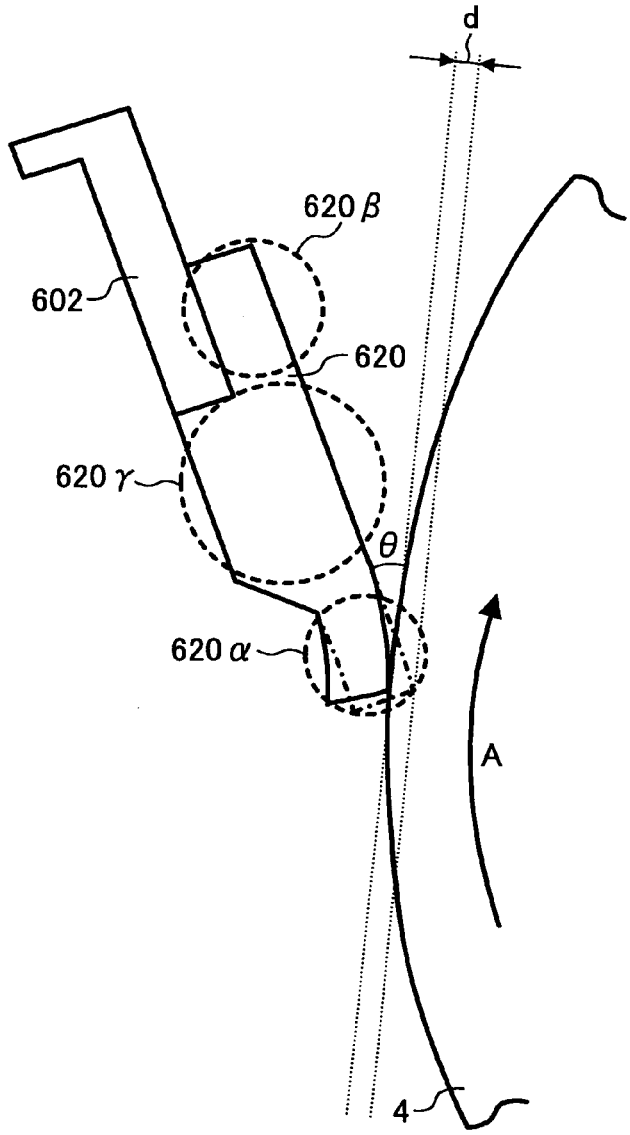
FIGS. 41 and 42 are schematic views illustrating another embodiment of the cleaner of the present invention.
Figure 42:
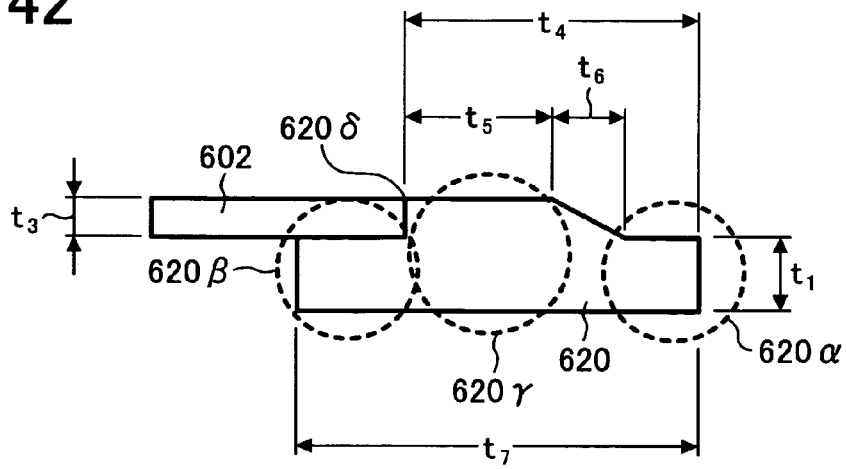

FIGS. 41 and 42 are schematic views illustrating another embodiment of the cleaner of the present invention.

As illustrated in FIG. 42, the cleaner has a convex blade 620 which has a thick central portion 620γ and thin end portions 620α and 620β. A back surface of the thin end portion 620β and a rear end of the thick central portion 620γ is connected with a metal support plate 602. Thus, the cleaner has a reinforced structure because the stress applied to the portion of the blade near the front edge of the support plate can be dispersed. Therefore, the buckling problem can be avoided.

Experiment 6

The blades Nos. 13, 18 and 20 listed in Tables 5 and 6, which could not obtain a high linear pressure, were modified so as to have the reinforced structure illustrated in FIG. 42 to measure the linear pressure of the modified blades Nos. 13', 18' and 20'. The hardness and repulsion elastic coefficient of the modified blades are the following, which is the same as those of the blades Nos. 13, 18 and 20, respectively.

Blade No. 13': Hardness of 70°; repulsion elastic coefficient of 8.0%

Blade No. 18': Hardness of 71°; repulsion elastic coefficient of 17%

Blade No. 20': Hardness of 72°; repulsion elastic coefficient of 23%

Other conditions are as follows:

t3: 1.6 mm t1: 2.0 mm t4: 7.0 mm t7: 11 mm t5: 4.0 mm t6: 1.6 mm

The results are shown in Table 7.

TABLE 7

| | | Deformation amount (d) (mm) | | |
|---|---|---|---|---|
| | | 1 | 0.7 | 0.4 |
| Blade No. 13 | Conventional shape | 0.49 | 0.3234 | — |
| Blade No. 13' | Reinforced shape | 1.2642 | 1.0682 | 0.8232 |
| Blade No. 18 | Conventional shape | 0.6762 | 0.392 | — |
| Blade No. 18' | Reinforced shape | 1.3132 | 1.0976 | 0.9016 |
| Blade No. 20 | Conventional shape | 0.7154 | 0.5488 | — |
| Blade No. 20' | Reinforced shape | 1.2936 | 1.029 | 0.8428 |

It is clear from Table 7 that each of the reinforced blades Nos. 13', 18' and 20' has a high linear pressure greater than the lower limit (0.784 N/cm) of the linear pressure. Therefore, it becomes possible to well clean the surface of a material to be cleaned.

Since these blades have a relatively low hardness compared to the blades Nos. 15, 19, 21 and 22 listed in Tables 5 and 6, the blades can be closely contacted with the surface of the material to be cleaned. Therefore, the reinforced blades have better cleanability.

However, the reinforced blades have too high a linear pressure greater than the upper limit 1.176 N/cm when the deformation amount (d) is 1.0 mm. When the linear pressure is too high, problems in that a high driving torque has to be applied to the photoreceptor and the life of the material to be cleaned is shortened occur. Therefore, the upper limit of the linear pressure is about 1.176 N/cm (120 gf/cm). In this embodiment, the blade No. 13' is preferably used under a condition of 0.7 mm in deformation amount (d).

Then the image forming apparatus of the present invention having the above-mentioned cleaning blade will be explained.

Figure 43:
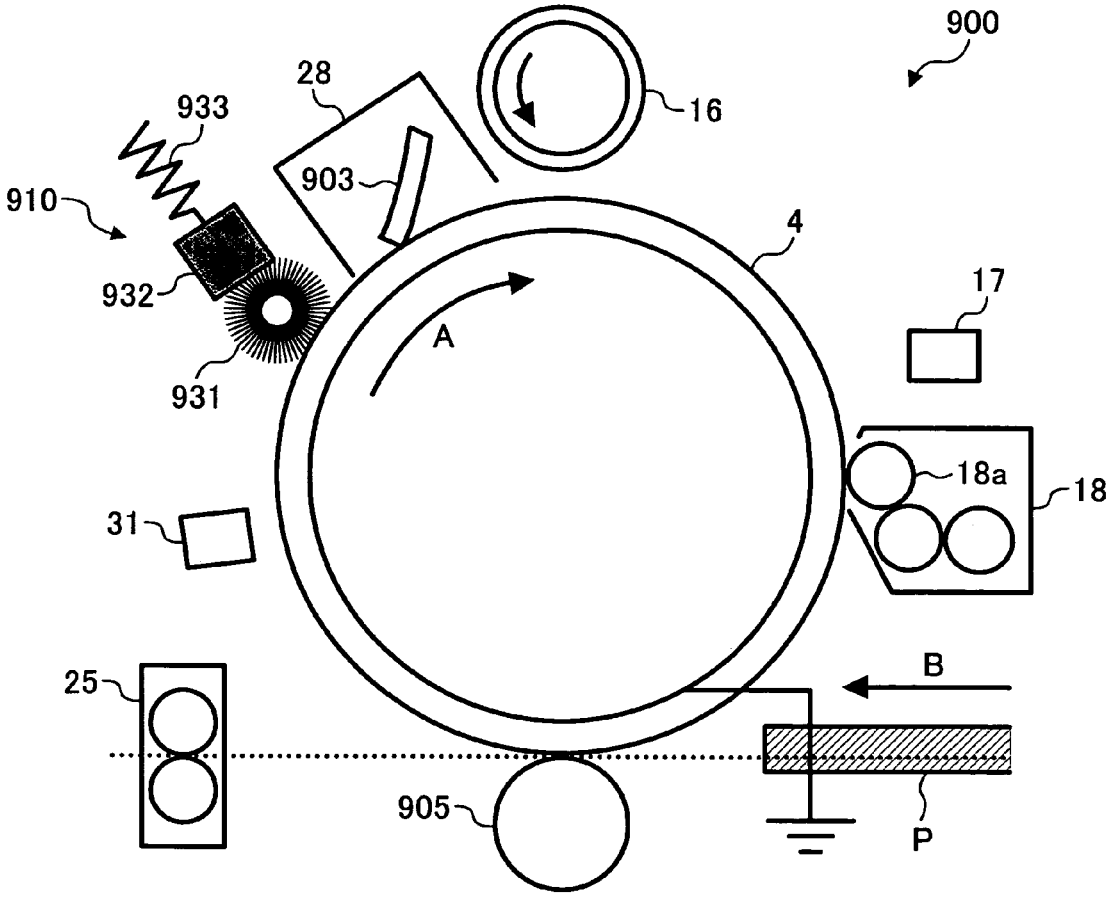
FIG. 43 is a schematic view illustrating another embodiment of the image forming apparatus of the present invention.

FIG. 43 illustrates another embodiment of the image forming apparatus of the present invention which uses the cleaning device of the present invention.

An image forming apparatus 900 includes a photoreceptor drum 4 which serves as an image bearing member and rotates in a direction A, a charger 16, a light irradiator 17, a developing device 18 having a developing roller 18*a*, a transfer device 905, a fixing device 25, a discharger 31, a lubricant applicator 910 including a solid lubricant 932, a brush 931 and a spring 933, and the cleaning device 28 having a cleaner 903 of the present invention. As mentioned above, a toner image formed on the photoreceptor 4 is transferred onto a receiving paper P which is fed in a direction B by the transfer device 905 while the photoreceptor 4 is grounded.

The charger 16 for use in the image forming apparatus will be explained in detail.

Corona charging methods using corona discharging have been used for the charger. In corona charging methods, a high voltage is applied to a charge wire which is provided so as to be close to the surface of a material (such as photoreceptors) to be charge to cause a corona discharging between the charge wire and the material, thereby charging the material. However, corona discharging generates materials such as ozone and nitrogen oxide (NOx). Such discharge products form a film of nitric acid or a nitrate on the surface of the photoreceptor, which film adversely affects properties of the photoreceptor. Therefore, it is preferable to prevent generation of such discharge products.

Recently, various contact charging methods and short-range charging methods have been developed to reduce the amount of discharge products generated. In these methods, a voltage is applied to a charging member such as rollers, brushes and blades is contacted with or is set so as to be close to the surface of a photoreceptor to charge the surface of the photoreceptor. These charging methods have advantages such that the applied voltage can be decreased and the amount of discharge products can be reduced. In addition, the charging device can be minimized in size, and is preferably used for a small-sized image forming apparatus.

One embodiment of the non-contact charger will be explained.

When a spherical toner is used, the bad cleaning problem tends to occur relatively easily compared to the case where a conventional pulverization toner is used. Even when the cleaner of the present invention, which hardly causes the bad cleaning problem, is used and toner particles pass through the nip between the blade and the surface of the photoreceptor by any chance, the non-contact charger is not contaminated with the toner particles and thereby occurrence of a problem in that abnormal image are formed due to adhesion of the toner particles to the charger can be prevented.

Referring to FIG. 43, an AC voltage is applied to the charger 16, which is set so as to be close to the surface of the photoreceptor 4 to charge the photoreceptor. The reason is as follows. When the charger is contacted with the photoreceptor, an elastic material has to be used as the charger 16 to improve the contacting property of the charger with the surface of the photoreceptor. When such an elastic material is used, the width of the nip between the charger and the photoreceptor increases, and thereby the materials in the protective layer of the photoreceptor or other foreign materials present on the surface are easily adhered to the charger. Therefore, in order to prevent such problems, non-contact chargers are preferably used.

Figure 44:
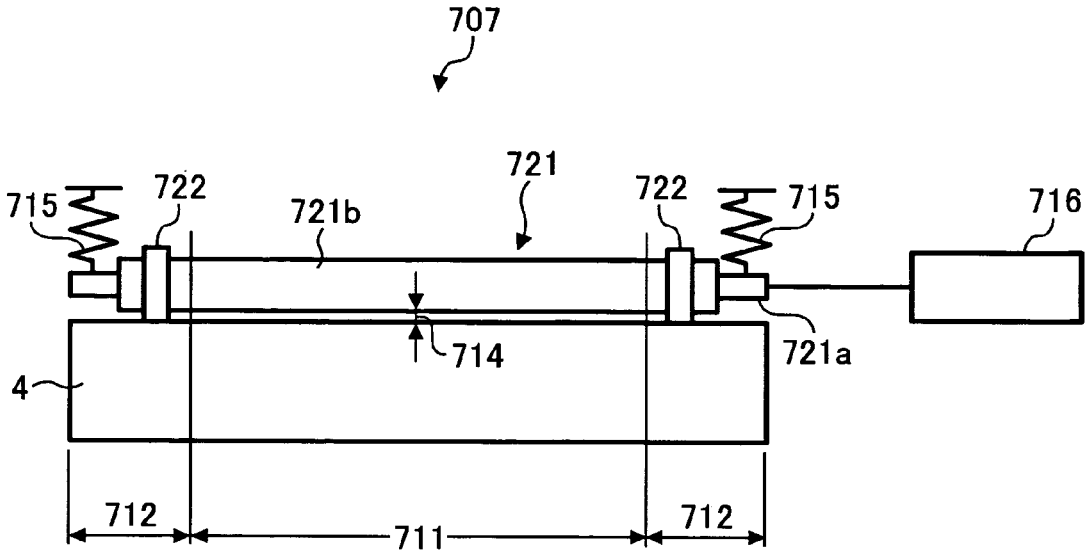
FIG. 44 is a schematic view illustrating a non-contact charger for use in the image forming apparatus of the present invention.

FIG. 44 is a schematic view illustrating a non-contact charger (a short-range charger) for use in the image forming apparatus of the present invention.

A charger 707 has a charging roller 721, spacers 722, springs 715, and an electric power source 716. The charging roller 721 has a shaft 721*a* and a roller portion 721*b* which serves as a charging portion and charges the surface of the photoreceptor 4. Spacers 722 contact non-image forming portions 712 located at both ends of the photoreceptor 4 to form a small gap 714 between the surface of the roller portion 721*b* and the surface 711 of the photoreceptor 4. The charging roller 721 is rotated by rotation of the photoreceptor 4. The gap 714 is generally from 1 to 100 μm, and preferably from 30 to 65 μm. In this embodiment, the gap is set so as to be 50 μm.

The springs 715 press the shaft 721*a* to keep the gap 714 uniform.

The power source 716 is connected with the charging roller 721. The power source 716 applies a DC voltage overlapped with an AC voltage to the charging roller 721 to cause discharge at the gap 714, thereby charging the surface of the photoreceptor 4. By applying a DC voltage overlapped with an AC voltage, the potential of the charged photoreceptor can be uniformized even when the gap varies.

The charging roller 721 has a metal core serving as an electroconductive support and a resistance controlling layer formed on the metal core. In this embodiment, the diameter of the charging roller 721 is 10 mm.

The surface of the charging roller 721 is made of a known material such as rubbers and resins, and preferably made of a resin. When a rubber is used for the surface of the charging roller 721, it is difficult to keep the gap 714 uniform because rubbers tend to absorb water or bend. Depending on the conditions of the charging roller 721, there is a case where the central portion of the charging roller contacts the surface of the photoreceptor, resulting in uneven charging of the photoreceptor. It is difficult to fix such a problem when a rubber is used. Therefore it is preferable to use a hard material such as resins for the surface of the photoreceptor.

In order to form a hard layer on the charging roller, the following materials can be preferably used. Specifically, a resin layer including a thermoplastic resin (such as polyethylene, polypropylene, polymethyl methacrylate and polystyrene) and a an ionic electroconductive polymer dispersed in the thermoplastic resin is formed as the resistance controlling layer. The surface of the resin layer is preferably crosslinked with a crosslinking agent. Specifically, the crosslinked surface can be prepared by dipping the resin layer into a treatment liquid including an isocyanate-containing compound.

Figure 45:
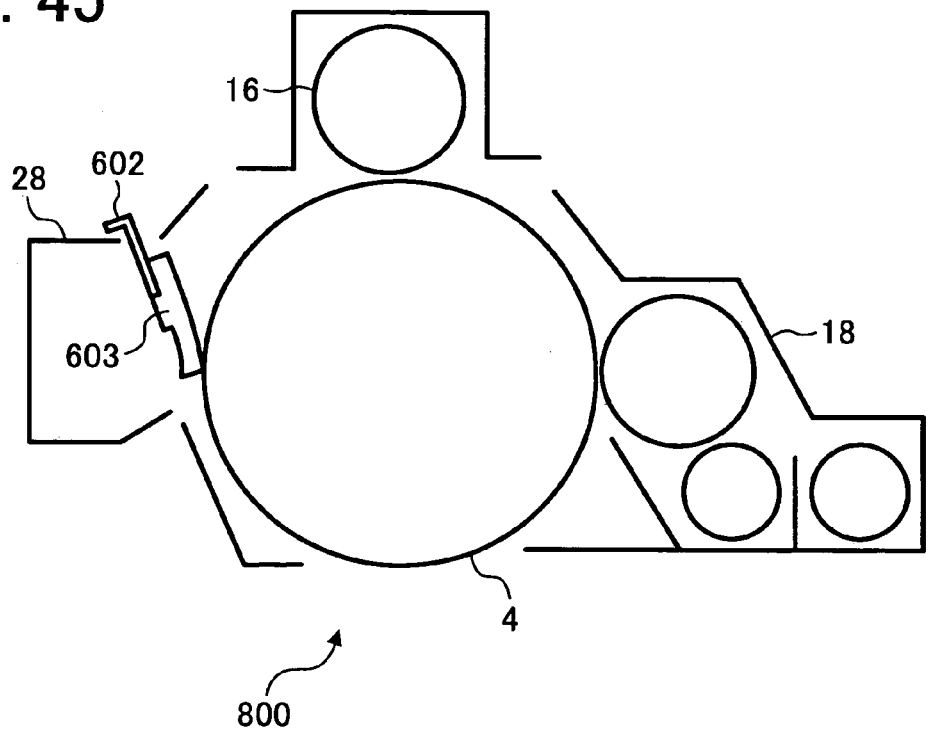
FIG. 45 is a schematic view illustrating another embodiment of the image forming apparatus of the present invention.

FIG. 45 illustrates an image forming apparatus for which the cleaning blade of this embodiment is used. The image forming apparatus has a process cartridge 800 which includes at least a cleaning device 28 having a support plate 602 and a blade 603, and a photoreceptor drum 4, which are united. In this process cartridge, a charger 16 and a developing device 18 are also provided. When the lives of the blade and photoreceptor expire, the user can easily change the devices by replacing the process unit with a new process cartridge. The process cartridge has a heat insulating structure to minimize the temperature change in the process cartridge. When a urethane rubber is used for the blade, the repulsion elasticity of the blade changes if the environmental conditions vary, thereby causing a problem in that the cleanability of the cleaning device deteriorates. When the process cartridge has such a heat insulating structure, occurrence of such a problem can be prevented. The heat insulating structure can be formed by adhering a heat insulating sheet (such as foamed materials) to the inner wall of the process cartridge, but the method is not limited thereto.

Then a first example of the fifth embodiment of the cleaner will be explained.

As illustrated in FIG. 41, the blade of the first example of the fifth embodiment has a thick central portion 620γ, which serves as a reinforcement, to prevent occurrence of buckling of the blade. However, the reinforcement is not limited thereto. It is preferable to provide a reinforcement on a surface of the blade from the stress-concentrated portion 603*s* to the tip portion of the blade.

Figure 46A:
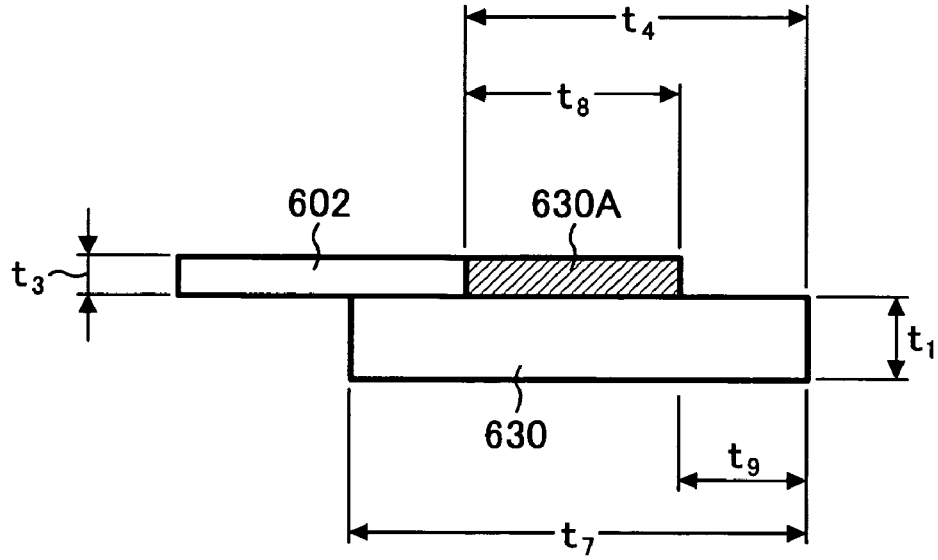
FIGS. 46A and 46B are schematic views illustrating other examples of the reinforced cleaning blade of the present invention.
Figure 46B:
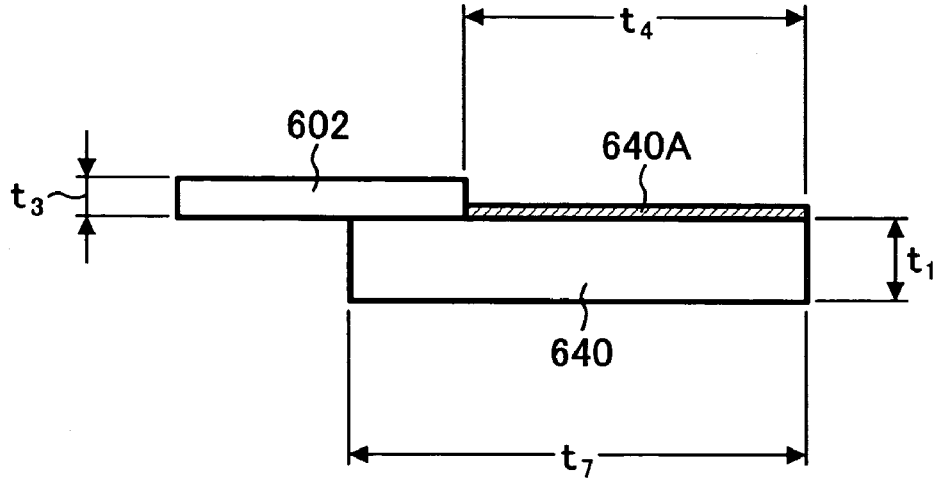

FIGS. 46A and 46B illustrate other examples of the reinforced cleaning blade.

The cleaner illustrated in FIG. 46A has a metal support 602, a reinforcement 630A having a length of t8 and a thickness t3 which is the same as that of the metal support 602, and an elastic blade 630 having a length of t7 and a thickness of t1. In this example, a length t9 of the free portion of the elastic blade is 3.0 mm, but the length t6 is not limited thereto. The metal support 602 is not contacted with a portion of the blade having a length of t4.

The reinforcement 630A, which is made of a material which is the same as or different from that of the metal support, is adhered to the back surface of the elastic blade 630. It is preferable to use a material, which has a hardness higher than that of the elastic blade 630 and lower than that of the metal support 602 for the reinforcement.

The cleaner illustrated in FIG. 46B has a metal support 602, a reinforcement 640A having a length of t4 and a thickness which is less than that of the metal support 602, and an elastic blade 640 having a length of t7 and a thickness of t1. The reinforcement 640A is adhered to the entire of the back surface of the free portion of the elastic blade 640, but the length of the reinforcement 640A is not limited thereto.

By using such simple reinforcements, cleaners (including conventional cleaners) can be reinforced and thereby occurrence of the buckling problem can be prevented. Such reinforcements can be used, not only for the blades listed in Tables 5 and 6, which have an insufficient cleanability due to their low hardness, but also the blades having a good cleanability. In addition, such reinforcements can be used for the blades having a high hardness because there is a case where such blades with a high hardness also cause the buckling problem.

In addition, by adjusting the thickness t1 of the blade of the cleaner having a configuration illustrated in FIG. 40 to adjust the deformation amount (d) of the edge portion of the blade, a linear pressure not less than the lower limit linear pressure (0.784 N/cm) can be obtained.

Then another example of the fifth embodiment of the cleaner will be explained.

The blade of the fifth embodiment of the cleaner uses a material having a low repulsion elastic coefficient to prevent occurrence of the stick-slip movement. However, by decreasing the friction coefficient of the surface of the photoreceptor 4, occurrence of the stick-slip movement can also be prevented.

As illustrated in FIG. 43, the image forming apparatus has the lubricant applicator 910 which coats the lubricant 932 on the surface of the photoreceptor 4 using the fur brush 931. By coating a lubricant on the surface of the photoreceptor to decrease the friction coefficient thereof, occurrence of the stick-slip movement can be prevented more securely when this technique is used in combination with the cleaner of the present invention. When a spherical toner is used, the amplitude of the stick-slip movement largely depends on the friction coefficient of the surface of the photoreceptor. By decreasing the friction coefficient of the surface of the photoreceptor, the chance of occurrence of the stick-slip movement can be dramatically decreased.

Alternatively, a lubricant can be included in a toner or an outermost layer of the image bearing member (such as photoreceptors).

Experiment 7

Each of the blades Nos. 13 and 18 which had been modified to have the reinforcement illustrated in FIG. 42, and the blades Nos. 15 and 19 which do not have a reinforcement was set on the image forming apparatus illustrated in FIG. 43 while a lubricant is or is not applied to the surface of the photoreceptor 4 to evaluate the variation dθ of the actual cleaning angle θ of the blade.

The experimental conditions are as follows:

Friction coefficient μ of photoreceptor: not greater than 0.2 (when measured by an Euler belt method)

Linear speed of photoreceptor: 100 mm/s

Contact angle β: 20°

The results are shown in Table 8.

TABLE 8

| | Conditions of blade | | | | d θ | |
|---|---|---|---|---|---|---|
| Blade | REC* (23° C.) | Shape | d (mm) | Linear press. (N/cm) | No lubricant | Lubricant coated |
| No. 13 | 8 | Reinforced | 0.4 | 0.8232 | 14 | 9 |
| No. 15 | 11 | Conventional | 1 | 0.7938 | 10 | 8 |
| No. 18 | 17 | Reinforced | 0.4 | 0.9016 | 15 | 11 |
| No. 19 | 18 | Conventional | 1 | 0.833 | 16 | 12 |

REC*: Repulsion elastic coefficient

It is clear from Table 8 that the variation dθ can be decreased when a lubricant is coated on the surface of the photoreceptor. Therefore, the chance of occurrence of the stick-slip movement can be decreased.

Suitable materials for use as the lubricant include a material having a lamellar structure such as zinc stearate. Since the materials having a lamellar structure in which an amphipathic molecule forms a layered structure, the materials have such a property that when a shearing force is applied thereto, the layers are separated from each other, and thereby a low friction coefficient can be imparted to the surface of the photoreceptor. Other materials such as fatty acid, fatty acid salts, waxes, silicone oils can also be used as the lubricant.

Specific examples of the fatty acids include undecylic acid, lauric acid, tridecylic acid, myristic acid, palmitic acid, pentadecylic acid, stearic acid, heptadecylic acid, arachic acid, montanic acid, oleic acid, arachidonic acid, capric acid, caproic acid, etc. Specific examples of the metals of the fatty acid metal salts include zinc, iron, copper, magnesium, aluminum, calcium, etc.

This document claims priority and contains subject matter related to Japanese Patent Applications Nos. 2004-141653, 2004-142191, 2004-194300 and 2004-151225, filed on May 11, 2004, May 12, 2004, Jun. 30, 2004 and May 21, 2004, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A cleaner for cleaning a surface of a rotating material, comprising:

an elastic blade arranged to counter the rotating material while a tip of the elastic blade is contacted with the surface of the rotating material to clean the surface of the rotating material, wherein the elastic blade has a first surface facing the rotating material, and a second surface opposite to the first surface, and wherein the elastic blade has a recessed portion, which has a bottom surface and a wall, in a rear portion of the second surface thereof; and a support plate configured to support the elastic blade, wherein the support plate has a first surface facing the rotating material, a second surface opposite to the first surface and a tip surface, wherein the elastic blade is connected with the support plate in such a manner that the bottom surface and the wall of the recessed portion of the blade are contacted with the first surface and the tip surface of the support plate, respectively.

2. The cleaner according to claim 1, wherein the elastic blade is not contacted with the second surface of the support plate.

3. The cleaner according to claim 1, wherein the blade satisfies the following relationship:

$$t1<t2,$$

wherein t1 represents a thickness of a tip portion of the blade and t2 represents a maximum thickness of a front portion of the blade, which portion is not contacted with the support plate.

4. The cleaner according to claim 3, wherein the cleaner satisfies the following relationship:

$$t1<t2\leqq t3+t1,$$

wherein t3 represents a thickness of the support plate.

5. The cleaner according to claim 3, wherein the cleaner satisfies the following relationship:

$$t3+t1\leqq t2,$$

wherein t3 represents a thickness of the support plate.

6. The cleaner according to claim 1, wherein the cleaner satisfies the following relationship:

$$\theta 1\leqq\theta 2,$$

wherein θ1 represents an angle formed by the first surface of the elastic blade and a tangent line to the surface of the rotating material at a contact point, in which the tip of the elastic blade is contacted with the surface of the rotating material; and θ2 represents an angle formed by the first surface of the elastic blade and a line connecting the contact point and an upper edge of the wall of the recessed portion.

7. The cleaner according to claim 1, wherein the elastic blade has a JIS A hardness of from 65° to 80°.

8. The cleaner according to claim 1, wherein the elastic blade has a repulsion elastic coefficient not greater than 30% at 24° C.±3° C., and a repulsion elastic coefficient variation not greater than 350% in a temperature range of from 10° C. to 40° C.

9. The cleaner according to claim 1, further comprising:
a reinforcement connected with a portion of the second surface of the elastic blade.

10. The cleaner according to claim 9, wherein the reinforcement is connected with the portion of the second surface of the elastic blade and a portion of the tip surface of the support plate.

11. The cleaner according to claim 9, wherein the reinforcement is connected with the portion of the second surface of the support plate and a portion of the wall of the recessed portion of the elastic blade.

12. The cleaner according to claim 9, wherein the reinforcement has a Young's modulus greater than that of the elastic blade.

13. The cleaner according to claim 1, wherein the elastic blade has an elastic reinforcement on a portion of the second surface thereof and wherein the elastic reinforcement is connected with only the portion of the second surface of the elastic blade and the tip surface of the support plate.

14. The cleaner according to claim 13, wherein the elastic reinforcement is not contacted with the second surface of the support plate.

15. The cleaner according to claim 13, wherein the elastic reinforcement comprises an elastic plate.

16. The cleaner according to claim 13, wherein the elastic reinforcement comprises an elastic adhesive.

17. The cleaner according to claim 13, wherein the elastic reinforcement has substantially a same width in a longitudinal direction of the cleaner.

18. The cleaner according to claim 13, wherein the elastic reinforcement has a width less than a length of a front portion of the blade, which portion is not contacted with the support plate.

19. The cleaner according to claim 13, wherein the elastic reinforcement has a JIS A hardness not less than that of the blade.

20. The cleaner according to claim 13, wherein the elastic reinforcement comprises a metal foil.

21. A process cartridge comprising:
an image bearing member configured to bear a toner image thereon;
a cleaner configured to clean a surface of the image bearing member,
wherein the cleaner is the cleaner of claim 1, and wherein the process cartridge is detachably set in an image forming apparatus.

22. The process cartridge according to claim 21, wherein the elastic blade has an elastic reinforcement on a portion of the second surface thereof, and wherein the elastic reinforcement is connected with only the portion of the second surface of the elastic blade and the tip surface of the support plate.

23. An image forming apparatus comprising:
an image bearing member configured to bear an electrostatic latent image on a surface thereof;
a developing device configured to develop the electrostatic latent image with a developer comprising a toner to form a toner image on the surface of the image bearing member;
a transfer device configured to transfer the toner image onto a receiving material; and
a cleaner configured to clean the surface of the image bearing member,
wherein the cleaner is the cleaner according to claim 1.

24. The image forming apparatus according to claim 23, wherein the elastic blade has an elastic reinforcement on a portion of the second surface thereof, and wherein the elastic reinforcement is connected with only the portion of the second surface of the elastic blade and the tip surface of the support plate.

25. A cleaner for removing toner particles present on a rotating image bearing member, comprising:
an elastic blade arranged to counter the rotating image bearing member while a tip of the elastic blade is contacted with the surface of the rotating material and achieves a stick state to remove the toner particles; and
a support plate configured to support the elastic blade, wherein just after a toner particle passes through a portion of the tip of the elastic blade contacting a surface of the image bearing member, the portion of the tip of the elastic blade moves in a direction opposite to a rotation direction of the image bearing member at a length less than 8 μm,
wherein the elastic blade a JIS A hardness of from 70° to 80°, and a repulsion elastic coefficient of from 8% to 30% at 23° C., and wherein the blade is pressed to the image bearing member at a linear pressure of from 0.784 N/cm (80 gf/cm) to 1.176 N/cm (120 gf/cm).

26. The cleaner according to claim 25, further comprising:
a pressing member configured to press a portion of a first surface of the elastic blade opposite to a second surface of the elastic blade facing the surface of the image bearing member in a normal line direction at a point of the image bearing member contacted with the tip of the elastic blade.

27. The cleaner according to claim 26, wherein the pressing member presses only a tip portion of the elastic blade.

28. The cleaner according to claim 27, wherein the pressing member presses only a tip portion of the elastic blade in such a manner that the pressure is applied to the surface of the image bearing member from a normal line direction at the point of the image bearing member contacted with the tip of the elastic blade.

29. The cleaner according to claim 27, wherein the pressing member presses only the tip portion of the elastic blade with an elastic member therebetween, wherein the elastic member has a repulsion elastic coefficient greater than that of the elastic blade.

30. The cleaner according to claim 27, wherein the pressing member comprises:
a piezoelectric element configured to press the tip portion of the elastic blade; and
a voltage controller configured to control a voltage applied to the piezoelectric element.

31. The cleaner according to claim 27, wherein the pressing member comprises a metal plate having a thickness of from 0.1 mm to 0.5 mm and one of an end thereof is fixed to the metal plate, and wherein the metal plate is bent to press the tip portion of the elastic blade using a restoring force of the bent metal plate.

32. An image forming apparatus comprising:
an image bearing member configured to bear a toner image on a surface thereof while rotating in a direction; and
a cleaner configured to clean toner particles remaining on the surface of the image bearing member, wherein the cleaner comprises:
a support plate;
an elastic blade having a repulsion elastic coefficient of from 8.0% to 30% and a JIS A hardness of from 70° to 90°, wherein a second surface of the elastic blade opposite to a first surface thereof facing the surface of the image bearing member is connected with the support plate, and a reinforcement located on the second surface of the elastic blade while being contacted with the support plate, wherein the elastic blade is arranged so as to counter the rotating image bearing member while a tip of the blade is contacted with the surface of the image bearing member at a linear pressure of from 0.784 N/cm (80 gf/cm) to 1.176 N/cm (120 gf/cm).

33. The image forming apparatus according to claim 32, wherein the elastic blade has a convex form, and a thick central portion of the elastic blade serves as the reinforcement, and wherein a rear wall of the thick central portion is contacted with a tip surface of the support plate.

34. The image forming apparatus according to claim 32, wherein the reinforcement is located on the second surface of the elastic blade while a rear surface of the reinforcement is contacted with a tip surface of the support plate.

35. The image forming apparatus according to claim 32, wherein the elastic blade comprises a polyurethane elastomer.

36. The image forming apparatus according to claim 32, wherein the toner comprises a lubricant.

37. The image forming apparatus according to claim 32, further comprising:

a lubricant applicator configured to apply a lubricant to a surface of the image bearing member.

38. The image forming apparatus according to claim 32, wherein the image bearing member comprises a lubricant in an outermost layer thereof.

39. The image forming apparatus according to claim 32, wherein the image bearing member comprises a filler in an outermost layer thereof.

40. The image forming apparatus according to claim 32, wherein the image bearing member comprises a crosslinked resin in an outermost layer thereof.

41. The image forming apparatus according to claim 40, wherein the crosslinked resin comprises a charge transport moiety in a molecule thereof.

42. A process cartridge comprising:

an image bearing member configured to bear a toner image on a surface thereof while rotating in a direction; and a cleaner configured to clean toner particles remaining on the surface of the image bearing member, wherein the cleaner comprises:

a support plate;

an elastic blade having a repulsion elastic coefficient of from 8.0% to 30% and a JIS A hardness of from 70° to 90°, wherein a second surface of the elastic blade opposite to a first surface thereof facing the surface of the image bearing member is connected with the support plate, and a reinforcement located on the second surface of the elastic blade while being contacted with the support plate, wherein the elastic blade is arranged so as to counter the rotating image bearing member while a tip of the blade is contacted with the surface of the image bearing member at a linear pressure of from 0.784 N/cm (80 gf/cm) to 1.176 N/cm (120 gf/cm), and wherein the process cartridge is detachably set in an image forming apparatus.

43. The process cartridge according to claim 42, wherein the process cartridge has a heat insulating structure.

* * * * *